US007896056B2

(12) United States Patent
Ben-David

(10) Patent No.: US 7,896,056 B2
(45) Date of Patent: Mar. 1, 2011

(54) MANUALLY OPERATED VENETIAN BLIND

(76) Inventor: Avigdor Ben-David, Yehud (IL)

( * ) Notice: Subject to any disclaimer, the term of this patent is extended or adjusted under 35 U.S.C. 154(b) by 0 days.

(21) Appl. No.: 11/659,518

(22) PCT Filed: Jul. 14, 2005

(86) PCT No.: PCT/IL2005/000747

§ 371 (c)(1),
(2), (4) Date: Mar. 11, 2008

(87) PCT Pub. No.: WO2007/007308

PCT Pub. Date: Jan. 18, 2007

(65) Prior Publication Data

US 2008/0216966 A1 Sep. 11, 2008

(51) Int. Cl.
*E06B 9/26* (2006.01)

(52) U.S. Cl. ..... 160/107; 160/168.1 R; 160/176.1 R

(58) Field of Classification Search ..... 160/107, 160/168.1 R, 176.1 R, 173 R, 177 R, 172 R, 160/190, 193, 84.06
See application file for complete search history.

(56) References Cited

U.S. PATENT DOCUMENTS 1,463,877 A * 8/1923 Dickinson ..... 16/218
2,389,956 A * 11/1945 Castilonia ..... 160/172 R
2,639,766 A * 5/1953 Pratt ..... 160/40
3,702,040 A 11/1972 Roy
3,721,285 A * 3/1973 Debs ..... 160/172 R
3,818,969 A * 6/1974 Debs ..... 160/168.1 R
4,444,243 A * 4/1984 Voney et al. ..... 160/172 R
4,456,049 A * 6/1984 Vecchiarelli ..... 160/176.1 R
4,480,674 A * 11/1984 Anderson ..... 160/107
4,484,611 A * 11/1984 Anderson ..... 160/107
4,513,804 A * 4/1985 Anderson ..... 160/174 R
4,588,012 A * 5/1986 Anderson ..... 160/174 R
4,685,502 A * 8/1987 Spangenberg ..... 160/107
4,723,586 A * 2/1988 Spangenberg ..... 160/107
4,768,576 A * 9/1988 Anderson ..... 160/107
4,817,698 A * 4/1989 Rossini et al. ..... 160/107

(Continued)

FOREIGN PATENT DOCUMENTS

DE 9002677 6/1990

(Continued)

*Primary Examiner*—Katherine Mitchell
*Assistant Examiner*—Jaime F Cardenas-Garcia
(74) *Attorney, Agent, or Firm*—Kinney & Lange, P.A.

(57) ABSTRACT

In one embodiment, a manually operated internal Venetian blind for raising/lowering a plurality of slats is disclosed, and comprises a stationary bearing housing, a longitudinally displaceable bifurcated bearing block, a counterweight interconnected to the bearing block and housing at least one internal magnet, and a first linearly displaceable actuator disposed outwardly to one of two glass sheets and provided with at least one external magnet at a fixed distance from the internal magnet. The displacement of the first actuator is significantly less than the displacement of the longitudinally lowest slat due to the winding of central cords around a ball bearing housed within the bearing block. In another embodiment, a device for tilting the slats to which two outer cords are affixed is provided with two laterally oriented sides and an annular protrusion rotatably supported by a suitable assembly secured to a support surface and transversally extending outwardly from each laterally oriented side, such that the tilting device is rotatable about a transversal axis coincident with the axis of the annular protrusions. An external blind is also disclosed.

39 Claims, 53 Drawing Sheets

U.S. PATENT DOCUMENTS

| | | | | |
|---|---|---|---|---|
| 4,917,167 | A * | 4/1990 | Voss et al. | 160/84.02 |
| 4,979,552 | A * | 12/1990 | van der Zanden | 160/107 |
| 5,226,466 | A * | 7/1993 | Coddens | 160/107 |
| 5,396,944 | A * | 3/1995 | Rossini | 160/107 |
| 5,671,793 | A * | 9/1997 | Lee | 160/168.1 R |
| 5,699,845 | A * | 12/1997 | Jelic | 160/107 |
| 5,996,668 | A * | 12/1999 | DeBlock et al. | 160/107 |
| 6,059,006 | A | 5/2000 | Rossini | |
| 6,065,524 | A * | 5/2000 | Rossini | 160/107 |
| 6,095,223 | A | 8/2000 | Rossini et al. | |
| 6,401,790 | B1 * | 6/2002 | Dai et al. | 160/107 |
| 6,516,858 | B1 * | 2/2003 | Anderson et al. | 160/168.1 P |
| 6,601,633 | B2 * | 8/2003 | Sun et al. | 160/107 |
| 7,000,670 | B2 * | 2/2006 | Kwon et al. | 160/107 |
| 7,124,803 | B2 * | 10/2006 | Jin et al. | 160/107 |
| 7,191,817 | B2 * | 3/2007 | Nicolosi | 160/84.06 |
| 7,337,824 | B2 * | 3/2008 | Berger | 160/107 |
| 7,475,715 | B2 * | 1/2009 | Gardner et al. | 160/107 |
| 7,543,623 | B2 * | 6/2009 | Allardyce et al. | 160/107 |
| 7,640,964 | B2 * | 1/2010 | Berger | 160/107 |
| 2003/0066614 | A1 * | 4/2003 | Sun et al. | 160/107 |
| 2003/0075285 | A1 * | 4/2003 | Anderson et al. | 160/90 |
| 2003/0089462 | A1 | 5/2003 | Wang | |
| 2003/0173036 | A1 * | 9/2003 | Kwon et al. | 160/107 |
| 2004/0211528 | A1 | 10/2004 | Jin et al. | |
| 2004/0226665 | A1 * | 11/2004 | Berger | 160/107 |
| 2006/0118250 | A1 * | 6/2006 | Jin et al. | 160/107 |
| 2006/0180279 | A1 * | 8/2006 | Bouchard | 160/107 |
| 2007/0017644 | A1 * | 1/2007 | Berger | 160/107 |
| 2007/0267152 | A1 * | 11/2007 | Fan | 160/84.06 |
| 2008/0029226 | A1 * | 2/2008 | Huang | 160/107 |
| 2008/0083511 | A1 * | 4/2008 | Hung | 160/168.1 R |
| 2008/0179018 | A1 * | 7/2008 | Berger | 160/107 |

FOREIGN PATENT DOCUMENTS

| | | |
|---|---|---|
| EP | 0109382 | 5/1984 |
| EP | 0245811 | 5/1987 |
| EP | 0902155 | 3/1999 |
| EP | 1087095 A1 | 3/2001 |

* cited by examiner

MANUALLY OPERATED VENETIAN BLIND

FIELD OF THE INVENTION

The present invention relates to the field of Venetian blinds. More particularly, the invention relates to a manually operated Venetian blind that can be lowered/raised and tilted effortlessly and speedily by means of a novel, reliable, and cost-effective operating mechanism.

BACKGROUND OF THE INVENTION

Shading devices have been traditionally used to reduce the area of glazing which is exposed to an influx of solar radiation.

Operable shading devices mounted exterior to windows are designed to control the incoming solar radiation. They may have a complex mechanism which requires maintenance or replacement, or may have an expensive automatic control system.

Other types of shading devices, such as roller shades, curtains or Venetian blinds, are installed within the interior of a building and are adapted to reflect incoming solar radiation back through the window before it can be absorbed and converted to heat. Recently, internal blinds, i.e. Venetian blinds that are arranged in a spaced parallel relationship and are placed between glass sheets in a double glazing unit or between the frames of a double window, have been employed.

Prior art Venetian blinds, must remain in an upright position, such that a longitudinal axis coinciding with each slat is essentially perpendicular to horizontally disposed flooring, during transportation, installation and while in use so that the slats and cords will not be in a state of disarray and be rendered unusable. If the longitudinal axis of the blind arrangement were not in an essentially vertical disposition, some of the blinds would touch the glazing, causing the cords which support the blinds to become entangled.

Venetian blinds are generally provided with at least two ladder braids, the number of ladder braids depending on the length of the slats. Each ladder braid is composed of two outer cords for tilting the slats, an inner cord for raising and lowering the slats, and a plurality of cross ladders. Each of the cross ladders is connected between the two outer cords and supports a corresponding horizontally disposed slat. The outer cords of prior art Venetian blinds, which provide a tilting motion, are directed to the tilting mechanism by means of a spacer placed on the outside of the uppermost slat. As a result, the weight of the slats is concentrated disproportionally more on the spacer and the uppermost slat than on the other slats, causing the slats to change their relative position, or even to fail, over the course of time. The tilting mechanism is usually a gear train that adds to the cost of the blind unit. Also, due to the angle of the cords the blinds cannot completely close and invariably only 75% of the incoming light is blocked.

Concerning the raising and lowering of prior art internal Venetian blinds, the actuation is generally by means of a magnet external to the glazing which linearly translates another magnet imbedded within the raising mechanism. The degree of raising or lowering of the blind is completely dependent on the displacement of the external magnet, and may take up to 2 minutes to raise the blind from a lowered position to a raised position. Due to the configuration of the cord and spacers, the area of the blind is limited to 2 sq. meters. A considerable force must be applied in order to raise the blind.

U.S. Pat. No. 3,702,040 discloses a Venetian blind structure that is adapted to be mounted within the air space of a double glazed sealed window unit. A plurality of elongated slats are pivotally mounted at their ends in a support frame, such that pins which protrude from a wheel secured to the pivot shaft of each slat abut transverse edges of a reciprocable actuating member driven by a gear train and therefore limit the angular position of the slats. The gear train is adapted to tilt the slats, but the Venetian blind structure is not provided with a means to raise or to lower the slats. Also the addition of the gear train adds to the cost of producing and assembling the blind structure.

U.S. Pat. No. 6,059,006 is another actuation device for adjusting the inclination of Venetian blinds arranged inside a double glazing unit. A first magnet is slidingly movable inside the sealed space of the double glazing unit, in response to the movement of a second magnet, which is located inside a box-like body connected outside the double glazing unit and driven by a cord stretching in a loop between two pulleys and connected to an actuation rod. The first magnet is fixed to a bush which is internally shaped complementarily to the helical profile of a shaft, so that translatory motion of the first magnet results in rotation of the shaft and of vertical adjustment chords to thereby synchronously adjust the inclination of the blinds about a longitudinal axis thereof. The complexity and cost of the apparatus is increased, due to the transmission system, as well as the actuator that is external to the double glazing unit.

U.S. Pat. No. 6,095,223 discloses an actuation unit that includes a magnetic kinematic coupling device which is connected to an electric motor and to a kinematic system for moving an internal Venetian blind. The apparatus of the actuation unit adds to the cost of the Venetian blind.

Other manually operated Venetian blinds mounted in a double glazing unit are disclosed in EP 0 245 811, EP 1 087 095, EP 0 902 155, U.S. Pat. Nos. 4,685,502, 4,768,576, US 2003/0089462, and US 2004/0211528.

It is an object of the present invention to provide a Venetian blind assembly which is incorporated in a permanently sealed double glazed window unit.

It is an object of the present invention to provide an internal Venetian blind assembly that provides for the tilting, raising and lowering of the slats.

It is an additional object of the present invention to provide an internal Venetian blind assembly in which means for tilting, raising and lowering of the slats are disposed internally to the double glazed window unit.

It is an additional object of the present invention to provide an internal Venetian blind assembly for which means for tilting, raising and lowering of the slats are manually actuated.

It is an additional object of the present invention to provide an internal Venetian blind assembly for which the tilting, raising and/or lowering of the slats can be reliably completed within approximately 2 seconds.

It is an additional object of the present invention to provide an internal Venetian blind assembly for which means for tilting, raising and lowering of the slats are relatively frictionless and can be easily assembled.

It is an additional object of the present invention to provide an internal Venetian blind assembly in which the means for tilting, raising and lowering of the slats do not incorporate a gear train, a set of pulleys or couplings.

It is yet an additional object of the present invention to provide an internal Venetian blind assembly that can be inverted without resulting in cord entanglement and can be operable immediately thereafter.

It is yet an additional object of the present invention to provide an internal Venetian blind assembly by which the slats may be tilted, raised and lowered while the blind assembly is disposed at an inclination of approximately 45 degrees with respect to the floor.

It is yet an additional object of the present invention to provide an internal Venetian blind assembly that blocks approximately 90% of the incoming light.

It is yet an additional object of the present invention to provide an internal Venetian blind assembly that overcomes the disadvantages of the prior art.

Other objects and advantages of the invention will become apparent as the description proceeds.

SUMMARY OF THE INVENTION

One embodiment of the present invention provides a manually operated internal Venetian blind which comprises an arrangement for raising/lowering a plurality of slats. The arrangement comprises:

a) A frame comprising a transversally extending headrail and lower support member, each of which having at least one planar support surface, and two longitudinally extending side members positioned at each transversal end of said blind, said frame being interposed between two glass sheets;

b) A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids further comprise a longitudinally extending central cord passing through each slat;

c) A transversally oriented slat support disposed underneath said plurality of slats to which each of said ladder braids is affixed;

d) A bearing housing for housing a ball bearing, wherein said bearing housing is secured to the upper longitudinal end of a first side member;

e) A bifurcated bearing block longitudinally displaceable within said first side member which houses a ball bearing;

f) A counterweight longitudinally displaceable within said first side member and integrally formed by a central portion and two outward portions, each of said outward portions being disposed laterally outwardly from said central portion, at least one internal magnet being housed in an outward portion, said bearing block and said counterweight being interconnected;

g) a stabilizer affixed proximate to the upper longitudinal end of said first side member; and h) a first linearly displaceable actuator disposed outwardly to one of said glass sheets and provided with at least one external magnet in opposed relation to, and at a fixed distance from, said internal magnet which is housed in said counterweight, said external and internal magnets being magnetically coupled, wherein each central cord is transversally oriented within said headrail, is wound around the ball bearing housed in said bearing housing, is further wound around the ball bearing housed in said bearing block, and the ends of each central cord are affixed to said stabilizer, said stabilizer thereby applying a reactive force to each of the central cords during displacement of said central cords, said counterweight and said bearing block being longitudinally displaceable upon linear displacement of said first actuator, the displacement of said first actuator being significantly less than the distance to which the longitudinally lowest slat is raised or lowered due to the winding of said central cords around the ball bearing of said bearing block.

The following are definitions for various terms that are referred to herein:

"internal Venetian blind"—a unit comprising a plurality of slats, frame, and operating mechanism, all interposed between two sheets of glass;

"external Venetian blind"—a unit comprising a plurality of slats, frame, and operating mechanism, which is not interposed between two sheets of glass;

"longitudinal"—in the direction between the headrail and lower rail or lower support member, generally denoting the direction to which the plurality of slats are raised and lowered;

"transversal"—in the direction to which the slats extend;

"lateral"—in the direction perpendicular to the longitudinal and lateral directions, in the direction between the two glass sheets of an internal Venetian blind;

"extending"—concerning an element having one side longer than the other side, in the direction of the longer side;

"oriented"—the disposition of a wall or face of an element which coincides with a longitudinally, transversally, or laterally positioned plane; for example, a wall may be longitudinally oriented while being transversally extending;

"inner" and "inwards"—in a direction towards the cavity between the two glass sheets;

"outer" and "outwards"—in a direction away from the cavity between the two glass sheets;

"upper," "upwards," and "above"—in a longitudinal direction closer to the headrail;

"lower," "downwards," and "below"—in a longitudinal direction away from the headrail;

"front"—in a lateral direction towards a user that manipulates the actuator; and "rear"—in a lateral direction away from a user that manipulates the actuator.

Preferably, the bearing housing has a laterally oriented base and two parallel, flexible rings which longitudinally protrude from said base, a ball bearing and a pair of plain bearings for supporting and positioning said ball bearing being housed in said bearing housing.

Preferably, the bifurcated bearing block comprises two symmetrical rectilinear sections for housing a ball bearing therebetween, each of said sections being formed of a laterally thicker portion and a laterally narrower portion, said thicker portion being above said narrower portion, each of said thicker portions being formed with a circular recess to receive therein a corresponding bearing flange and an annular portion outwardly protruding from the back of said recess in which a corresponding bearing axle is seated, wherein the narrower portions are mated such that each upper portion is spaced one from the other with only a bearing rim located between said bearing flanges being visible, a hole being bored through said mated narrower portions.

Preferably, a hole is bored through a portion of the central portion of the counterweight longitudinally protruding from said outward portions, said bearing block and counterweight are interconnected by means of a rope tied through the hole bored through said lower portions of said bearing block and through the hole bored through said central portion of the counterweight;

By winding the central cords about the ball bearings housed in the bearing housing and bearing block, respectively, and then affixing the ends of each central cord to the stabilizer, the central cords are subjected to a frictional force significantly less than that of the prior art. While prior art blinds require a full 100% stroke length to achieve a complete raising/lowering of the slats, the displacement of the actuator of the present invention is advantageously only 40% of the distance to which the longitudinally lowest slat is raised or lowered. Consequently, the slats of a blind having a surface area of up to 5 square meters can be lowered or raised effortlessly and speedily.

In one aspect, the outer cords and central cord of each ladder braid is disposed at essentially 90 degrees with respect to the support surface between the headrail and lower rail.

One embodiment of the present invention provides a manually operated internal Venetian blind which comprises an arrangement for tilting a plurality of slats. The tilting arrangement comprises:

a) Frame components comprising a transversally extending headrail and lower support member, each of which having at least one planar transversally oriented support surface, and two longitudinally extending side members positioned at each transversal end of said blind, a frame assembled from said frame components being interposed between two glass sheets;

b) A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids optionally further comprise a longitudinally extending central cord passing through each slat;

c) Device for tilting said plurality of slats to which two outer cords of a corresponding ladder braid are affixed, each of said tilting devices comprising two laterally oriented sides, a rectangular face perpendicular to said laterally oriented sides, and an annular protrusion transversally extending outwardly from each laterally oriented side, wherein said tilting device is rotatable about a transversal axis coincident with the axis of said annular protrusions, said annular protrusions being rotatably supported by a suitable assembly secured to a support surface of said headrail or said lower support member which is internal to said glass sheets;

d) Means for rotationally driving each of said tilting devices which is internal to said glass sheets; and e) A linearly displaceable actuator in communication with said driving means, wherein an outer cord is partially wound around, and tensioned by, a corresponding tilting device during rotation thereof following displacement of said actuator, said outer cord being subsequently longitudinally and laterally displaced, causing uniform tilting of each of said slats.

Several prior art internal Venetian blinds comprise a tilting mechanism disposed in the headrail by which outer cords of a ladder braid are wound around a cylindrical element, which is generally driven by gears, or any other type of transmission in communication with an actuator external to the Venetian blind. Since this cylindrical element is housed within the headrail, the circumference of the cylindrical element is laterally spaced from the lateral periphery of the slats across which the outer cords extend. Spacers placed on the transversal periphery of the uppermost slat are therefore needed to direct the outer cords to the cylindrical element.

In contrast, the tilting device of the present invention is configured such that two outer cords are affixed to a corresponding tilting device by two affixation means, respectively, that retain the cords in an essentially vertical disposition from the headrail to the lower support member. The weight of the slats is therefore more evenly distributed than in the prior art, allowing the slats of a blind having a higher surface area than has been known heretofore to be tilted with greater reliability and without use of a gear train.

When the slats are in a completely open position, the outer cords have equal tension. Upon displacement of the actuator, a first outer cord is partially wound around, and tensioned by, a tensing portion of the tilting device during rotation thereof to a first angular distance, while a second outer cord is slackened. The first outer cord is then drawn upwards and inwards, causing the slats to change their inclination with respect to a horizontal plane. Following additional displacement of the actuator, the first outer cord is further drawn upwards and inwards, causing an additional change in the inclination of the slats, and the second outer cord is drawn downwards. When the slats are in a closed position, the spacing between the two outer cords is at a minimum. During this stage, the tension of the first outer cord is maximum, and this maximum tension further assists in closing the slats by pressing on the top of each slat, thereby increasing the inclination thereof.

The blind may also be provided with an arrangement for raising/lowering the plurality of slats.

In one embodiment, the two outer cords are affixed to a corresponding tilting device by two affixation means, respectively, positioned along the transversal centerline of the rectangular face thereof in such a way that an outer cord contacts one of said two opposed faces when said rectangular face is parallel to said at least one support surface. Each affixation means comprises an aperture bored through the rectangular face and a corresponding nail having radial protrusions, said nail being received in said aperture. The radial protrusions are adapted to press an outer cord onto the wall of the aperture and to thereby retain the pressed portions of the outer cord in a fixed position relative to the rectangular face of the tilting device.

In one embodiment, the tilting device comprises:

a) a core member provided with— i. two laterally oriented walls;

ii. a convex periphery disposed between, and integral with, said laterally oriented walls in such a way that the axis of said periphery is transversally extending;

iii. a toothed key protruding from, and having a similar curvature as, said periphery;

iv. at least one coaxial protrusion extending transversally from each of said laterally oriented walls, wherein one of said coaxial protrusions extending from a corresponding laterally oriented wall is adapted to receive a D-shaped shaft for driving the tilting device and one of said coaxial protrusions is rotatably supported by a suitably sized opening formed in a cord guide assembly secured to a headrail or lower rail of the blind;

v. two separated coplanar elements defining a rectangular face which truncate said laterally oriented walls and said periphery such that the diameter of said at least one coaxial protrusion is greater than the maximum radial dimension between said periphery and said coplanar elements;

vi. two transversally extending grooves of bilateral symmetry having a rectangular cross section and obliquely oriented with respect to said coplanar elements, each of said grooves being formed at a different lateral side of said at least one coaxial protrusion;

vii. a portion for tensing an outer cord formed between one of said grooves and the corresponding planar element; and viii. a circumferential, rectangularly shaped recess formed between said toothed key and a corresponding laterally oriented wall;

b) two oppositely oriented wing members which are engageable with said core member, each of said wing members being provided with— i. a convex shell having a curvature substantially equal to that of the periphery of said core member and being positioned such that the axis thereof is transversally extending;

ii. a first transversal end of said shell formed with two openings so as to define a central shell portion and two peripheral portions and with a lip circumferentially extending along the inner wall of said shell, each of said peripheral portions being considerably thicker than said central portion and being configured to be received within a corresponding groove of said core member;

iii. a second transversal end proximate to said toothed key having a laterally oriented circumferential wall extending between said two peripheral portions along the inner wall of said shell; and iv. a plurality of radially extending teeth formed in said laterally oriented circumferential wall, each of said teeth being configured with a sufficient length and spacing therebetween so as to abut complementary recessed sharp edge junctions of said toothed key;

wherein said teeth of each wing member retain a corresponding outer cord of a ladder braid of the blind which is placed on the periphery of said core member in pressed relation with said toothed key, wherein the lip of each of said wing member is adapted to engage a corresponding recess of said core member with a snapping action to prevent detachment of said corresponding outer cord from the tilting device, wherein an outer cord is partially wound around, and tensioned by, a corresponding tilting device during rotation thereof following displacement of a linearly displaceable actuator, said outer cord being subsequently longitudinally and laterally displaced, causing uniform tilting of a plurality of transversally extending slats each of which is supported by at least two ladder braids.

The central and outer cords are received in a cord guide assembly in immobilized engagement with the headrail or lower support member. A partitioned cord guide for separating each cord is secured to, or integrally formed with, a transversally oriented face of the cord guide assembly. The cord guide abuts the wall of an equally sized aperture formed in the support surface of the corresponding headrail or lower support member, thereby preventing movement in the transversal and lateral directions. The cord guide is substantially coplanar with the corresponding support surface.

The present invention is also directed to a linearly displaceable actuator for use in an internal Venetian blind, comprising:

a) An actuator guide mounted by a press fit between a glass sheet of the blind and a frame element of the wall opening in which the blind is placed, a linear track having an arcuate cross section being formed within said actuator guide;

b) An external magnet housing having a body with an inwardly facing cavity for the insertion therein of an external magnet and an L-shaped appendage protruding from said body, said L-shaped appendage being adapted to be slidingly displaceable within said track; and c) An internal magnet housing positioned within a frame component of said internal Venetian blind, said internal magnet housing being formed with an outwardly facing cavity for the insertion therein of an internal magnet in opposed relation to, and at a fixed distance from, said external magnet, an elongated element parallel to the back of said outwardly facing cavity, a bridge connecting between said elongated element and the back of said outwardly facing cavity, and coplanar abutment plates extending from each of the elongated element and cavity back to such a length that a gap is formed between said abutment plates, wherein a drive means for tilting or raising/lowering a plurality of slats is in communication with one of said abutment plates, said drive means operable upon displacement of said body.

In one aspect, the external magnet housing is suitable for adjusting the applied magnetic force by changing the number of magnets housed within the magnet retaining compartment.

The present invention is also directed to a driving assembly for a manually operated Venetian blind, comprising:

a) a rotatable cylindrical casing positioned within a headrail or side member of a blind frame, a hole being bored through the periphery of said casing;

b) means for receiving a transversally oriented shaft by which a tilting device of said blind is rotated;

c) an actuator cord fed through said hole bored through the periphery of said driving assembly in such a way that two portions of said actuator cord dangle in disengageable fashion from a diametrically opposite periphery of said casing; and d) an actuator in communication with said two portions of said actuator cord, wherein said casing and receiving means are an integral non-detachable unit, wherein the tensile force of at least one of said two portions of said actuator cord upon displacement of said actuator is sufficiently high to cause rotation of said driving assembly, whereby to drive said tilting device.

In one aspect, the casing is rotatably supported within the walls of a circular aperture formed within a first longitudinal end of a laterally oriented wall of a side member. The actuator cord is partially wound about a bearing element rotatingly supported by a bearing housing secured to a second longitudinal end of said side member and is fed through a linearly displaceable actuator. The ends of the actuator cord are tied to each other, the driving assembly and the shaft received therein being rotatable in unison upon displacement of said linearly displaceable actuator.

In one aspect, the receiving means is a D-shaped core to which a plurality of ribs radially extend from the inner face of the casing, said core coinciding substantially with the axis of the casing.

The present invention is also directed to an apparatus for the lateral centering of central cords of a manually operated Venetian blind, comprising:

a) A frame comprising a transversally extending headrail and lower support member, each of which having at least one transversally oriented planar support surface, and two longitudinally oriented side members positioned at each transversal end of said blind, said frame being interposed between two glass sheets;

b) A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids further comprise a longitudinally extending central cord passing through each slat; and c) A cord guide assembly secured to a headrail or to a lower support member, said cord guide assembly being provided with transversally and laterally oriented walls, a rectangular opening being formed in each lateral wall of said cord guide assembly, at essentially the lateral centerline thereof, said cord guide assembly being further formed with internal laterally oriented walls extending from a corresponding transversally oriented wall which are suitably configured so as to allow each axle of a bearing element to be rotatingly seated between a pair of said internal laterally oriented walls wherein the axis of said axles is laterally oriented, said cord guide assembly being further formed with a pair of parallel, transversally extending partitions, the spacing between said partitions being substantially equal to the lateral dimension of said rectangular opening, such that a central cord is transversally fed through said cord guide assembly via said rectangular openings and said partitions, wherein said partitions are adapted to limit the lateral movement of a central cord fed through said cord guide assembly and in contact with said bearing element when said blind is tilted, wherein a longitudinal wall of said rectangular opening is adapted to contact a central cord fed therethrough when the blind is completely inverted and to further urge said central cord to the lateral centerline of said cord guide assembly.

The present invention is also directed to a manually operated external Venetian blind, comprising:

a) A frame comprising a transversally extending headrail having a planar transversally oriented support surface;

b) A plurality of transversally extending, equally sized slats suspended from said headrail by means of at least two ladder braids, each ladder braid comprising two longitudinally extending outer cords being disposed laterally outwardly from a different lateral edge of the slats and a plurality of laterally extending cross ladders, each cross ladder being connected to the two outer cords and supporting a corresponding slat, wherein two outwardly positioned ladder braids further comprise a longitudinally extending central cord passing through each slat;

c) A cord guide assembly in immobilized engagement with said headrail comprising a transversally oriented and inwardly positioned face, two longitudinally oriented sides, and two laterally oriented sides, each of said laterally oriented sides being formed with an arcuate opening outwardly separated from said transversally oriented face;

d) A device for tilting said plurality of slats to which two outer cords of a corresponding ladder braid are affixed, each of said tilting devices comprising two laterally oriented sides, a rectangular face perpendicular to said laterally oriented sides, and an annular protrusion transversally extending outwardly from each laterally oriented side, wherein said tilting device is rotatable about a transversal axis coincident with the axis of said annular protrusions, said annular protrusions being rotatably supported by a corresponding annular opening of said cord guide assembly;

e) A transversally extending D-shaped shaft received in an annular protrusion of each of said tilting devices, two adjacent tilting devices being interconnected by means of one of said shafts;

f) a driving assembly having a cylindrical casing in which a hole is bored through the periphery thereof, and means for receiving one of said shafts;

g) an actuator cord fed through said hole bored through the periphery of said driving assembly in such a way that two ends of said actuator cord dangle in disengageable fashion from a diametrically opposite periphery of said driving assembly; and h) a cord lock for securing each central cord and thereby retaining the plurality of slats in a raised or lowered position, wherein one end of said actuator cord is displaced in one longitudinal direction following displacement of the other actuator cord end in the opposite longitudinal direction, causing said driving assembly and each of said tilting devices to rotate in the same rotational direction, wherein an outer cord is partially wound around, and tensioned by, a corresponding tilting device during rotation thereof, said outer cord being subsequently longitudinally and laterally displaced, causing uniform tilting of each of said slats.

The present invention is also directed to a method for darkening a room, comprising:

a) Providing a manually operated Venetian blind, comprising:

i. providing at least one frame component comprising at least a headrail, and optionally a cover for each of said frame components;

ii. a plurality of transversally oriented, equally sized slats suspended from said headrail by means of at least two ladder braids, wherein each ladder braid comprises two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids optionally further comprise a longitudinally extending central cord passing through each slat;

iii. one or more devices for tilting said plurality of slats, two outer cords of each ladder braid being affixed to a corresponding tilting device, each of said tilting device positioned within one of said frame components and comprising a core member comprising a convex periphery, a toothed key protruding from said periphery, two separated coplanar elements defining a rectangular face which truncate said periphery, two transversally extending grooves obliquely oriented with respect to said coplanar elements, a portion for tensing an outer cord formed between one of said grooves and the corresponding planar element, and a circumferential, rectangularly shaped recess formed between said toothed key and a corresponding laterally oriented wall of said core member; and two oppositely oriented wing members which are engageable with said core member, each of said wing members being provided with a convex shell having a curvature substantially equal to that of the periphery of said core member and being positioned such that the axis thereof is transversally extending, a first transversal end of said shell formed with two openings so as to define a central shell portion and two peripheral portions and with a lip circumferentially extending along the inner wall of said shell, each of said peripheral portions being considerably thicker than said central portion and being configured to be received within a corresponding groove of said core member, a second transversal end proximate to said toothed key having a laterally oriented circumferential wall extending between said two peripheral portions along the inner wall of said shell, and a plurality of radially extending teeth formed in said laterally oriented circumferential wall, each of said teeth being configured with a sufficient length and spacing therebetween so as to abut complementary recessed sharp edge junctions of said toothed key, wherein said teeth of each wing member retain a corresponding outer cord of a ladder braid of the blind which is placed on the periphery of said core member in pressed relation with said toothed key and the lip of each of said wing member is adapted to engage a corresponding recess of said core member with a snapping action to prevent detachment of said corresponding outer cord from the tilting device; and iv. an actuator for causing rotation of each of said tilting devices;

a) Displacing said actuator a first distance, thereby causing each tilting device to rotate to a first angular distance;

b) Allowing a first outer cord to be partially wound around, and tensioned by, the tensing portion of a corresponding tilting device during rotation thereof to said first angular distance, while a second outer cord is slackened;

c) Allowing said first outer cord to be longitudinally and laterally displaced by the pressing of the tensing portion of a corresponding side of said corresponding tilting device onto said first outer cord during rotation of said corresponding tilting device, causing uniform tilting of each of said slats;

d) Displacing said actuator a second distance, causing each tilting device to rotate to a second angular distance, the inclination of the slats to further increase to a maximum value and the spacing between said first and second outer cords to be a minimum value, significantly less the spacing between said first and second outer cords when the slats are at a completely open position; and e) Releasing said actuator when said maximum value of the slat inclination results in the darkening of a room to a desired degree, wherein said actuator is displaced said first and second distances by a continuous hand motion.

The first outer cord presses the plurality of slats and thereby assists in further increasing the inclination of the slats. Due to the increased inclination of the slats, the spacing between the first and second outer cords changes from 17 mm when the slats are in a completely open position to 3 mm when the slats are in a completely closed position.

By the method of the invention, the slats may block up to 93% of the incoming light, and up to 95% of the incoming light when a lower support member of the frame has two longitudinally oriented mounting surfaces.

The present invention is also directed to a method for assembling a Venetian blind, comprising:

a) providing at least one frame component comprising at least a headrail and optionally a cover for each of said frame components;

b) providing a plurality of tilting devices comprising two laterally oriented sides, a rectangular face perpendicular to said laterally oriented sides, and an annular protrusion transversally extending outwardly from each laterally oriented side, wherein each of said tilting devices is rotatable about a transversal axis coincident with the axis of said annular protrusions, the number of employed tilting devices depending on the transversal dimension of said headrail;

c) providing a plurality of ladder braids, wherein each ladder braid comprises two longitudinally extending outer cords and a plurality of laterally extending cross ladders, each of said outer cords being disposed laterally outwardly from a different lateral edge of a plurality of transversally extending slats and each cross ladder being connected to the two outer cords and adapted to support a corresponding slat;

d) forming apertures in an inner transversally extending planar surface of said at least one frame component;

e) securing a plurality of cord guide assemblies to a frame component while placing each corresponding cord guide of said plurality of cord guide assemblies in each of said apertures such that a cord guide is substantially coplanar with the corresponding planar surface;

f) mounting the two annular protrusions of each of said tilting devices on corresponding arcuate walls of each of said cord guide assemblies such that each of said protrusions is rotatable within a corresponding arcuate wall;

g) interconnecting adjacent tilting devices by means of a D-shaped shaft insertable within a corresponding annular protrusion;

h) introducing the two outer cords of a ladder braid through a corresponding outer section of the cord guide such that each outer cord is essentially longitudinally disposed;

i) affixing the two outer cords of a ladder braid to a corresponding tilting device;

j) inserting a drive means adapted to tilt the plurality of slats in one of said frame components and connecting one of said tilting devices by means of a D-shaped shaft to said drive means;

k) connecting an actuator to said drive means; and l) optionally, interlocking a cover with each corresponding frame component by a snapping motion.

In one aspect, the step of securing a cord guide assembly to a frame component comprises the steps of:

a) providing a substantially rectilinear cord guide assembly having a transversally oriented and inwardly positioned face from which the cord guide longitudinally protrudes, two longitudinally oriented sides, two laterally oriented sides, and four legs, each of said legs abutting a corresponding corner of said cord guide assembly and the longitudinally outward end of each of said legs terminating with a wedge-shaped portion, wherein each of said laterally oriented sides is formed with an arcuate opening on which an annular protrusion of a tilting device is to be mounted and with a substantially rectangular opening which is formed laterally outwardly from the corresponding arcuate opening, thereby affording the corresponding laterally oriented side with increased flexibility;

b) providing a frame component having at least one planar transversally oriented support surface, two longitudinally oriented and transversally extending walls perpendicular to said support surface, and mutually parallel, laterally oriented and transversally extending legs which perpendicularly protrude from the inner side of each of said transversally extending walls such that a first leg has a longer lateral dimension than a second leg, said first leg terminating with a longitudinally oriented abutment surface;

c) flexing a laterally oriented side of said cord guide assembly by bringing two opposed legs corresponding to said laterally oriented side towards each other;

d) inserting each of said wedge-shaped portions of said two opposed cord assembly legs between a corresponding longitudinally oriented abutment surface and wall of said frame component, so as to be compressed and snapped in secured, undetachable relationship with respect to a corresponding set of first leg, wall and abutment surface of said frame component; and e) repeating steps c) and d) for the other laterally oriented side of said cord guide assembly.

The method for assembling an internal Venetian blind further comprises the steps of:

a) providing two glass sheets of specified dimensions;

b) providing frame components of specified dimensions, said frame components consisting of a headrail, lower support member, and two side members, and a cover for each of said frame components;

c) positioning a first internal magnet housing formed within an outwardly facing cavity in which an internal magnet is placed and two spaced coplanar abutment plates such that one of said abutment plates is in communication with the drive means;

d) interlocking a cover with each corresponding frame component by a snapping motion;

e) connecting each of side members to said headrail and said lower support member to produce a blind frame;

f) bonding said two glass sheets to the front and rear of said blind frame;

g) inserting said blind frame in a suitably sized frame of a wall opening;

h) mounting a first actuator guide by a press fit between a glass sheet and a frame element of said wall opening in such a way so as to correspond to an intended displacement path of said internal magnet; and i) mating a first external magnet housing containing at least one external magnet with said first actuator guide such that said at least one external magnet is in opposed relation to, and at a fixed distance from, said internal magnet of said first internal magnet housing and that said first external magnet housing is slidingly displaceable within said first actuator guide, whereby said plurality of slats are uniformly tiltable upon linear displacement of said first external magnet housing.

In one aspect, the method further comprises the steps of:

a) additionally providing two outwardly positioned ladder braids with a longitudinally extending central cord passing through each slat;

b) introducing each central cord of a ladder braid through a corresponding inner section of the cord guide such that each central cord is essentially longitudinally disposed;

c) affixing a stabilizer proximate to the upper longitudinal end of a first side member;

d) securing a bearing housing which houses a ball bearing to the upper longitudinal end of said first side member;

e) interconnecting a bifurcated bearing block which houses a ball bearing with a counterweight which houses at least one inner magnet in an outward portion thereof;

f) introducing said bearing block and said counterweight within said first side member such that said bearing block and said counterweight are longitudinally displaceable within said first side member;

g) transversally orienting the two central cords through the headrail;

h) winding the two central cords around the ball bearing housed in said bearing housing;

i) winding the two central cords around the ball bearing housed in said bearing block and then affixing the ends of each central cord to said stabilizer;

j) mounting a second actuator guide by a press fit between said glass sheet and said frame element of said wall opening in such a way so as to correspond to an intended displacement path of said at least one internal magnet housed within said counterweight; and k) mating a second external magnet housing containing at least one external magnet with said second actuator guide such that said at least one external magnet is in opposed relation to, and at a fixed distance from, said at least one internal magnet of said counterweight and that said second external magnet housing is slidingly displaceable within said second actuator guide, whereby said bearing block and said counterweight are longitudinally displaceable upon linear displacement of said second external magnet housing.

DETAILED DESCRIPTION OF PREFERRED EMBODIMENTS

The present invention is a novel manually operated internal Venetian blind with a surface area of up to 5 square meters that can be lowered/raised and tilted effortlessly and speedily, whose operating mechanism can be adjusted to the dimensions of the blind, and which can be inverted without disarray of the slats and of the cords.

The first embodiment of the present invention relates to an internal Venetian blind for tilting a plurality of slats. Several prior art internal Venetian blinds comprise a tilting mechanism in the headrail in which outer cords of a ladder braid are wound around a cylindrical element, which is generally driven by gears, or any other type of transmission in communication with an actuator external to the Venetian blind. Since this cylindrical element is housed within the headrail, the circumference of the cylindrical element is laterally spaced from the lateral periphery of the slats across which the outer cords extend. Spacers placed on the transversal periphery of the uppermost slat are therefore needed to direct the outer cords to the cylindrical element. Such an arrangement for the tilting of Venetian blinds suffers from several drawbacks. Firstly, the weight of the slats is concentrated disproportionally more on the spacers and on the uppermost slat than on the other slats, causing the slats to change their relative position, or even to fail, over the course of time. Secondly, each outer cord is affixed to the cylindrical element by means of a clasp whose two legs are pressed onto the outer cord. Over the course of time, an outer cord may be released from its clasp, due to the weight concentration on a spacer or a change in the relative positions of the slats. Also, due to the angle of the outer cords resulting from the addition of the spacers, the slats cannot completely close and invariably only 75% of the incoming light is blocked.

In contrast, the tilting device of the present invention is rectangular, and the outer cords retain an essentially vertical disposition from the headrail to the lower rail. The outer cords are not affixed to the outer periphery of the tilting device, but rather to apertures formed within a planar surface of the tilting device, as will be described hereinafter. The weight of the slats is therefore more evenly distributed than in the prior art, allowing the slats of a blind unit with a higher surface area than has been known heretofore to be tilted, with greater reliability and without use of a gear train or any other transmission.

Figure 1A:
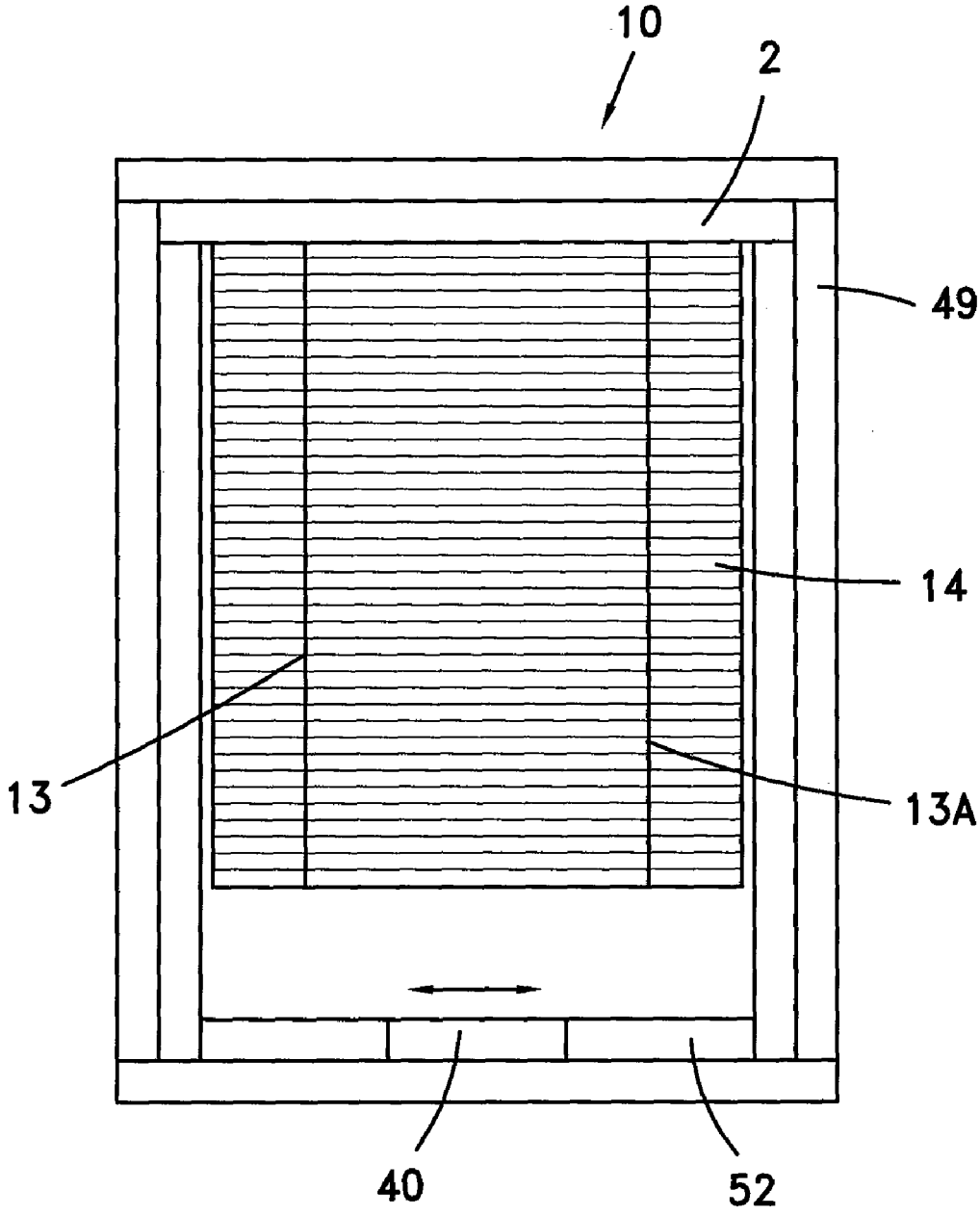
FIGS. 1A and 1B are front views of manually operated blinds in accordance with the present invention, having one and two linearly displaceable actuators, respectively.

Referring now to the drawings, FIG. 1A illustrates an internal Venetian blind generally indicated by numeral 10 which is adapted for tilting a plurality of slats inserted between a double glazing unit, such that each slat is tiltable about a horizontal axis. Internal blind 10 comprises frame 49, e.g. made from aluminum, a plurality of slats 14 suspended from headrail 2 of frame 49, ladder braids 13 and 13A to support and tilt slats 14, and horizontally displaceable actuator 40 which actuates the tilting device, as will be described hereinafter.

Figure 2:
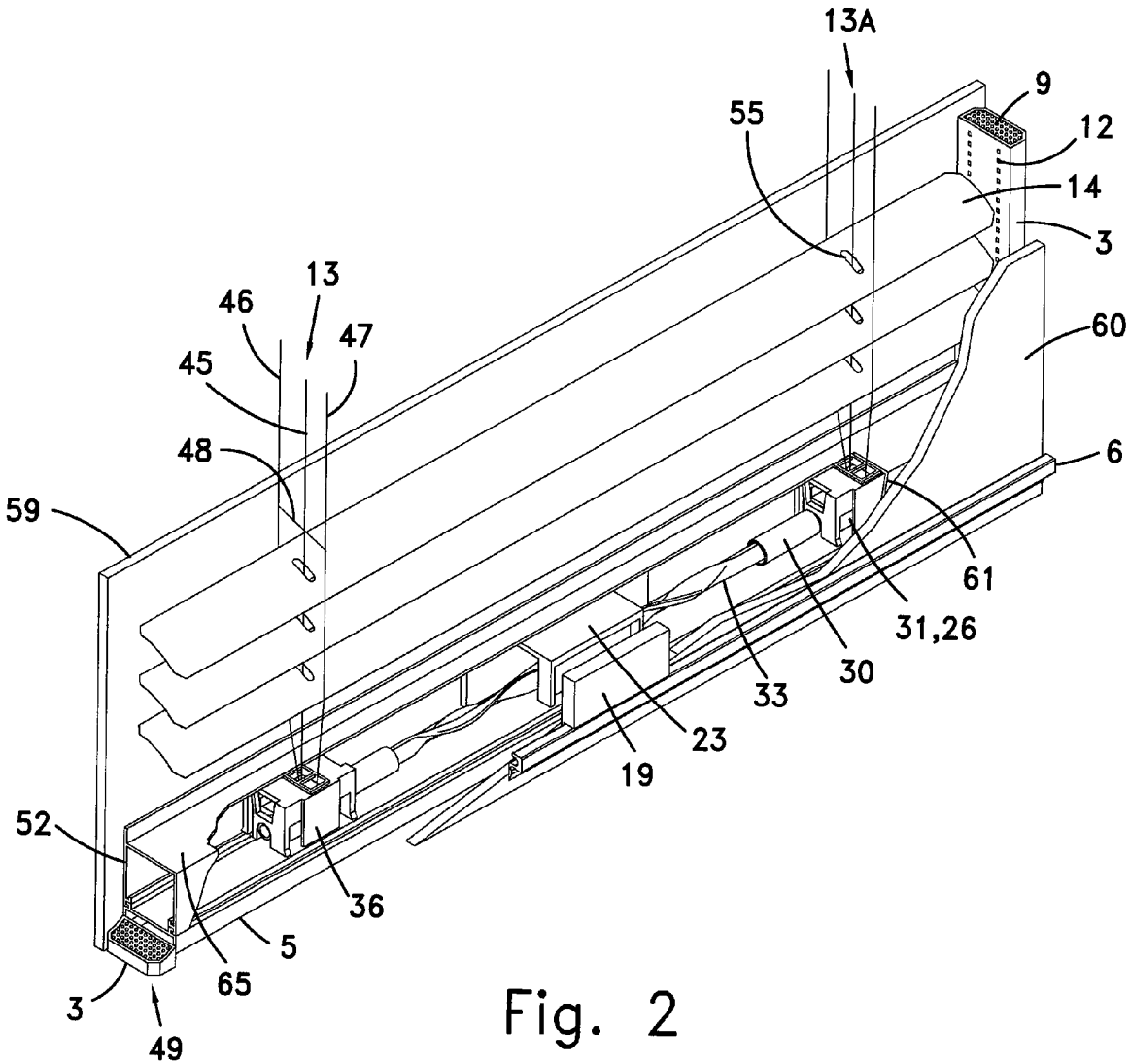
FIG. 2 is a perspective view of the lower rail of an internal Venetian blind, showing the drive means according to one embodiment of the invention.

As further shown in FIG. 2, frame 49 comprises headrail 2, lower rail 52, side members 3, and covers 5 that interlock with each of the aforementioned frame components. Side members 3 are formed with a plurality of apertures 12, so that hydrophilic pellets 9 placed within each side member 3 communicate with the interior of the blind via apertures 12 and absorbs any moisture that infiltrates to the interior of the blind.

Figure 12:
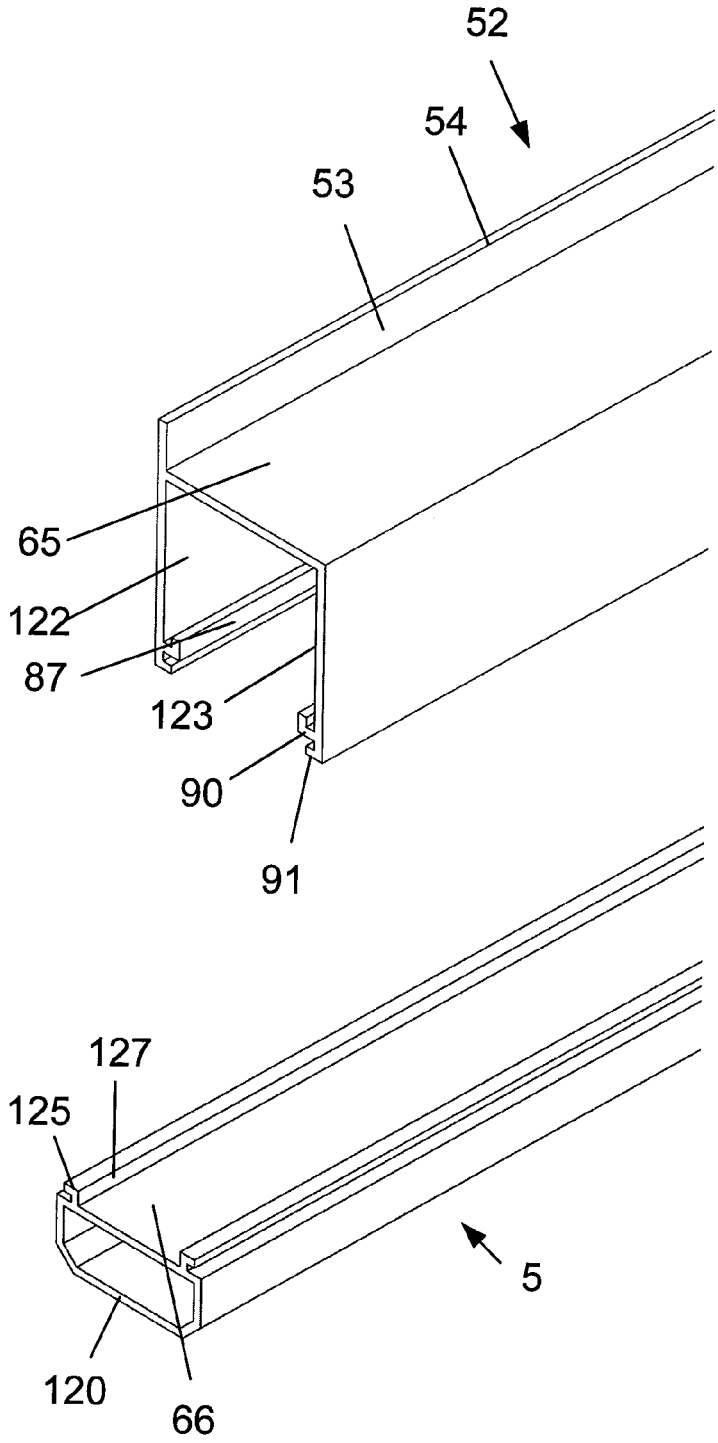
FIG. 12 is a perspective view of a lower rail and rail cover.

The structure of lower rail 52, which is arranged in mirror symmetry with respect to headrail 2, is illustrated in FIG. 12. Lower rail 52 is a rectilinear aluminum component provided with transversally extending mounting plate 53 and wall 123, which are bonded to glass sheets 59 and 60 (FIG. 2), respectively. Inner transversally oriented planar surface 65 is perpendicular to, and located below, upper longitudinal edge 54 of the mounting plate, and laterally extends to wall 123. Wall 122, i.e. the portion of mounting plate 53 which is below surface 65, is symmetrical to wall 123. Mutually parallel, laterally oriented legs 90 and 91 perpendicularly protrude from the inner side of each of walls 122 and 123, with leg 90 being longer than leg 91. Longitudinally oriented abutment surface 87 is perpendicular to the lateral end of each leg 90. Legs 90 and 91 interlock with corresponding leg 125 of rail cover 5, such that a longitudinal abutment surface 127, which is perpendicular to leg 125, is coplanar with corresponding abutment surface 87 of the lower rail. Inner planar surface 66 of rail cover 5, which serves as the bottom of the lower rail, is interposed between, and perpendicular to, the two abutment surfaces 127, with the lateral dimension of surface 66 being less than that of surface 65.

Figure 3:
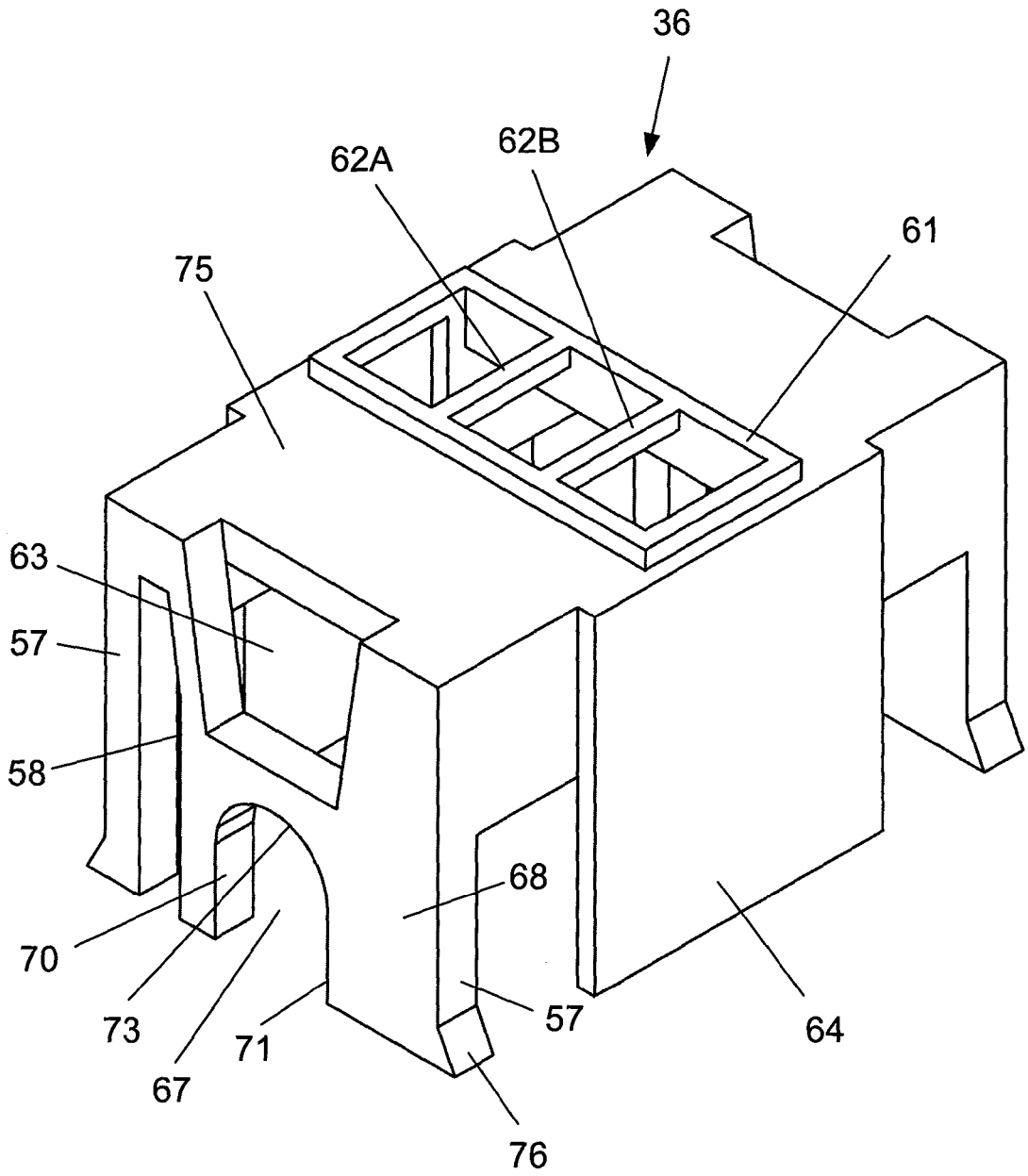
FIG. 3 is a perspective view of a cord guide assembly according to one embodiment of the invention.

With reference to FIGS. 2 and 3, ladder braids 13 and 13A are composed of three essentially vertically disposed cords, e.g. made from nylon: central cord 45 passing through an equally sized and similarly located aperture 55 formed within each slat 14, outer cords 46 and 47, each of which is interspersed between the slats and glass sheets 59 and 60, respectively, and a plurality of essentially horizontally disposed cross ladders 48 for supporting each corresponding slat 14. As well known to those skilled in the art, the outer cords 46 and 47 are adapted for tilting slats 14 in a desired angular direction by being either raised or lowered, while each of the cross ladders connects the two outer cords 46 and 47. The three cords 45-47 extend from headrail 2 to lower rail 52, passing through upper and lower cord guide assemblies 36.

When slats 14 are of an increased transversal length, e.g. 1.5 m due to a corresponding increased surface area of the blind, more than two ladder braids are employed. The two outer ladder braids are composed of three cords as described hereinabove wherein central cord 45 thereof is passed through similarly located aperture 55 formed within the slat. The remaining ladder braids are composed of outer cords 46 and 47 and a plurality of cross ladders 48 for supporting each corresponding slat 14, without need of a central cord. Accordingly, the inner portions of each slat 14 are formed without an aperture 55.

Each cord guide assembly 36 is substantially rectilinear, wherein face 75 is perpendicular to transversal sides 68 and to lateral sides 64. Trapezoidal opening 63, or an opening of any other convenient shape, is formed in each transversal side 68, such that a portion is removed from the transversal edge of face 75. Rectangular cord guide 61 is centrally located within, and protrudes from, face 75. Cord guide 61 is divided into three sections by dividers 62A and 62B so that each cord passes through a different section and is essentially vertically disposed. The cord guide 61 of each cord guide assembly 36 is internally positioned, i.e. it faces the cavity of internal blind 10, and is substantially coplanar with the inner planar surface 65 of either headrail 2 or of lower rail 52, protruding from a similarly shaped aperture formed in said outer planar surface so as to be accessible to the cords 45-47.

Figure 4:
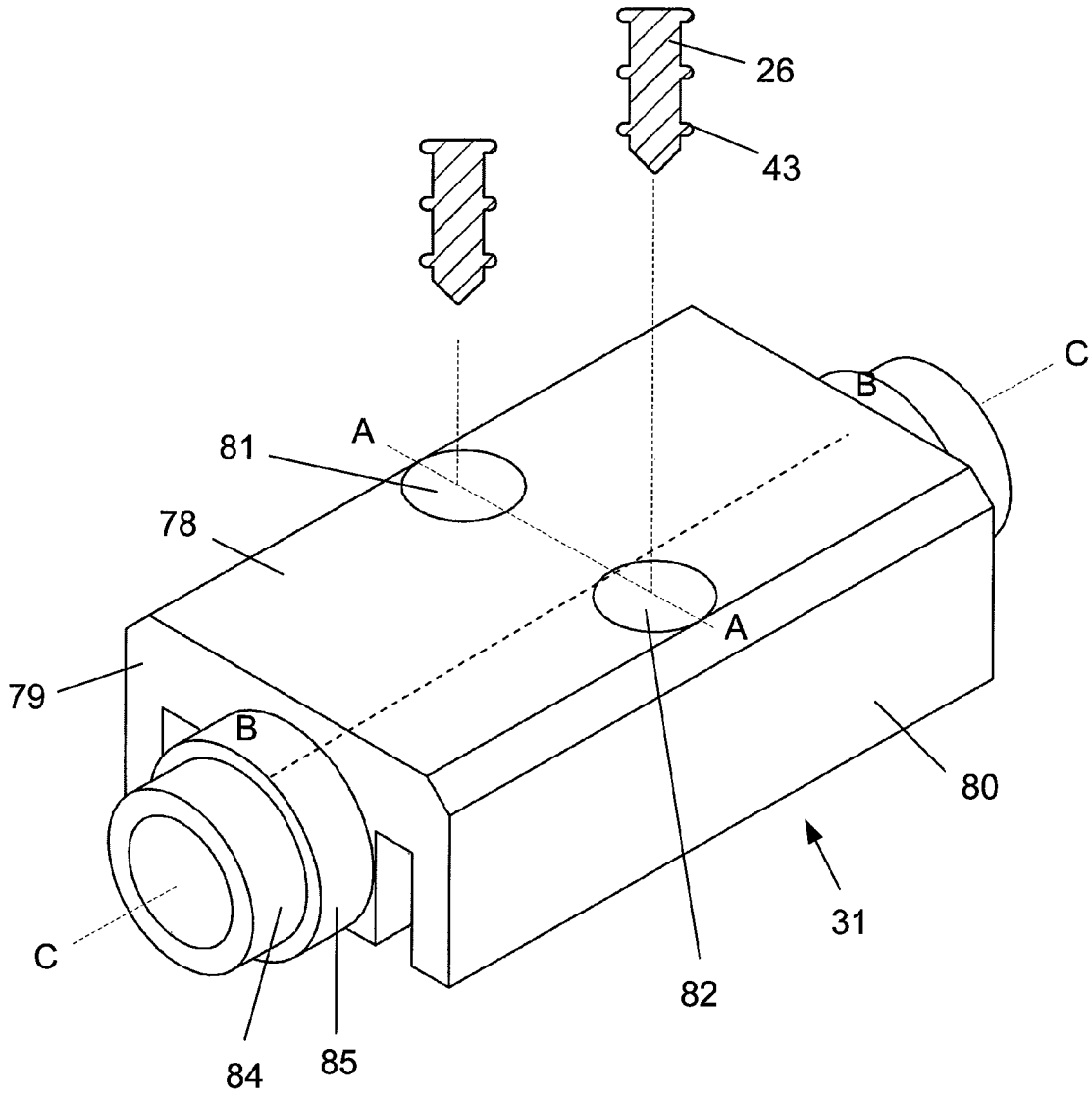
FIG. 4 is a perspective view of one embodiment of a tilting device.

Cord guide assembly 36 is adapted for rotatably supporting tilting device 31 (FIG. 4). Protrusion 85 extending from each laterally oriented side 79 of tilting device 31 is received and rotatable within arcuate opening 67 formed on the outer end of sides 68 of cord guide assembly 36, thereby allowing tilting device 31 to rotate. Tilting device 31 is prevented from being dislodged from the two arcuate openings 67 of cord guide assembly 36 by means of inner planar surface 66 of rail cover 5 (FIGS. 8C and 12), the latter being adapted to contact a lateral side 80 of a fully rotated tilting device 31, the rotation of which will be described hereinafter. Arcuate opening 67 is formed by two straight walls 70 and 71, each of which has an equal length and is separated by a distance substantially equal to the diameter of protrusion 85, and by arcuate wall 73 tangential with walls 70 and 71, whose curvature is substantially equal to that of protrusion 85. Each transversal side 68 is also formed with a rectangular opening 58, laterally inwards from arcuate opening 67, thereby defining leg 57 of a small lateral length. Cord guide assembly 36 is provided with four legs 57, one on each corner thereof, with the outward end of each leg terminating with a wedge-shaped portion 76, which facilitates the securing of cord guide assembly 36 to the headrail or to the lower rail, as shown in FIG. 2. Wall 70 is flexible, due to the existence of rectangular opening 58, and therefore wall 70 may be slightly flexed as the cord guide assembly is secured, or during insertion of protrusion 85 of the tilting device within arcuate opening 67.

Cord guide assemblies 36 are immobilized within lower rail 52 (FIG. 12) and within headrail 2 (FIG. 1A) by means of each corresponding cord guide 61, which abuts the wall of an equally sized aperture (not shown) formed in inner planar surface 65 of the lower rail, and therefore is prevented from moving in the transversal and lateral directions. Longitudinal movement of a cord guide assembly 36 is prevented by means of wedge-shaped portions 76, each of which is inserted between longitudinally oriented abutment surface 87 and wall 122 of a headrail or lower rail, so as to be compressed and snapped in secured, undetachable relationship with respect to a corresponding set of leg 90, wall 122 and abutment surface 87.

As shown in FIG. 4, tilting device 31 has a rectilinear body comprising planar face 78 which is perpendicular to its transversal sides 79 and to its lateral sides 80. Face 78 is formed with circular apertures 81 and 82, such that the center of each aperture coincides with centerline A-A of face 78. Sides 79 are formed with coaxial annular protrusions 84 and 85, wherein protrusion 85 has a greater outer diameter than protrusion 84 and axis C-C passing through protrusions 84 of each side is parallel to, and located directly underneath, the second centerline B-B of face 78. Apertures 81 and 82 are bored through face 78 and are adapted for receiving a corresponding nail 26 having radial protrusions 43.

Figure 7A:
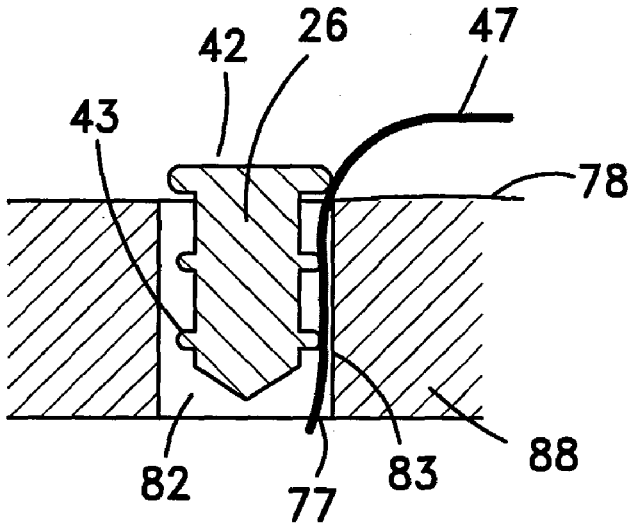
FIG. 7A is a longitudinal cross-sectional view of the tilting device of FIG. 4, showing the means by which an outer cord is affixed thereto.
Figure 7B:
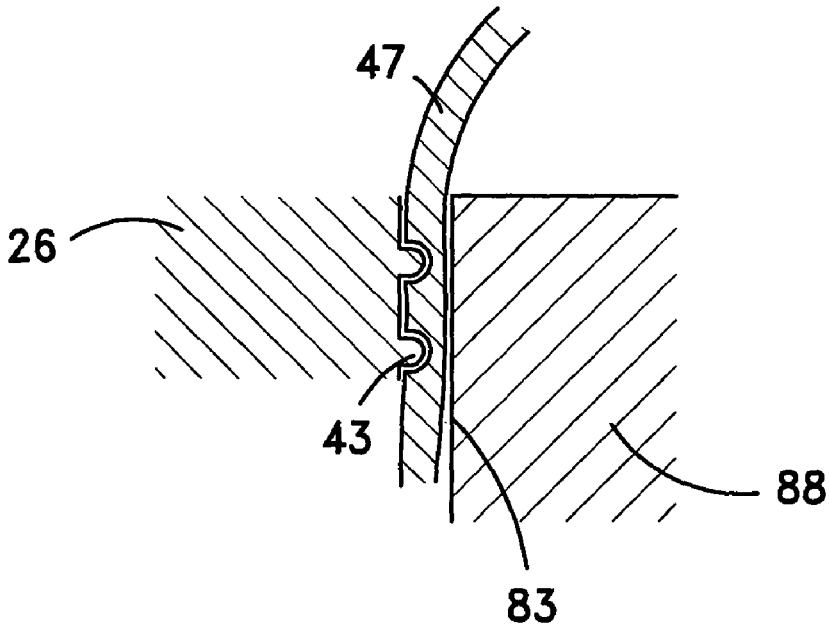
FIG. 7B is an enlarged view of FIG. 7A.

Referring now to FIGS. 7A and 7B, wall 83 of apertures 81 and 82 extends throughout body 88 of the tilting device, so that end 77 of each outer cord may be easily introduced within a corresponding aperture. Radial protrusions 43 of nail 26 have curved ends, with the spacing between the curved ends of opposing radial protrusions 43 substantially equal to, but slightly less than, the diameter of apertures 81 and 82. These curved ends are adapted to press an outer cord (for example the illustrated outer cord 47) onto wall 83 and to retain the pressed portions of the outer cord in a fixed position relative to face 78 of the tilting device, even during rotation of tilting device 31 about axis C-C (FIG. 4). Radial protrusions 43 may encircle the entire periphery of nail 26, or a portion thereof. Nail 26 is inserted into a corresponding aperture after the introduction of the corresponding outer cord in such a way that radial protrusions 43 press the outer cord and head 42 of the nail contacts, or is close proximity to, face 78. If nail 26 is incorrectly inserted into an aperture, e.g. head 42 is not parallel to face 78, head 42 will contact abutment surface 87 (FIG. 12) of headrail 2 or of lower rail 52 and tilting device 31 will therefore not be able to rotate to a full extent.

Figure 8A:
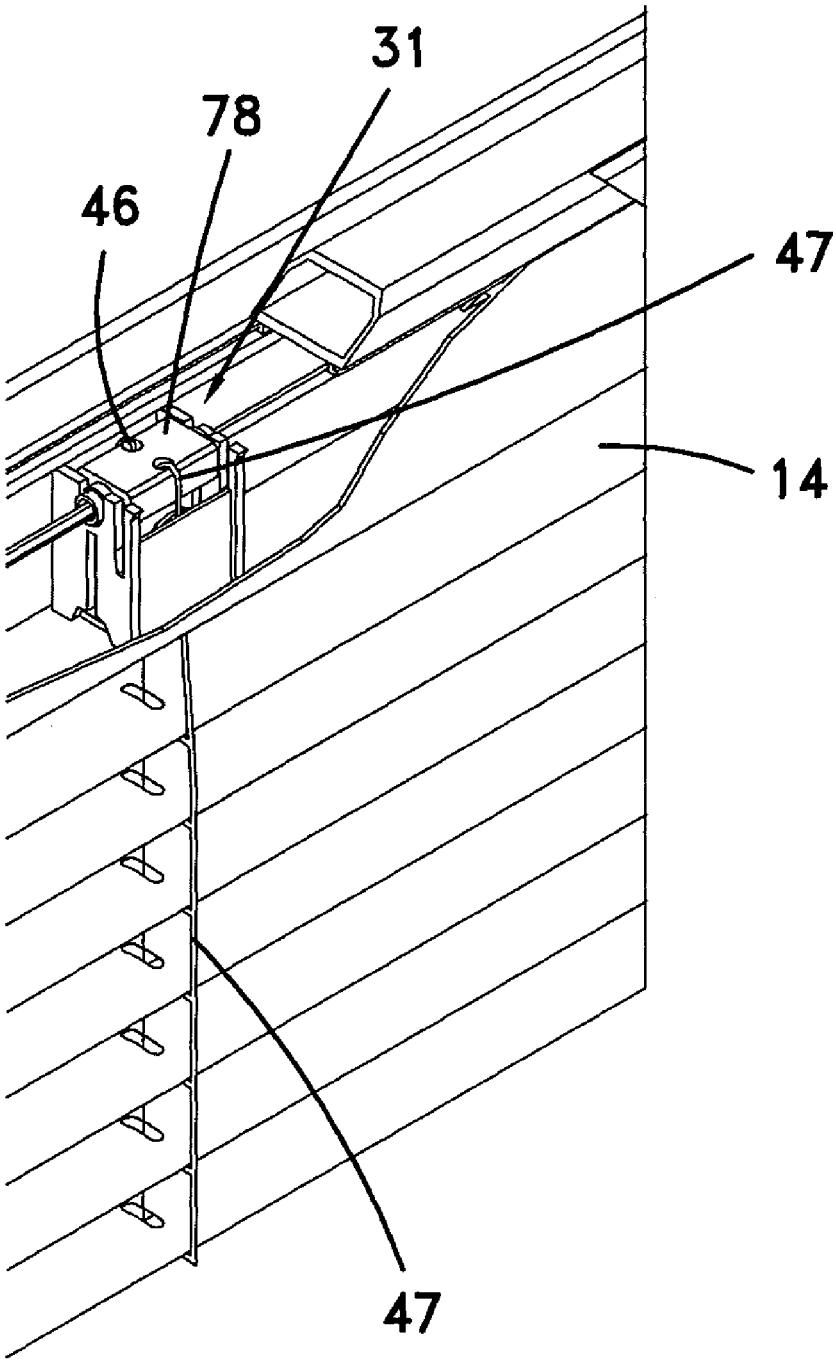
FIGS. 8A-C are perspective views of the tilting device of FIG. 4 in three angular positions, respectively.
Figure 8B:
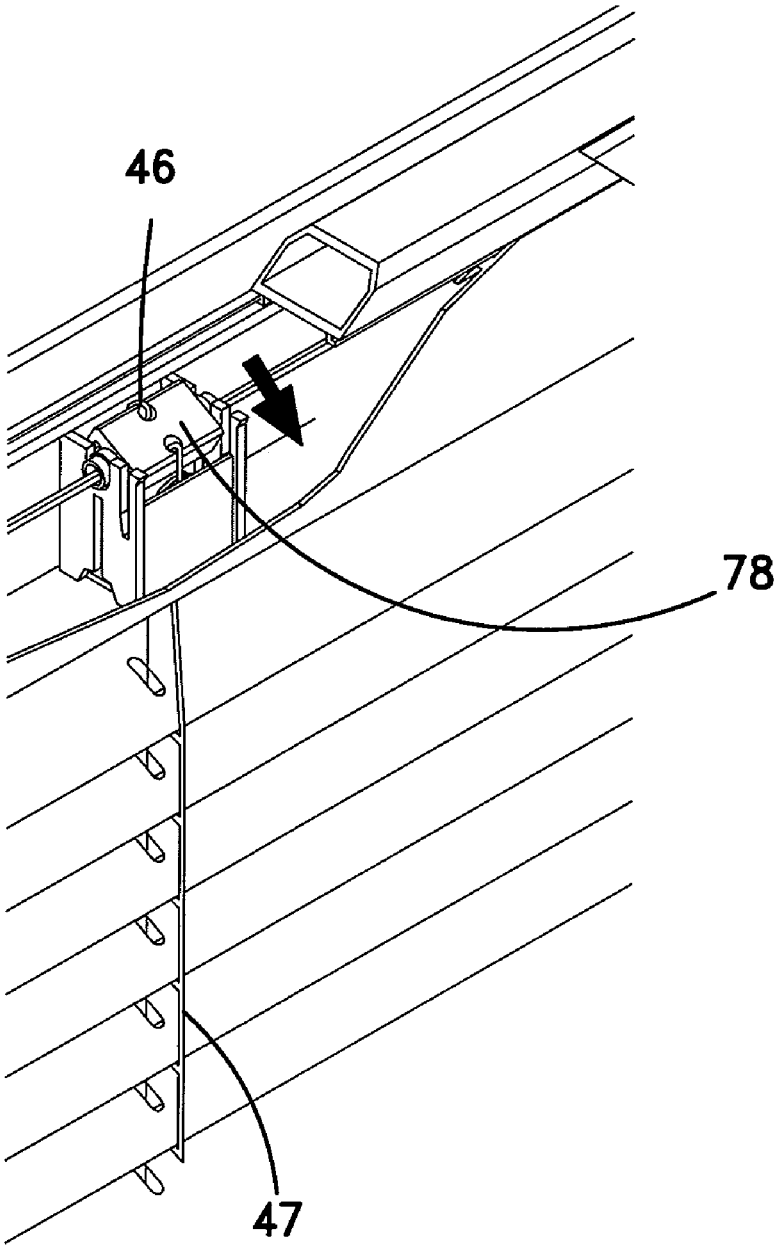
Figure 8C:
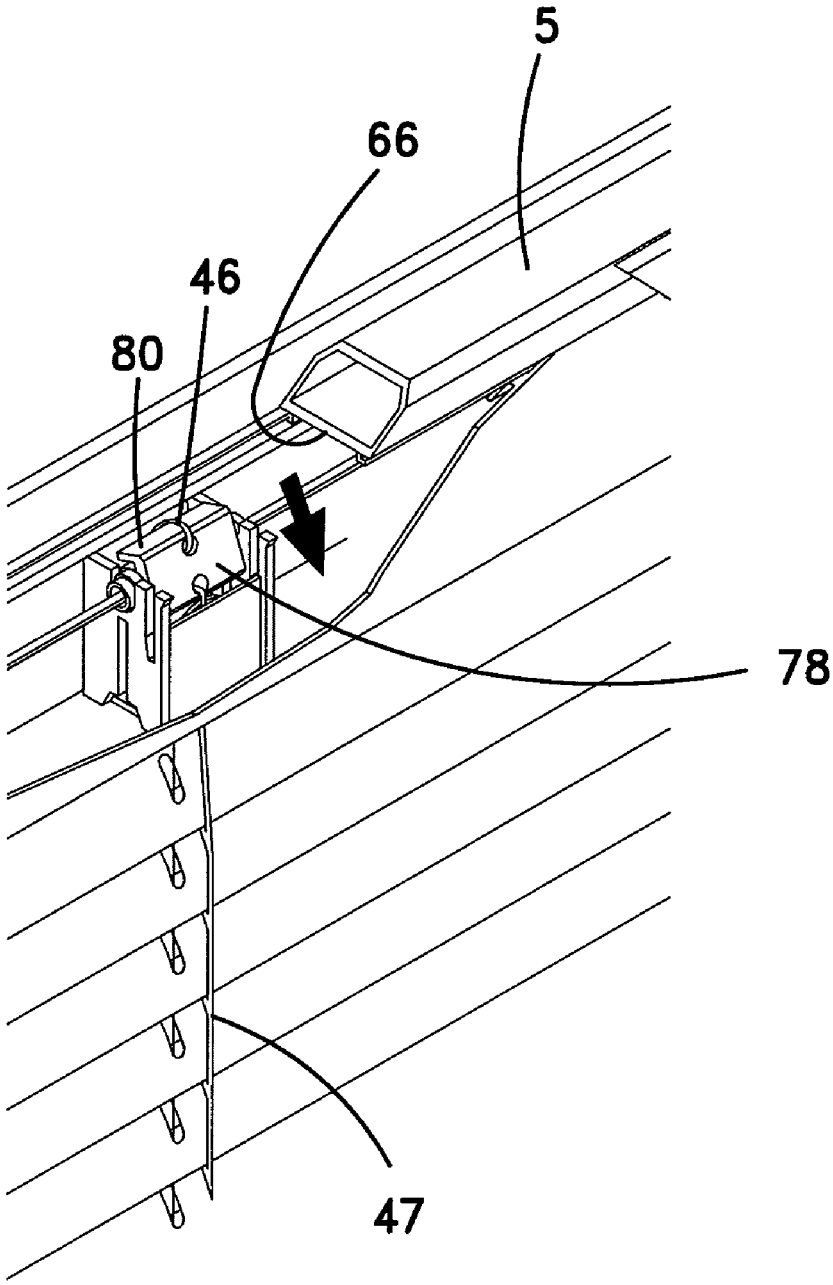

As shown in FIGS. 8A-C, face 78 of each tilting device 31 is outwardly positioned with respect to face 75 of cord guide assembly 36 (FIG. 3). Outer cords 46 and 47 are retained in a fixed relative position within corresponding upper and lower tilting device by nails 26 after having been introduced through each corresponding cord guide 61 and through each corresponding circular aperture of the tilting device while brushing against a corresponding lateral side 80 of each tilting device. Since the lateral dimension of tilting device 31 is substantially equal to that of slats 14, outer cords 46 and 47 are in an essentially vertical disposition from headrail 2 to lower rail 52.

Therefore the weight of slats 14 is substantially evenly distributed throughout the length of the outer cords, resulting in added reliability without danger of slat failure. Also, the circular apertures 81 and 82 (FIG. 4) are formed along the transversal centerline A-A of face 78 so that tilting device 31 is well balanced during rotation.

Figure 14A:
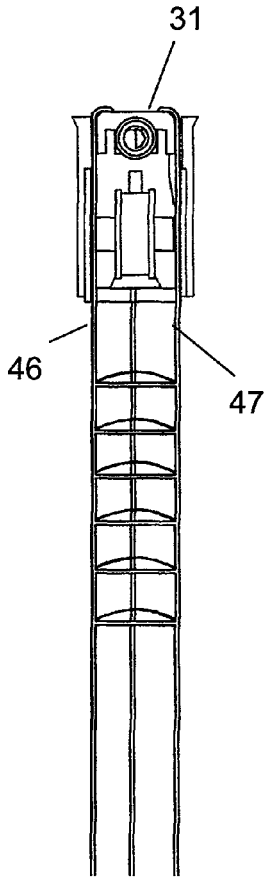
FIGS. 14A-C are side views of the tilting device of FIG. 4 and a corresponding ladder braid, showing a change in inclination of the slats during three angular positions of the tilting device, respectively.

When the slats are in a completely open position as illustrated in FIGS. 8A and 14A such that a maximum amount of solar radiation is admitted through glass sheets 59 and 60

Figure 14B:
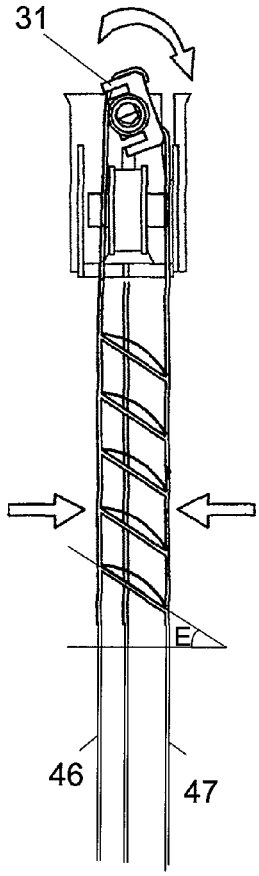

(FIG. 2), outer cords 46 and 47 have equal tension and are located proximate to the lateral ends, respectively, of the cord guides 61. Upon displacement of actuator 40 (FIG. 1A) slightly to the left, for example, cord 46 is tensed by the tilting device, as will be described hereinafter, and cord 47 is slackened. Cord 46 is then drawn upwards and inwards, causing the slats that are supported on cord 46 by means of each cross ladder 48 to change their inclination with respect to a horizontal plane, as shown in FIG. 8B. Following additional displacement of actuator 40, cord 46 is further drawn upwards and inwards, causing an additional change in the inclination of the slats, achieving an angle of E, and cord 47 is drawn downwards, as shown in FIGS. 8C and 14B.

As previously mentioned, the tilting of the slats is accomplished by rotating tilting device 31 about axis C-C (FIG. 4). While outer cords 46 and 47 have a nominal tension, due to their fixation by nails 26, when face 78 is substantially parallel to the inner planar surface 65 (FIG. 12), as in FIG. 8A, the tension of the outer cords may be increased by rotating the tilting device. The rotation of tilting device 31 causes a lateral side 80 to press against a corresponding outer cord, depending on the direction of rotation, thereby increasing the tension of that outer cord. With respect to the illustrated rotational direction of tilting device 31 shown in FIGS. 8B and 8C, the pressing of outer cord 46 by the corresponding lateral side 80 of the upper tilting device also draws that outer cord upwards and inwards, being wound around lateral side 80 and partially around face 78. It will be appreciated that outer cord 47 is slackened at this stage, since the corresponding lateral side 80 is no longer in contact with cord 47. At the rotational position of the tilting device depicted in FIG. 8C, the tension of outer cord 46 is substantially at a maximum, while the tension of outer cord 47 is increasing, since a corresponding lateral side 80 of the lower tilting device begins to press against outer cord 47. At the minimum spacing between the two outer cords, cord 46 is tensed due to the action of the upper tilting device and cord 47 is tensed due to the action of the lower tilting device.

Figure 5:
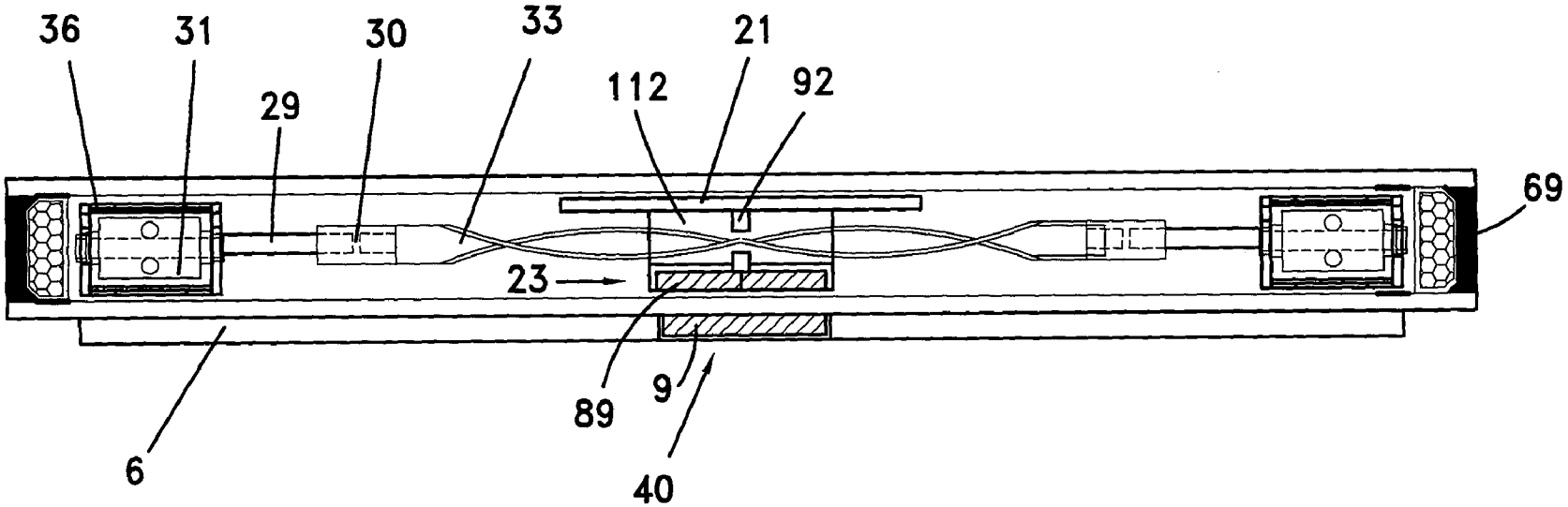
FIG. 5 is a transversal cross-sectional view of the blind, corresponding to the embodiment of FIG. 2.
Figure 6:
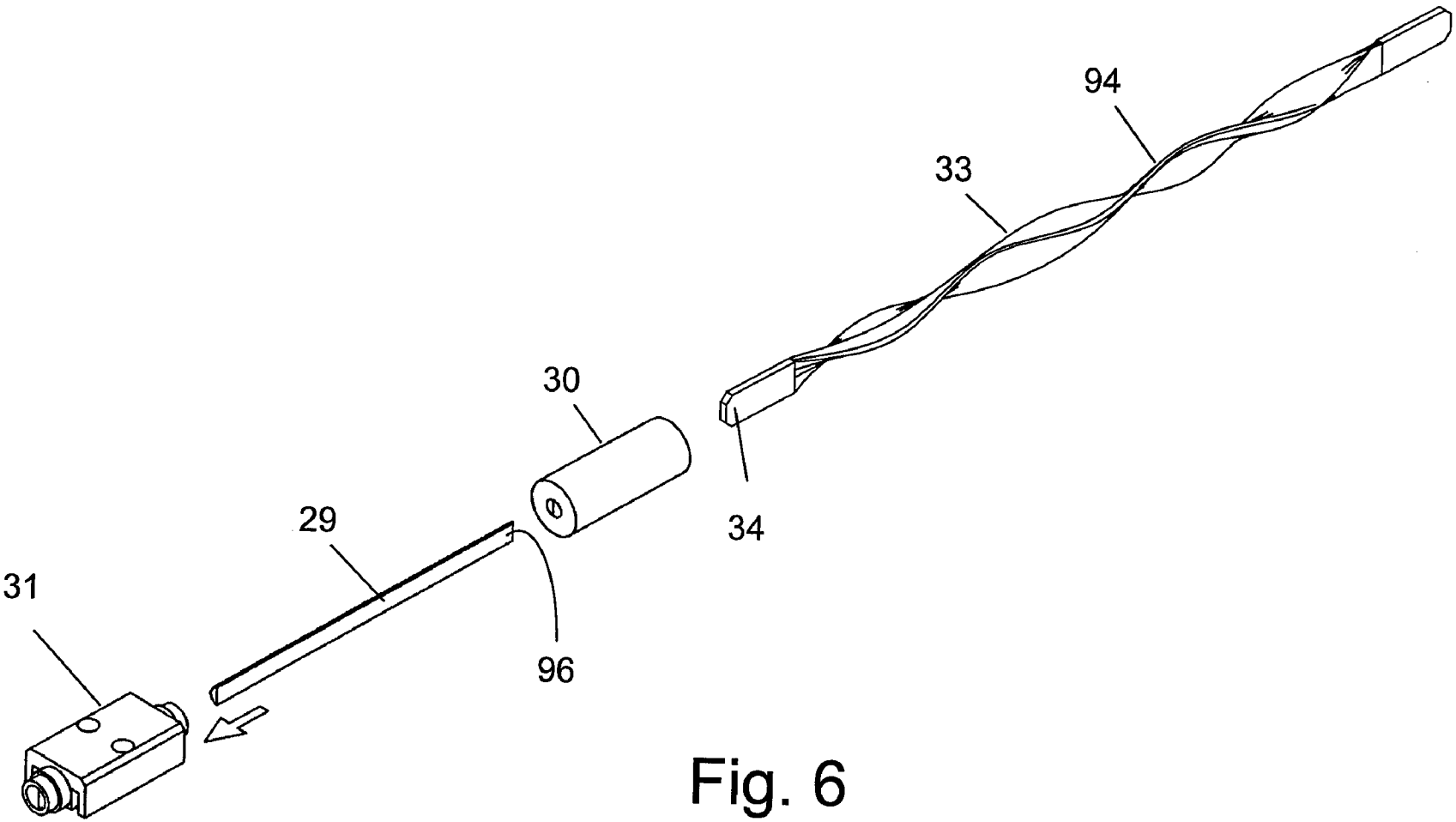
FIG. 6 is an exploded, perspective view of the drive means, corresponding to the embodiment of FIG. 2.

The drive means for this embodiment is illustrated in FIGS. 5 and 6, and is positioned within lower rail 52 (FIG. 2). In contrast with prior art internal blinds wherein the tilting mechanism is usually a gear train that adds to the cost of the device, the drive means of the present invention does not employ a gear train or clutch, but rather is manufactured from inexpensive components. Adapter 30, tilting device 31, and cord guide housing 36, for example, may be molded from acetal polyoxymethylene copolymer (POM) or polyacetal for its high rigidity and low coefficient of friction. Linear transversal displacement of actuator 40 is converted into rotational displacement by means of helical member 33, e.g. made of stainless steel. Helical member 33 is a metallic rectangular sheet that is twisted in such a way that its curvature can generate a volume of solid in the shape of a cylinder. Helical member 33 is provided with transversal ends 34, e.g. of plate-like shape, which are insertable within adapter 30 having an annular cross-section. Adapter 30 in turn receives steel shaft 29, which is insertable within annular protrusion 84 of the tilting device (FIG. 4). Shaft 29 is D-shaped or of any other suitable configuration that allows the periphery of shaft 29 to engage the inner wall of annular protrusion 84 and to thereby cause tilting device 31 to rotate about axis C-C. As shaft 29 rotates following the displacement of actuator 40 and the resulting rotation of helical member 33, as will be described hereinafter, tilting device 31 is rotated as well. If so desired, ends 34 may be inserted directly into a corresponding annular protrusion 84, for the direct driving of the tilting device.

Helical member 33 is placed between two coplanar, laterally oriented abutment plates 92 of internal magnet housing 23. Following transversal displacement of actuator 40, and consequently of abutment plates 92 as well, one of the abutment plates contacts a twist 94 of helical member 33. The twist in contact with an abutment plate is in turn transversally displaced in a similar direction, and then that twist follows a helical path, due to the shape of member 33. Helical member 33 therefore is therefore rotationally displaceable since all portions thereof follow a helical path. It will be appreciated that the rotational displacement of helical member 33 per stroke of actuator 40 is dependent on the pitch, or numbers of twists for a given length, of the helical member. Therefore a shorter helical member 33 can be rotationally displaced as much as a longer helical member if the shorter member is provided with a greater pitch.

Two sets of tilting devices are provided, wherein one set is positioned in headrail 2 and the other in lower rail 52. By utilizing transversally extending D-shaped shaft 29 to connect between adjacent tilting devices, the spacing between a pair of tilting devices 31 is adjustable. A tilting device 31 or adapter 30 may be effortlessly pushed along shaft 29, whereby to define a transversal position of the tilting device within the corresponding rail. Following adjustment of the spacing between adjacent tilting devices, an end 96 of D-shaped shaft 29 may inwardly protrude within the cavity of tilting device 31 or adapter 30. If the transversal length of an internal blind is relatively long, more than two tilting devices, with suitable connections thereto such as an additional helical member or shaft, may be employed. If so desired, the drive means may be positioned in headrail 2, for example if the lower rail is in an inaccessible location. Therefore the drive means may be effortlessly customized to any desired transversal length, e.g. from 2 cm to 8 m, without any compromise in reliability, rate of actuation, comfort or safety.

Figure 9:
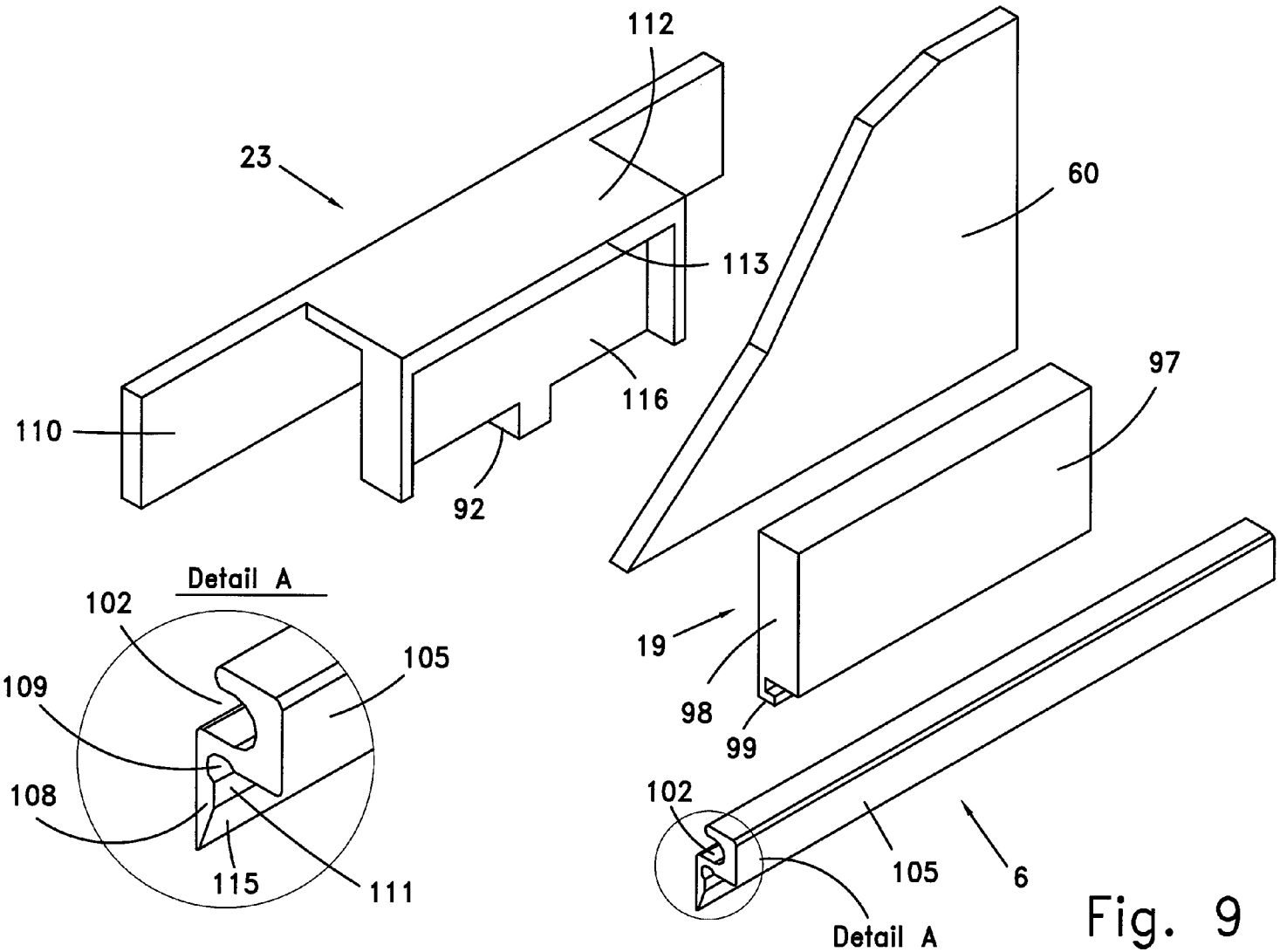
FIG. 9 is an exploded, perspective view of a linearly displaceable actuator, with an enlarged view of an actuator guide shown in Detail A.

The slats of the present invention can be tilted effortlessly and speedily from one angular position to another within less than 2 seconds regardless of the surface area of the Venetian blind. Such quick tilting is realized due to the configuration of actuator 40, which is shown in FIGS. 2, 5, and 9. Since the Venetian blind is located internally to the double glazing, an actuator external to the glass sheets is needed to transmit a force to the tilting mechanism disposed within the double glazing. One prior art method comprises the engagement of an actuating rod with a gear train, which causes the rotation of the tilting mechanism. To reduce the costs associated with a gear train, another prior art method involves the use of an externally disposed and hand-held magnet, which is placed on a glass sheet, to displace another magnet housed within the double glazing causing a force to be transmitted to the tilting mechanism. The movement of the externally disposed magnet is often slow since the location of the internal magnet may not be known, and even if it were known, inevitable delays in guidance of the magnets occur due to uncertain displacement paths, muscle spasms while holding the external magnet, etc., and therefore actuation of the slats from one position to another may last as much as two minutes. In contrast, actuator 40 is coupled to the frame of the Venetian blind, and therefore external magnet 9 is guided within a fixed path, such that the distance from external magnet 9 to internally disposed magnet 89 is a constant value.

As shown in FIG. 9, external magnet 9 is placed within external magnet housing 19 and internal magnet 89 is placed within internal magnet housing 23. External magnet housing 19 has a rectangular body 98 formed with an inwardly facing cavity for the insertion therein of external magnet 9, wherein body 98 is suitably sized so that external magnet 9 is in contact with glass sheet 60. External magnet housing 19 is provided with L-shaped appendage 99, which extends from the inner lateral edge of external magnet housing 19 and is longitudinally spaced from, extends the entire transversal length of, and has a lateral dimension considerably less than that of, body 98. L-shaped appendage 99 is adapted to be slidingly displaceable within arcuate track 102 of actuator guide 6, which extends the entire transversal length of internal blind 10, and is sized so that outward face 97 of body 98, which is held by a user during actuation of the blind, is substantially coplanar with outward face 105 of actuator guide 6, when L-shaped appendage 99 is inserted within track 102 and the inner planar face of mounting plate 108 of the actuator guide is mounted by a press fit between glass sheet 60 and the frame of the wall opening in which blind 10 is placed. As shown in Detail A of FIG. 9, the outer side of mounting plate 108 is formed with transversally extending arcuate recess 109, planar transversally extending contact element 111 which is parallel to the inner planar face of mounting plate 108, and oblique side 115 being inclined with respect to contact element 111, the purpose for all of which will be described hereinafter.

Internal magnet housing 23 is integrally formed with longitudinally oriented stopper 110 and cavity back 116, transversally oriented bridge 112, and laterally oriented abutment plates 92 and legs 114. The longitudinal dimension of stopper 110, which is sidable along wall 122 of lower rail 52 (FIG. 12), of legs 114 and of abutment plates 92 is substantially equal to that of the spacing between planar surface 65 and abutment surface 87 of the lower rail, to prevent slippage of the stopper when being transversally displaced. Bridge 112 is contiguous with, and has a similar lateral dimension as, planar surface 65. Legs 114 laterally extend from cavity back 116 to bridge edge 113, with helical member 33 positioned below the remaining portion of bridge 112. Abutment plates 92 laterally extend from stopper 110 and cavity back 116, respectively, to such a length such that a gap is formed between the two abutment plates. This gap allows helical member 33 to be positioned approximately at the lateral centerline of the lower rail, yet allows for contact between the helical member and the abutment plates during transversal displacement of the actuator, as described hereinabove.

The outwardly facing cavity in which internal magnet 89 is placed is defined by legs 114, cavity back 116 and bridge edge 113, and is suitably sized so that the internal magnet contacts wall 123 of lower rail 52 (FIG. 12). External magnet housing 19 is initially transversally displaced along track 102 to such a position that external magnet 9 and internal magnet 89 are in opposed relation, at a fixed distance ranging from 6-10 mm. Since external magnet 9 and internal magnet 89 produce a relatively high magnetic force, suitable for tilting the slats or raising them (in another embodiment) and are of opposite polarity, they quickly move in unison upon transversal displacement of external magnet housing 19 along track 102, which is initiated by a user. Since lower rail 52 is made from aluminum, the magnetic force exerted by external magnet 9 and internal magnet 89 is not significantly reduced by wall 123, which is interspersed between the two magnets. Likewise glass sheet 60 interposed between the two magnets does not adversely affect the magnetic force produced by the two magnets.

The transversal displacement of actuator 40, and therefore the rotation of tilting device 31 as well due to the kinematic relationship described hereinabove between external magnet housing 19 and tilting device 31, is limited by stopper 110, as the stopper abuts leg 57 and straight wall 70 of cord guide assembly 36 (FIG. 3). The length of stopper 110 is selected to be compatible with the transversal length of internal blind 10, so that the rotation of tilting device 31 will not be greater than a predetermined angle.

In contrast with prior art internal blinds with which great care has to be taken so that the slats remain horizontally disposed during shipping, handling and installment in order to avoid transversal cord movement and subsequent entanglement in other cords and/or slats, the present invention employs a central cord tensioning means. By applying a tensile force, e.g. of 0.5 kg, to the central cord, the central cord, as well as the outer cords connected thereto by means of the cross ladders of a ladder braid, will remain essentially perpendicular to planar surface 65 of lower rail 52 (FIG. 12), even if the blind is inverted. Due to the tensile force applied to the central cord, the slats may be tilted even if the blind is disposed in an inclined disposition, e.g. 45 degrees with respect to a horizontal plane, or even in a horizontal disposition, depending on the applied tensile force.

Figure 10:
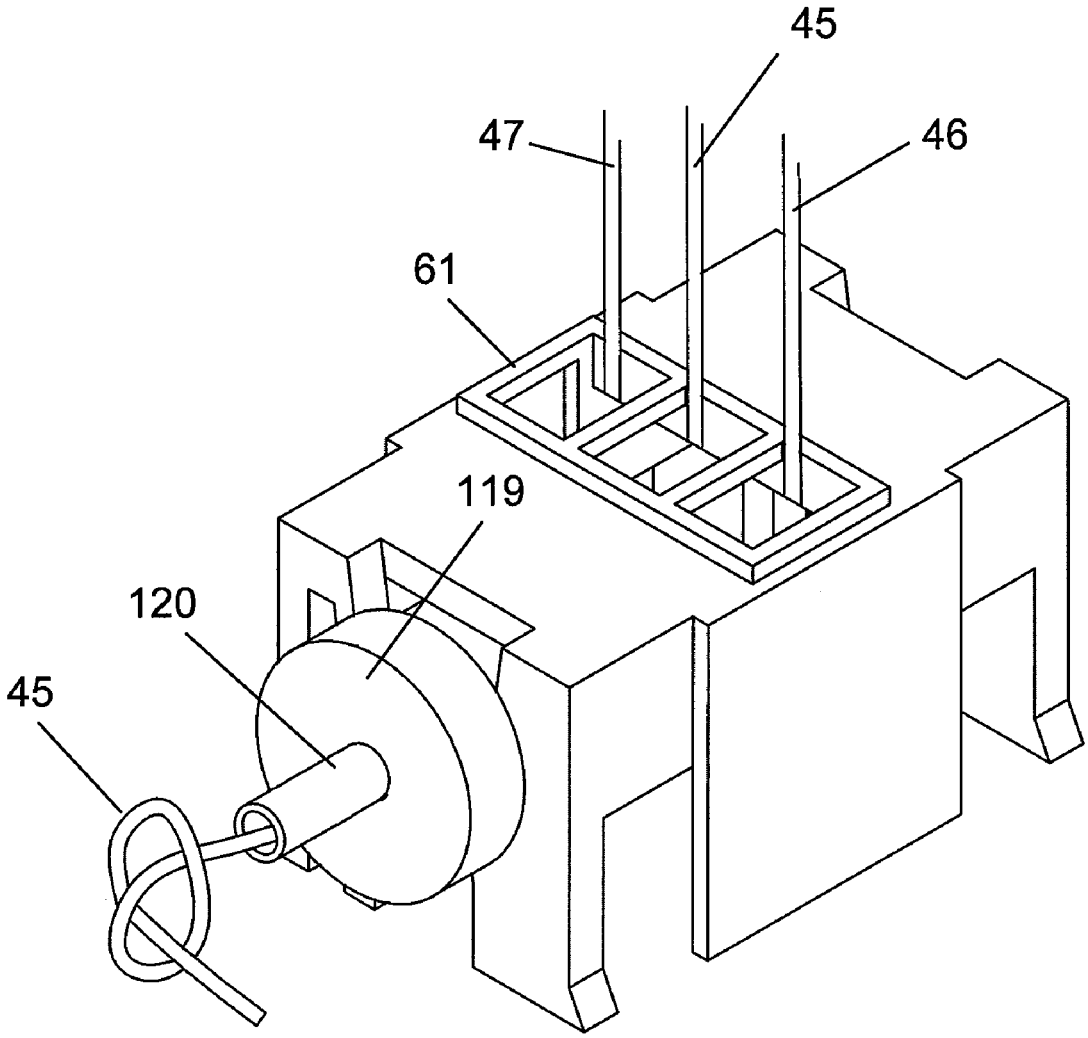
FIG. 10 is a perspective view of means for tensioning a central cord, according to one embodiment.

FIG. 10 illustrates an exemplary tensioning means which comprises base 119 having an elliptical cross section, or any other suitable long and thin shape, and an annular projection 120 perpendicularly protruding from base 119. Base 119 is placed on the outward face of laterally oriented transversal side 68 (FIG. 3), and as central cord 45 is pulled and tied onto annular projection 120, base 119 is pressed against side 68 of cord guide housing 36, which is in immobilized, pressed engagement within a corresponding rail 2 or 52. Central cord 45 can be tied in any convenient way that applies a constant, long-lasting and sufficient tensile force to base 119.

Figure 1B:
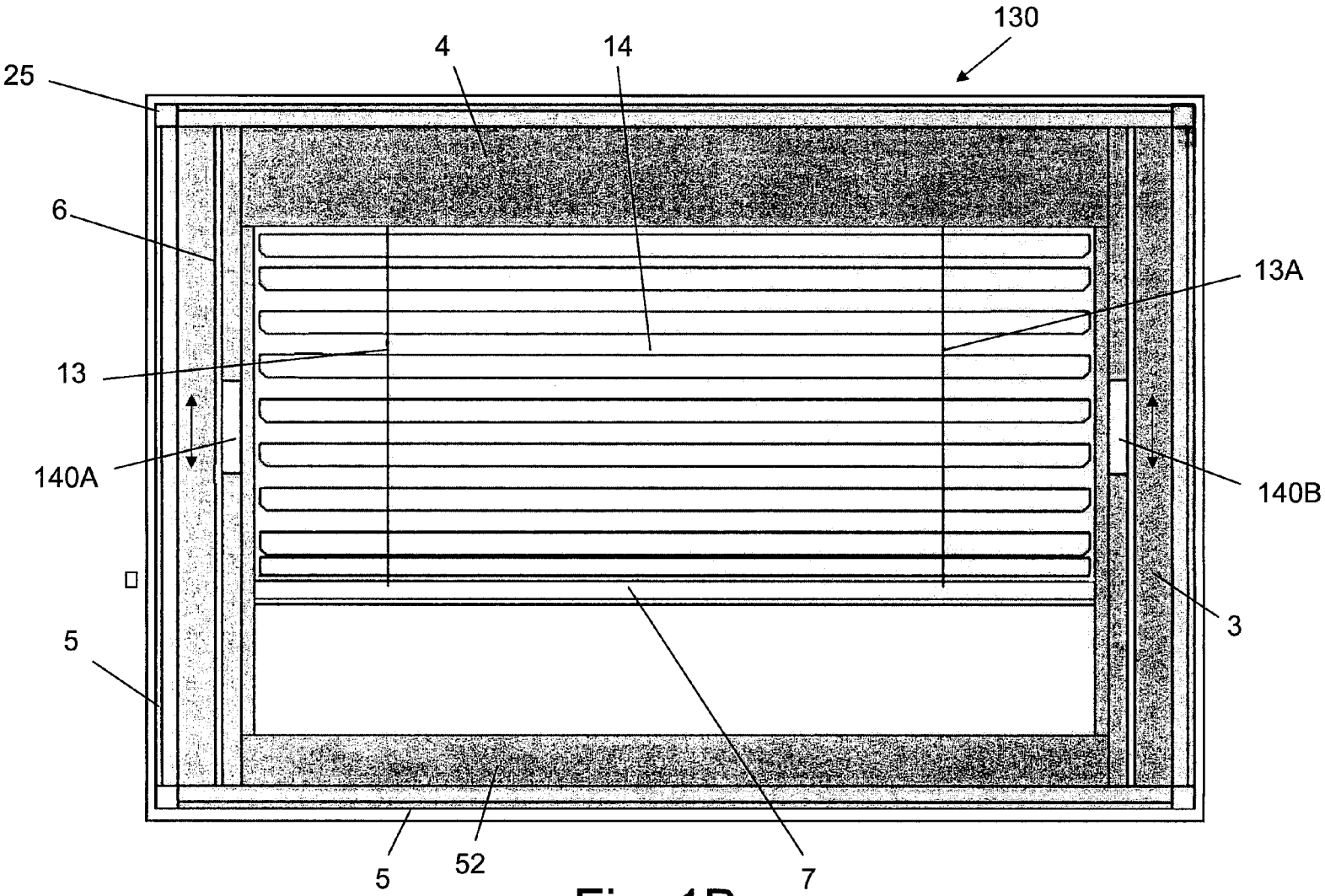

FIG. 1B illustrates an internal Venetian blind generally indicated by numeral 130, which is adapted for both tilting and raising/lowering a plurality of slats inserted between a double glazing unit with the use of lubrication-free bearing elements. Slats 14 are suspended from headrail 4, while ladder braids 13 and 13A are secured from below to slat support 7, e.g. made from aluminum, by means of an element (not shown) which is inserted into the slat support and presses the various cords of a corresponding ladder braid. Tilting is effected by longitudinally displacing actuator 140A and raising/lowering is effected by longitudinally displacing actuator 140B.

After suspending the slats from a suitably sized headrail 4, the aluminum frame of blind 130 is assembled in the manner illustrated in FIGS. 11A-C, 12 and 13A-B. Headrail 4, which is longitudinally longer than headrail 2 (FIG. 1A), is structured in a similar fashion as the latter, such that headrail 4 can be interlocked with rail cover 5 whereby longitudinal abutment surface 127 of the rail cover is coplanar with a corresponding abutment surface of headrail 4. Similarly rail cover 5 can be interlocked with transversally extending lower rail 52, as shown in FIG. 12, and with longitudinally extending side member 3, the latter being illustrated in FIGS. 13A-B.

It will be appreciated that cover 5 need not be interlocked with any of the aforementioned components by being inserted at an end of the component, e.g. a longitudinal end of side member 3. Cover 5 is advantageously adapted to be interlocked with a corresponding component by a single snap, e.g. at the lateral centerline of the cover when interlocked with a side member after one leg 125 has been inserted between legs 90 and 91 of a corresponding side member.

Figure 13A:
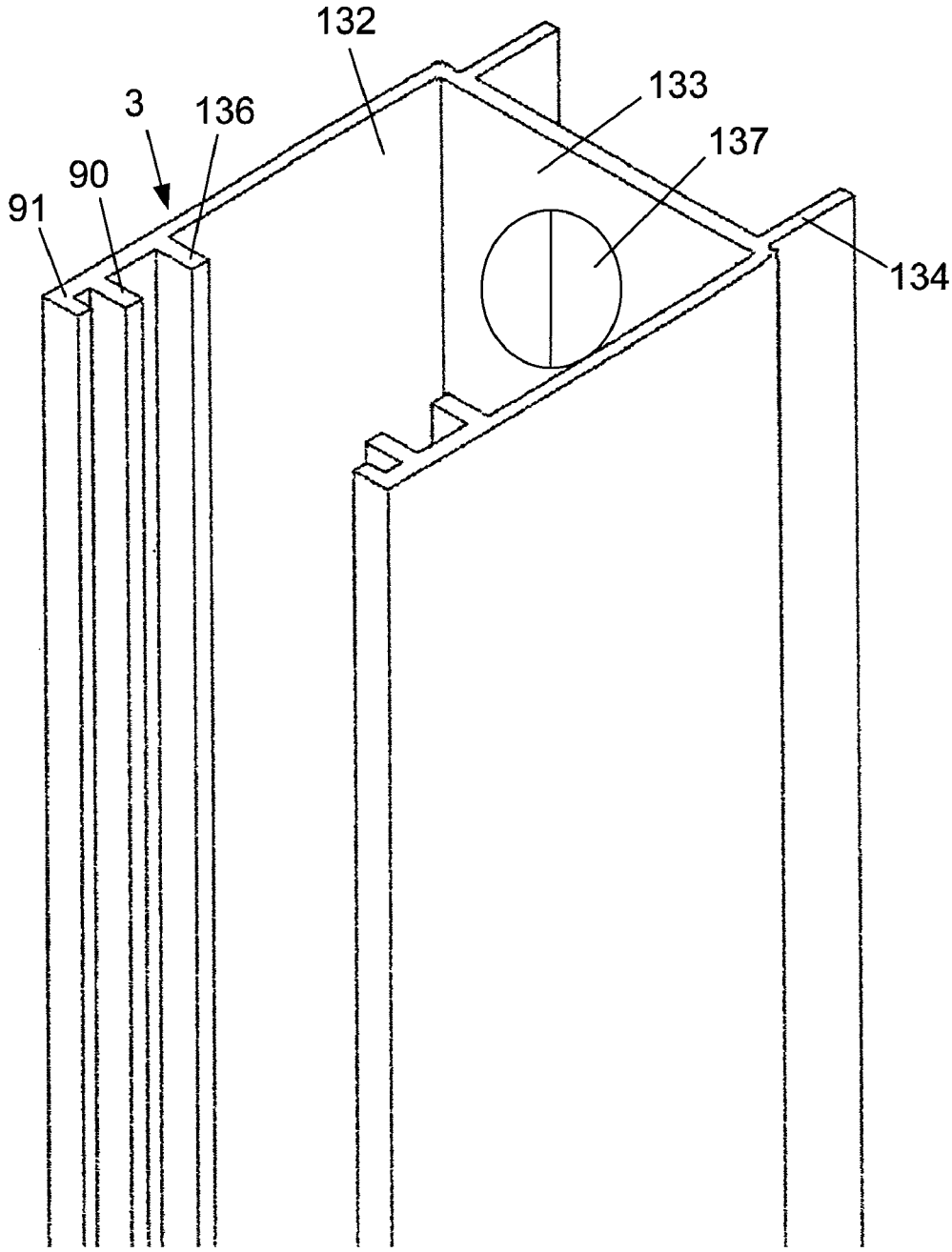
FIGS. 13A and 13B are perspective views of two longitudinal ends, respectively, of a side member.
Figure 13B:
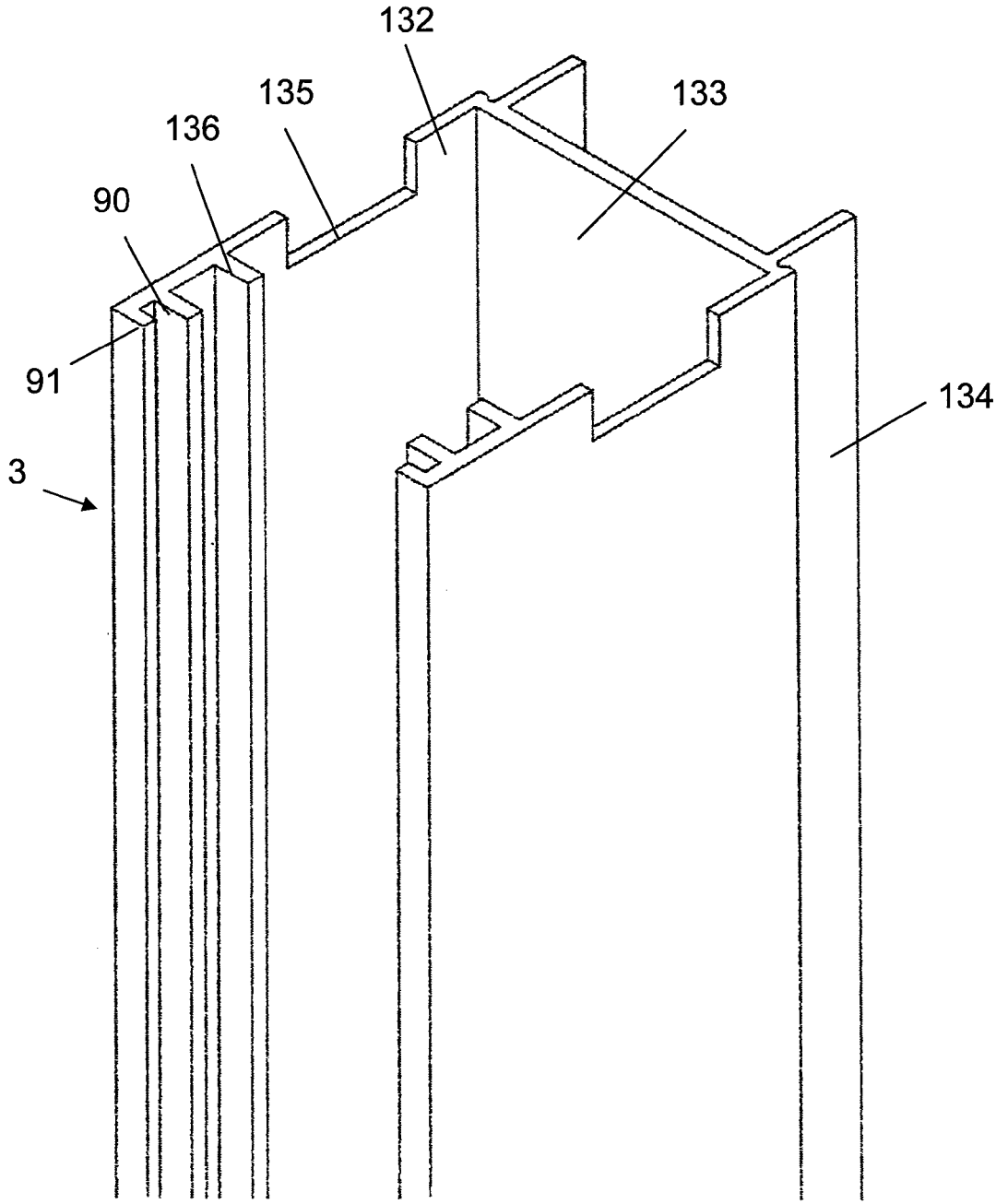

Longitudinally extending side member 3, as illustrated in FIGS. 13A-B, is a rectilinear component which comprises two longitudinally oriented walls 132, one laterally oriented wall 133 interposed between, and perpendicular to, walls 132, two parallel fins 134 transversally extending from the exterior of lateral wall 133 and laterally spaced from a corresponding longitudinally oriented wall 132, and two sets of mutually parallel, laterally oriented and longitudinally extending legs 90, 91 and 136 which perpendicularly protrude from the inner side of a corresponding wall 132, wherein the spacing between, and the dimensions of, legs 90 and 91 being equal to those of rails 2 and 52. The lateral dimension of leg 136 is preferably equal to that of leg 90. At one longitudinal end of side member 3, transversal wall 132 is formed with cut-out 135, as shown in FIG. 13B, which accommodates the fixation of bearing housing 8 (FIG. 16), as will be described hereinafter. At the other longitudinal end of side member 3, lateral wall 133 is formed with a circular aperture 137, as shown in FIG. 13A, which allows for the rotation of driving assembly 139 (FIG. 15) therethrough, as will be described hereinafter. Accordingly, each side member 3 is interlocked with a corresponding longitudinally extending cover 5, such that each cover 5 is at a transversal end of blind 130 (FIG. 1B) and fins 134 of one side member 3 face the fins of the other side member. It will be appreciated that side members 3 of blind 10 shown in FIGS. 1A and 2 may also have fins 134.

Figure 11A:
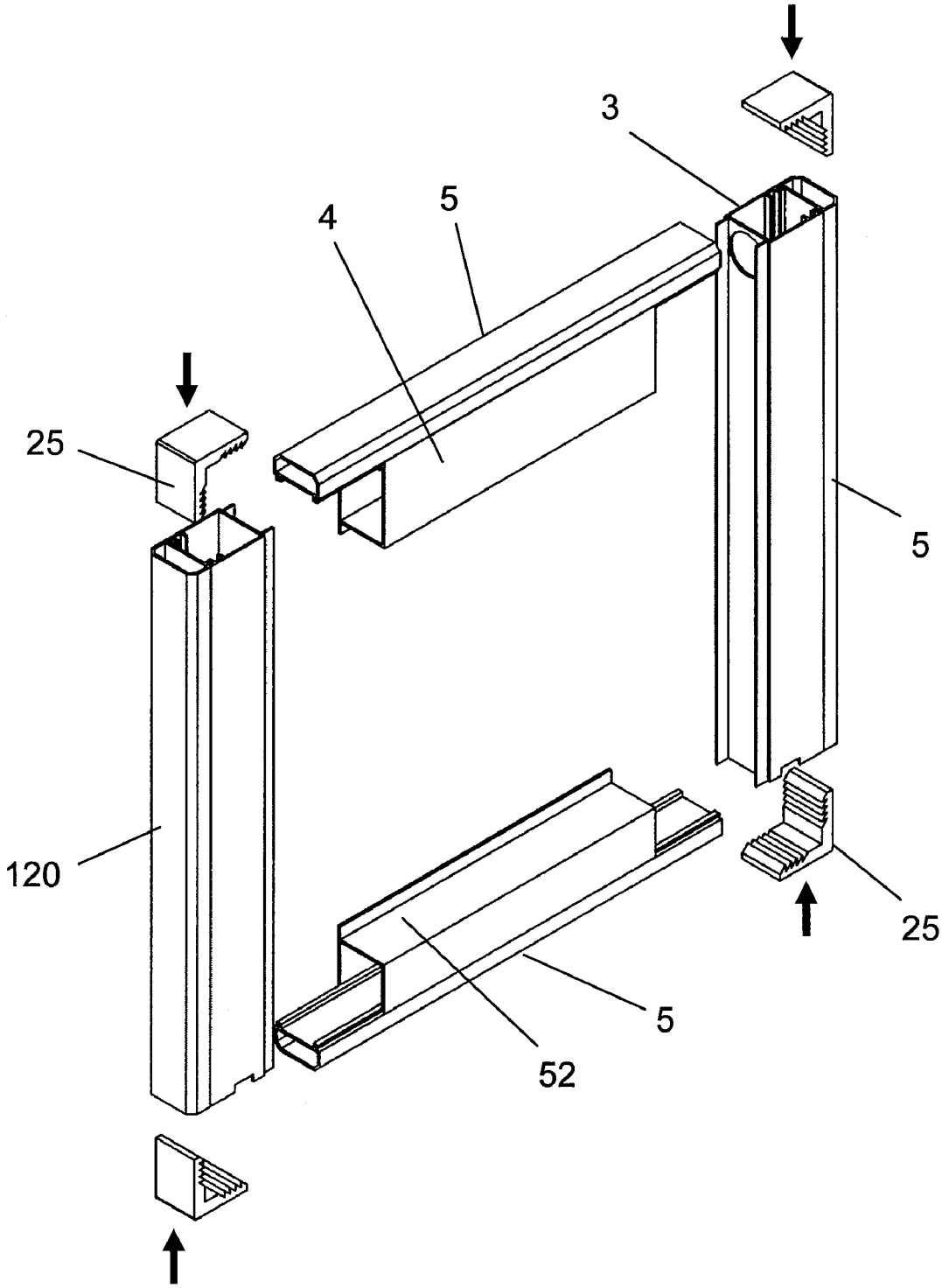
FIGS. 11A and 11C are perspective views of an assembling method for one embodiment of a blind frame.
Figure 11B:
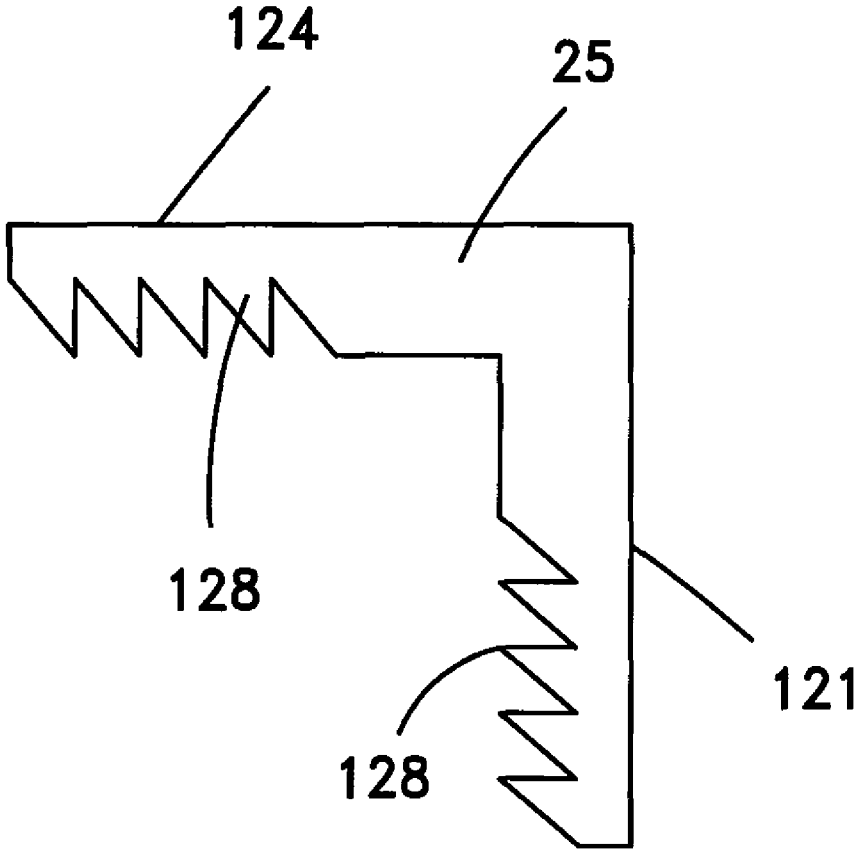
FIG. 11B is a side view of a frame corner.
Figure 20A:
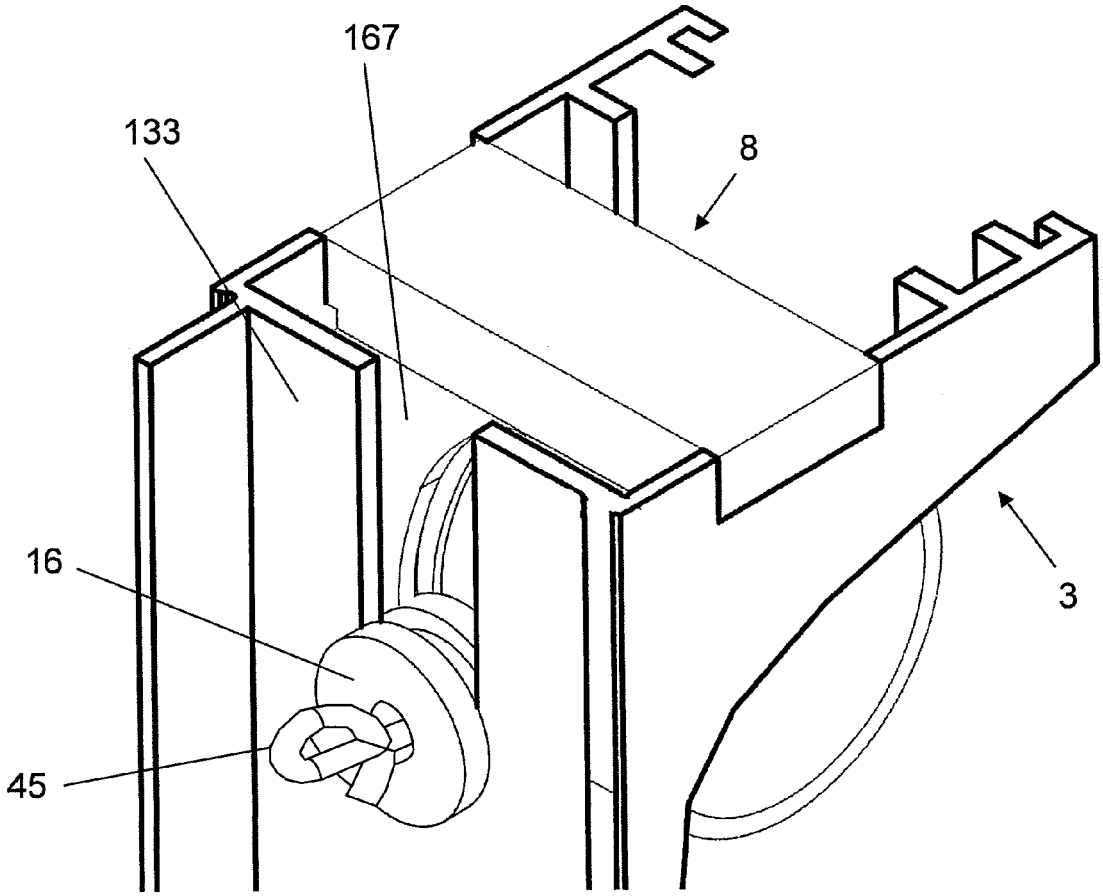
FIG. 20A is a perspective view of a stabilizer affixed to a side member when the central cords are removed.
Figure 20B:
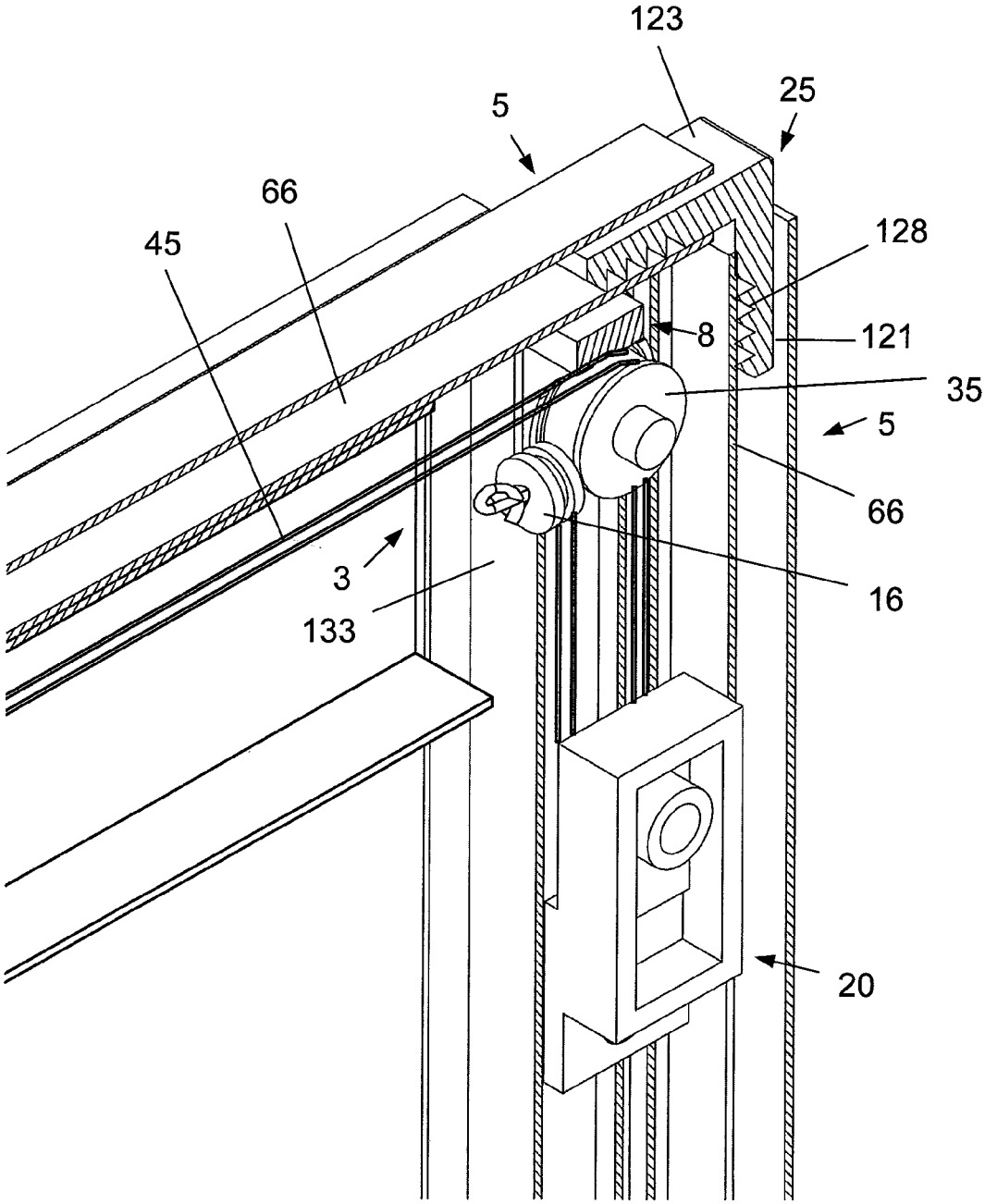
FIG. 20B is a perspective, cross sectional view of an internal blind frame, showing a corner being secured thereto and a portion of the raising/lowering arrangement.

A transversally extending cover 5 is then connected to headrail 4 and lower rail 52. As illustrated in FIG. 11A, lower rail 52 has an equal transversal dimension as headrail 4, while transversally extending cover 5 is longer than the two rails. A corner 25 made of a thermoplastic molded material, e.g. polypropylene, is then inserted into the upper and lower ends of each longitudinally extending cover as depicted in FIG. 11A, in such a way that laterally oriented surface 121 of the corner shown in FIG. 11B is adjacent to outer planar surface 120 of cover 5 (FIG. 12). While corner 25 is inserted into a corresponding longitudinally extending cover 5, wedge-shaped teeth 128 formed on the inner side of laterally oriented surface 121 of corner 25 snap in place by a press fit with inner planar surface 66 of longitudinally extending cover 5 (FIG. 20B). The lateral spacing between adjacent fins 134 of a side member 3 is substantially equal to, and slightly greater than, the lateral spacing between walls 122 and 123 of headrail 4 and lower rail 52 (FIG. 12).

Figure 11C:
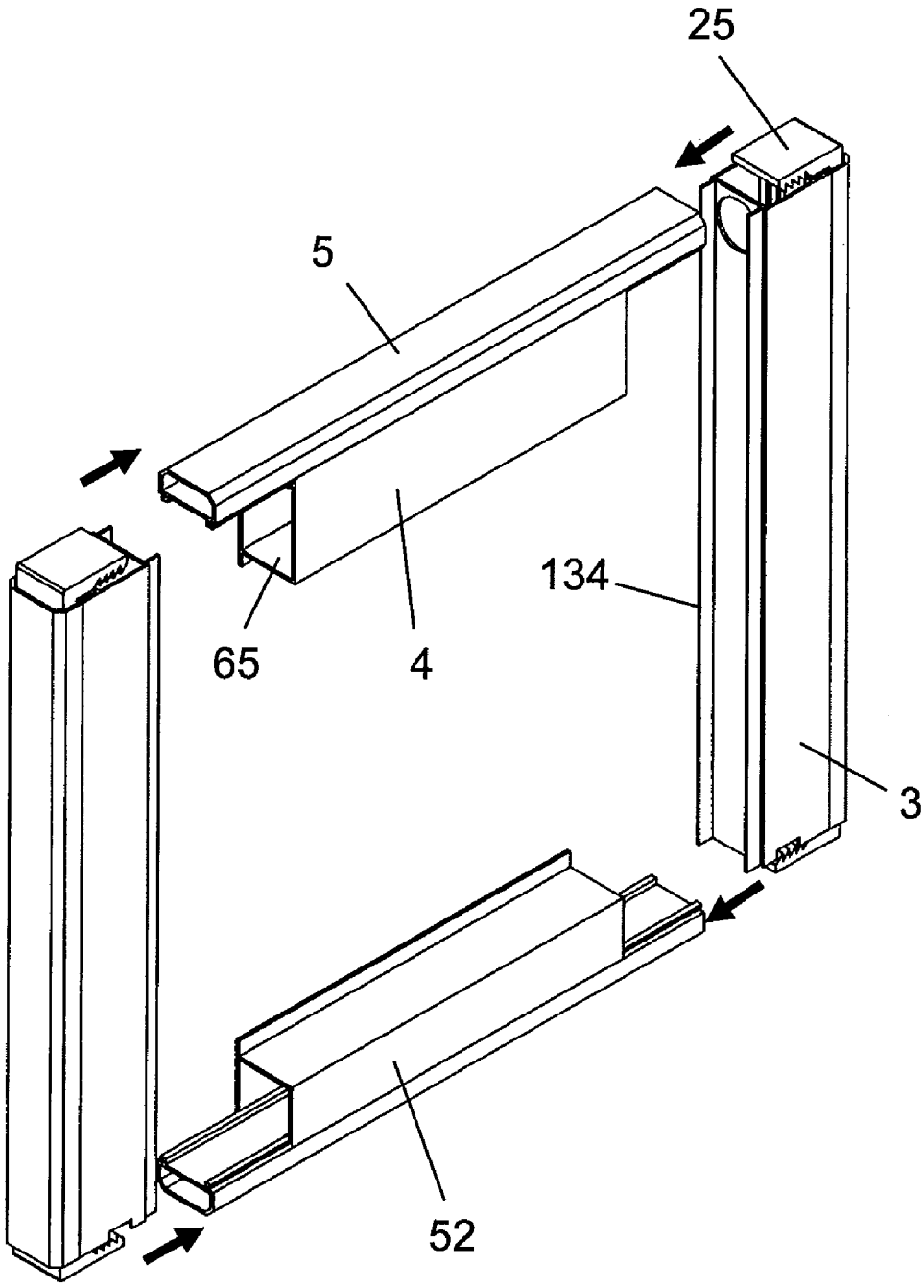

After being secured to the longitudinally extending covers, corners 25 are then secured to the transversally extending covers. As shown in FIG. 11C, the two side members 3 together with the corresponding longitudinally extending cover 5 and corner 25 are inwardly displaced until wedge-shaped teeth 128 formed on the inner side of transversally oriented surface 124 of each corner 25 snap in place by a press fit with inner planar surface 66 of a corresponding transversally extending cover 5, thereby preventing disengagement of a corner from a cover and resulting in a sturdy frame which is then bonded to glass sheets, e.g. by means of adhesive strips. Furthermore, walls 122 and 123 of headrail 4 and lower rail 52 (FIG. 12) are received between a corresponding pair of fins 134 of side member 3, thereby restricting movement of the plurality of slats (not shown) suspended by headrail 4 and increasing the capability of the blind to darken a room. Alternatively, side members 3 may be provided without fins, while laterally oriented wall 133 of side member 3 (FIGS. 13A-B) is bonded to adjacent walls 122 and 123 of headrail 4 and of lower rail 52.

By assembling the blind frame in the manner described hereinabove, each transversally extending cover 5 abuts two side members 3 and rail 4 or 52, as illustrated in FIG. 1B. As a result the frame may be painted in a uniform color, in contrast to the prior art wherein the various components are connected by screws and silicon, thereby necessitating the frame to have a non-uniform color. Also, the frame, as well as other components of the blind, may be easily assembled with several simple motions, and therefore may also be assembled by means of a robot.

Figure 15:
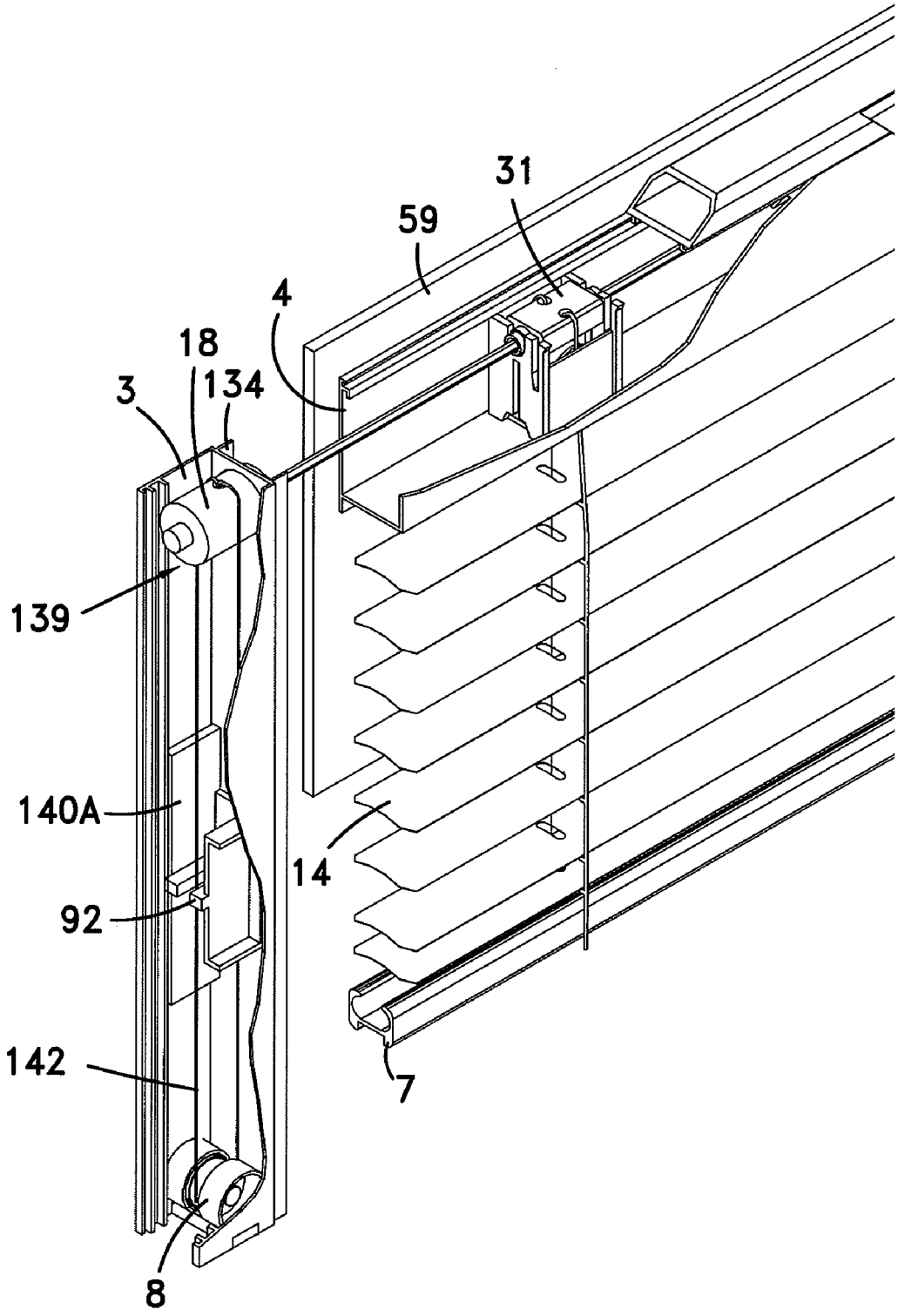
FIG. 15 is a perspective view of a side member and headrail, showing a driving assembly.

In this embodiment, one set of tilting device is employed, and is positioned within headrail 4, as illustrated in FIG. 15. Each tilting device is directly driven by driving assembly 139, and a greater degree of slat tilting may therefore be realized, as will be described hereinafter. D-shaped shaft 29 connects each tilting device 31 of the set with driving assembly 139, so that when actuator 140A is longitudinally displaced and driving assembly 139 is consequently rotated, all tilting device 31 connected to shaft 29 rotate an equal angular displacement. Driving assembly 139 in turn is driven by actuator cord 142, which is wound about a plain bearing (not shown) housed within bearing housing 8. Actuator cord 142 is affixed to driving assembly 139 and is tied to a hole bored through an abutment plate 92 of the actuator, while the ends of the actuator cord are tied to each other. Consequently, longitudinal displacement of actuator 140A results in corresponding longitudinal displacement of actuator cord 142 and in rotation of the plain bearing housed in bearing housing 8 and of driving assembly 139. The provision of a plain bearing and a rotating driving assembly therefore reduces the frictional resistance to the actuator cord and consequently, the required force needed to tilt slats 14.

Figure 16:
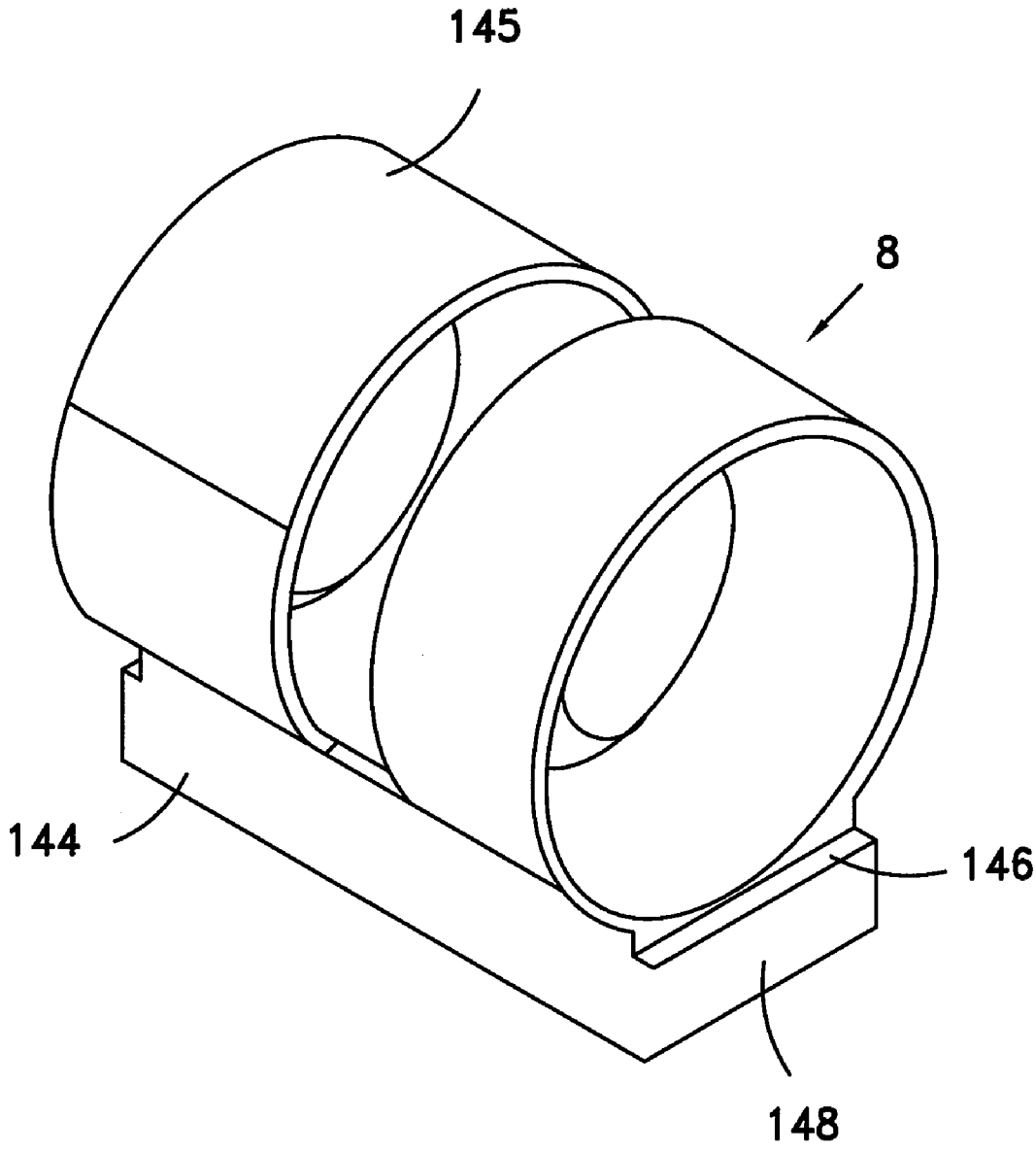
FIG. 16 is a perspective view of a bearing housing.

FIG. 16 illustrates bearing housing 8, e.g. made of polyacetal. Bearing housing 8 is formed of laterally extending base 144 and two parallel rings 145, which longitudinally protrude from base 144 and are spaced from each corresponding lateral end 148 thereof to define shoulder 146. The plain bearing is mounted within bearing housing 8 by flexing rings 145. Bearing housing 8 is secured to the bottom of side member 3, as shown in FIG. 15, by forcing each ring 145 to be in pressed engagement with corresponding leg 136 and lateral wall 133 of the side member while shoulder 146 is supported by the transversal wall of cut-out 135 (FIG. 13B), as further shown in FIG. 18.

Figure 17A:
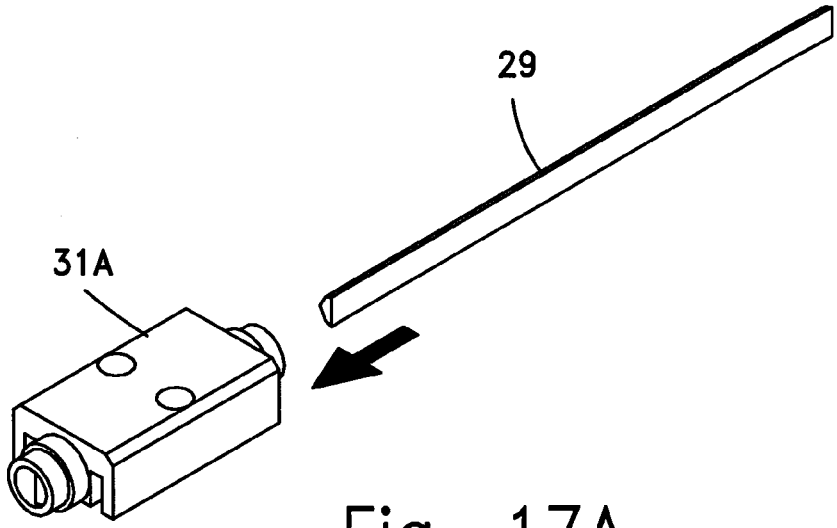
FIGS. 17A-D are perspective views of the steps by which one embodiment of a driving assembly is produced.
Figure 17B:
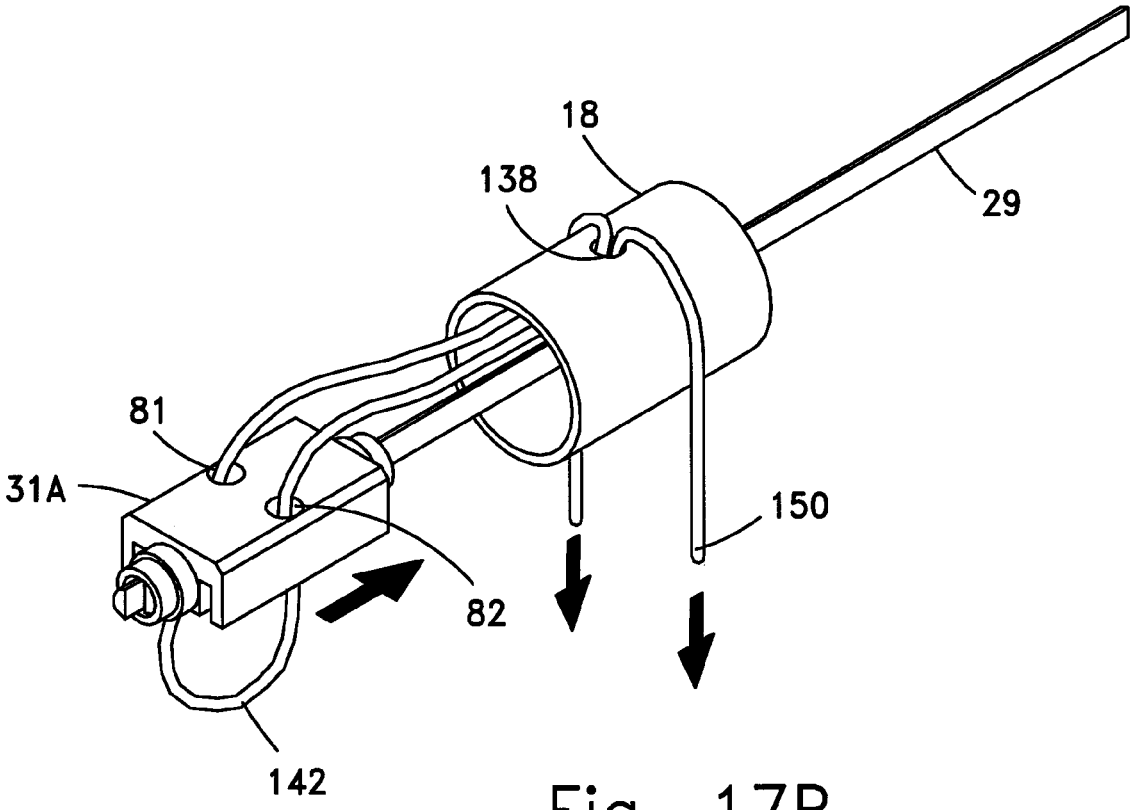
Figure 17D:
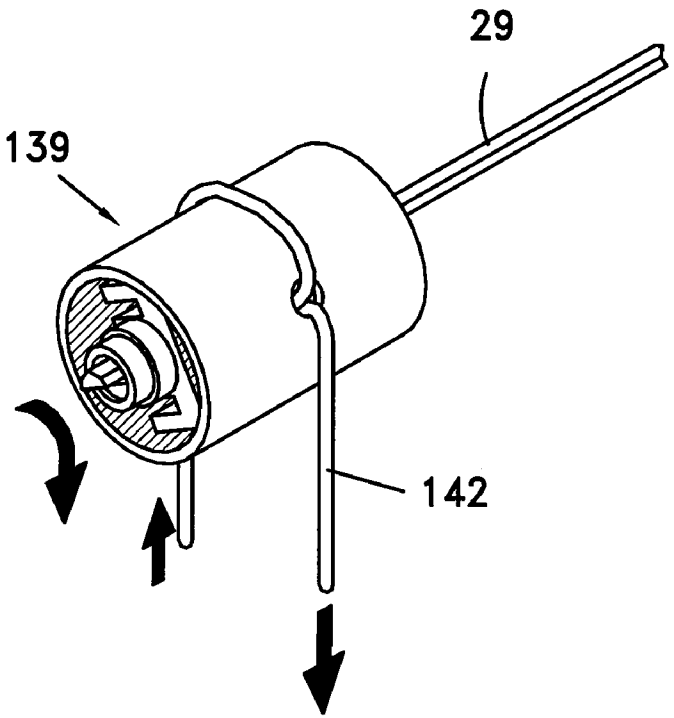
Figure 17C:
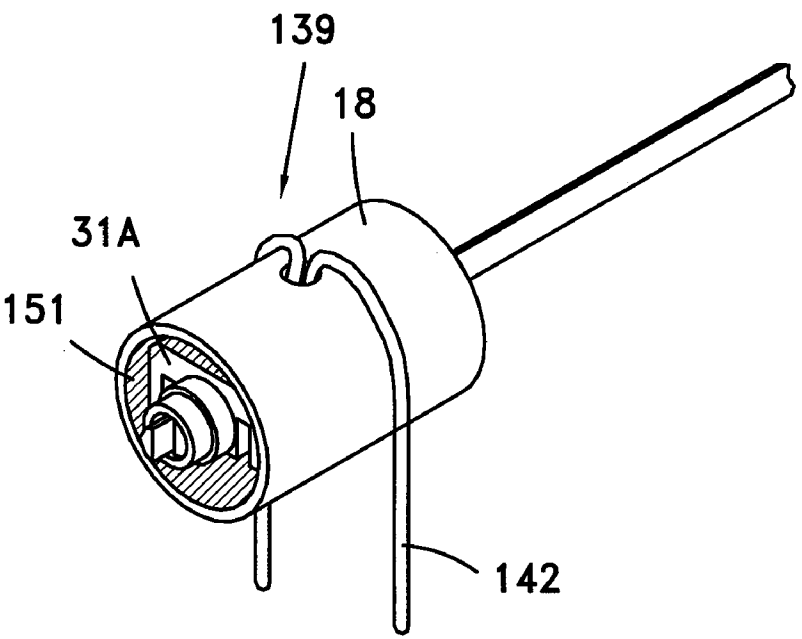

Driving assembly 139 is both a means to drive the tilting device and to receive D-shaped shaft 29, and is adapted to convert longitudinal linear motion of the actuator into rotational motion. Driving assembly 139 is produced by the steps illustrated in FIGS. 17A-D. After the slats have been suspended from headrail 4 (FIG. 15) by affixing the outer cords to corresponding tilting device 31 and the central cords to the centering means, as will be described hereinafter, and after the tilting device has been transversally positioned on shaft 29, shaft 29 is then inserted into receiving means 31A, which is the same component as tilting device 31, as shown in FIG. 17A. Cylindrical casing 18, e.g. made from aluminum, is then placed around receiving means 31A and pushed transversally inwards over shaft 29, as shown in FIG. 17B. Actuator cord 142 is then fed through aperture 138 bored in a central location within the periphery of casing 18, drawn through the interior of the casing, inwardly fed through aperture 81 of receiving means 31A, outwardly fed through aperture 82, drawn once again through the interior of casing 18, and outwardly fed through aperture 138, with ends 150 of the actuator cord dangling over casing 18 and facing longitudinally inwards. Receiving means 31A is then repositioned to be completely within the interior of casing 18, as shown in FIG. 17C, after which actuator cord ends 150 are pulled so that actuator cord 142 is in contact with the inner face of receiving means 31A. Hot, fast-drying glue 151 is then injected into casing 18, whereupon driving assembly 139 is produced such that casing 18, receiving means 31A and actuator cord 142 become one integral non-detachable unit. The actuator cord ends are then tied to each other, after the actuator cord has been tied to the actuator and wound around the plain bearing, as described hereinabove. Therefore driving assembly 139 and shaft 29 are rotatable in unison upon longitudinal displacement of actuator cord 142.

Figure 14C:
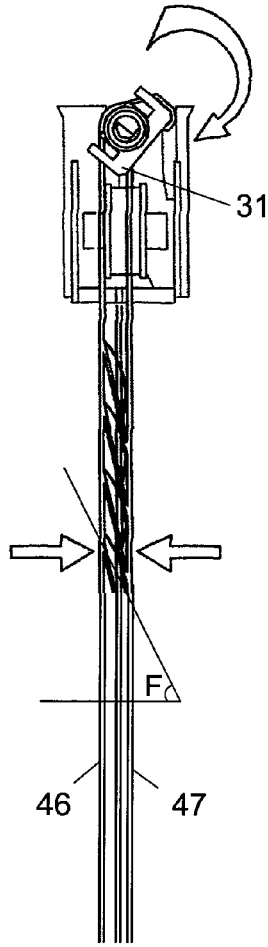

Since the tilting devices are directly driven by the driving assembly, a greater rotational displacement by the tilting device may be realized. FIGS. 14A-C illustrate the rotation of tilting device 31 from a completely open position of the slats in FIG. 14A to a completely closed position in FIG. 14C. During the stage of 14B, tilting device 31 is displaced to an intermediate rotational position and the slats achieve an inclination of E. When the slats are in a closed position, i.e. at a maximum inclination of F, as shown in FIG. 14C, the spacing between cords 46 and 47 is at a minimum, as shown by the arrows. During this stage the tension of outer cord 46 is maximum, and this maximum tension further assists in closing the slats by pressing on the top of each slat, thereby increasing the inclination thereof. Consequently, approximately 90% of the incoming solar radiation can be blocked, due to the increased inclination of the slats relative to prior art internal blinds.

The maximum rotational displacement of the tilting device shown in FIG. 14C is approximately 120 degrees clockwise from the rotational position shown in FIG. 14A. Although the tilting device can be further rotationally displaced, additional tensioning of the outer cords is liable to result in failure thereof. To limit the rotational displacement of tilting device 31 and the longitudinal displacement of actuator 140A, silicon may be injected into track 102 of actuator guide 6 (FIGS. 1B and 9) at predetermined locations, thereby producing stoppers (not shown).

Figure 23A:
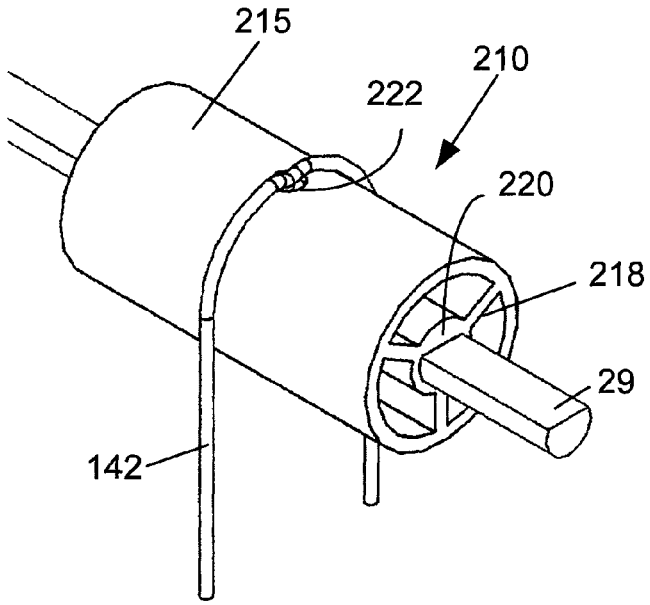
FIGS. 23A-C are a perspective view, side view, and a partially removed perspective view, respectively, showing the affixation of the outer cords thereto of another embodiment of a driving assembly.
Figure 23B:
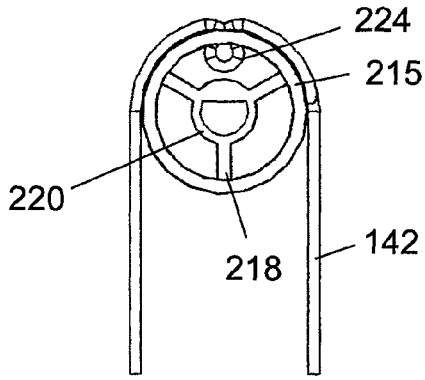
Figure 23C:
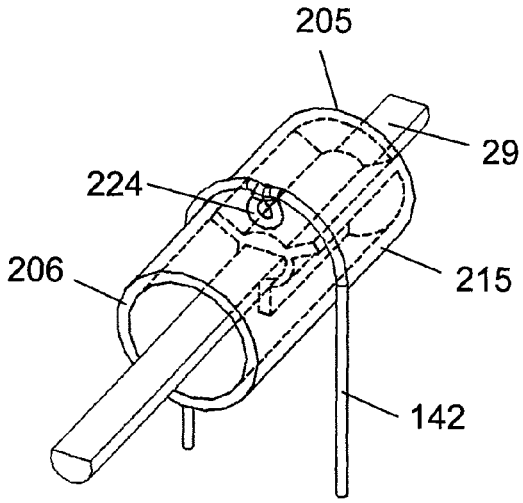

An alternative embodiment of a driving assembly, which is adapted to rotate a tilting device to such an extent so as to block up to 90% of the incoming solar radiation, is illustrated in FIGS. 23A-C. Driving assembly 210 comprises cylindrical casing 215, radial ribs 218 and central core 220, all of which are made from a lightweight and strong material such as polyacetal or aluminum. The three ribs 218, or any other suitable number of ribs, extend radially from inner face of casing 215 to core 220. The inner wall of core 220 is D-shaped, and is adapted to receive similarly shaped shaft 29. Ribs 218 extend transversally from the inward end 205 of casing 215 until approximately the transversal centerline thereof. By employing such a driving assembly configuration, a casing having a relatively small diameter ranging from approximately 13 to 19 mm may be employed, since the driving assembly is formed with an integral receiving means. The internal Venetian blind may therefore have an even thinner configuration, with an air gap between the glass sheets of only e.g. 17 mm when a casing diameter of 13 mm is employed.

In order to affix actuator cord to casing 215, knot 224 is tied at the middle of actuator cord 142. The ends of actuator cord 142 are then introduced into the outward end of casing 215, through the interior thereof, and fed through aperture 222 bored in the periphery of casing 215. After the ends of actuator cord 142 are pulled, actuator cord 142 divides into two portions which dangle over outer wall of casing 215 and extend longitudinally inwardly, and knot 224 engages the inner wall of casing 215. Consequently, actuator cord 142 will not be released from casing 215 as the actuator is longitudinally displaced and driving assembly 210 is thereby rotated.

Figure 18:
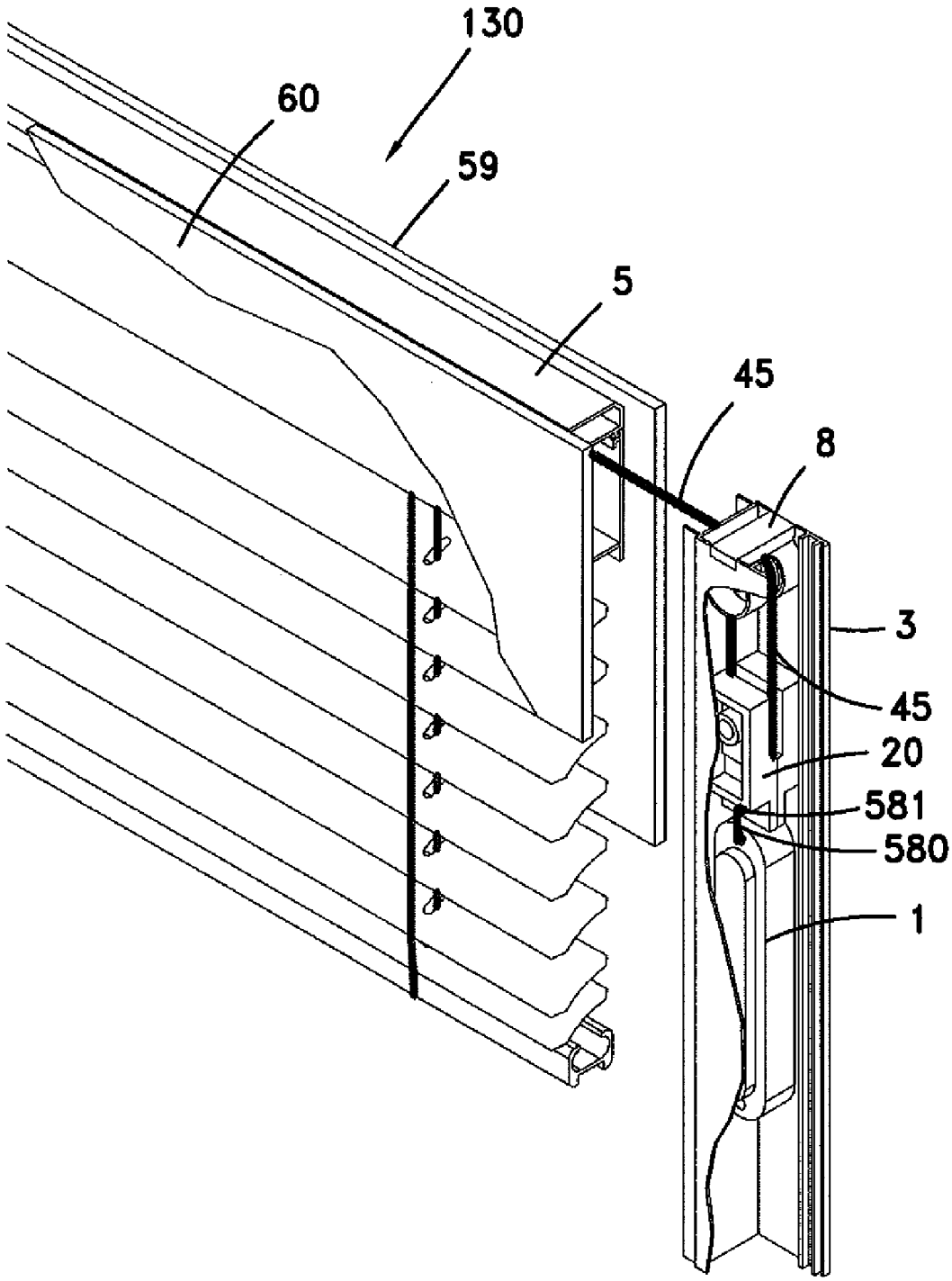
FIG. 18 is a perspective view of a side member, showing the arrangement for lowering and raising a plurality of slats within a manually operated internal Venetian blind.

FIG. 18 illustrates the raising/lowering arrangement of blind 130. By employing bearing elements, over which two central cords are wound, the frictional force that the central cords encounter is significantly reduced relative to the prior art, and therefore a lower actuating force is required to raise or to lower the slats. As a result, a plurality of slats with a surface area of up to 5 square meters can be lowered/raised and tilted effortlessly and speedily. Furthermore, the use of the bearing elements allows for a shorted path of the central cords, and therefore a stroke length of only approximately 40% of the longitudinal dimension of the blind is required to achieve complete raising/lowering of the slats, in contrast to the prior art which require a full 100% stroke length of the longitudinal dimension of the blind to achieve complete raising/lowering of the slats.

The raising/lowering arrangement includes bearing housing 8, bifurcated rectangular bearing block 20 and lead counterweight 1, all positioned within the interior of side member 3. Ball bearing 35 having opposed axles 38 (FIG. 19A) is housed in each of bearing housing 8 and bearing block 20 for reducing the frictional resistance to the central cords and for reducing the stroke length of the actuator, respectively. Counterweight 1 is attached to bearing block 20, e.g. by a rope, so that when actuator 140B is longitudinally displaced, counterweight 1 and bearing block 20 are displaced in a similar direction as the actuator, while slats 14 are longitudinally displaced in an opposite direction as the actuator.

In addition to ball bearing 35, a pair of plain bearings (not shown) is housed in housing 8. Each plain bearing encircles, supports and centers a corresponding axle 38 of the ball bearing. Each plain bearing presses against a corresponding transversal wall 132 (FIG. 13B) of side member 3.

Figure 19B:
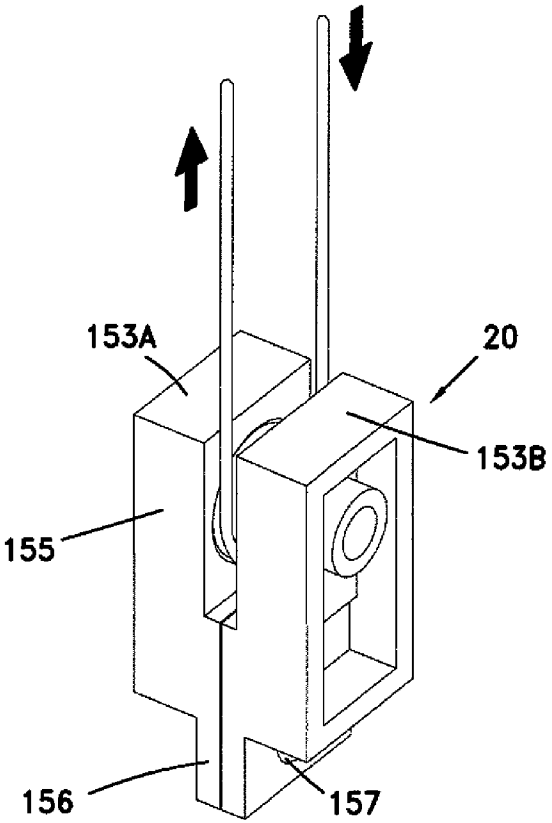
FIGS. 19A and 19B are perspective views before assembly and after assembly, respectively, of a longitudinally displaceable bearing block.
Figure 19A:
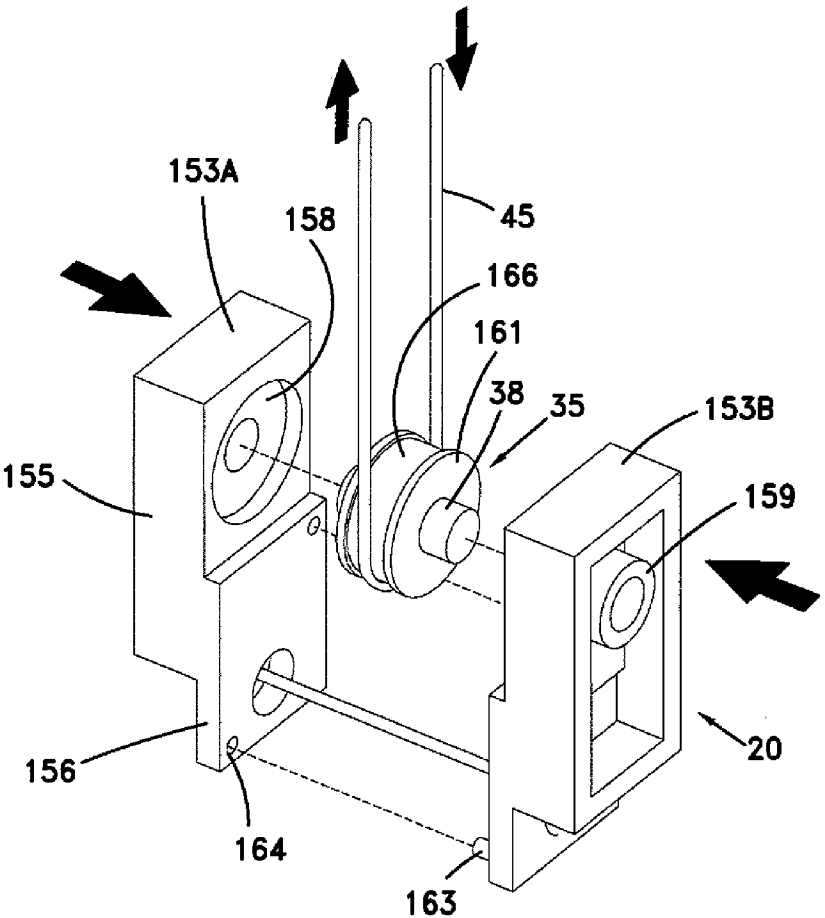

FIGS. 19A and 19B illustrate the assembly of bearing block 20. Bearing block 20 comprises two symmetrical rectilinear sections 153A and 153B. Each section is formed of an upper, laterally thicker portion 155, whose transversal dimension is substantially equal to that of transversal wall 132 of side member 3 (FIG. 13B) and therefore can be guided by wall 133 and leg 136 during longitudinal displacement, and a lower, laterally narrower portion 156. Upper portion 155 is formed with a circular recess 158 to receive therein a corresponding bearing flange 161 and annular portion 159 outwardly protruding from recess 158 in which is seated bearing axle 38. Lower portion 156 of section 153B is provided with a plurality of pins 163 which are snapped in place within corresponding seats 164 formed within the lower portion of section 153A.

When sections 153A and 153B are mated, as shown in FIG. 19B, the two lower portions 156 in opposed relation are in contact with each other. Block 20 is configured so that each upper portion 155 is spaced one from the other, with only bearing rim 166 being visible, so that the central cords wound around the bearing rim are free to be longitudinally displaced but are limited in terms of their lateral movement due to the existence of the upper portions 155 which may contact a central cord if it is moves in a lateral direction. For clarity, one central cord 45 is shown, but it is understood that two central cords are wound around ball bearing 35, one from ladder braid 13 and the other from ladder braid 13A (FIG. 1B).

Referring now to FIGS. 20A-D, central cords 45 are wound around ball bearing 35 mounted in housing 8, and after being wound around ball bearing 35 mounted in block 20 as shown in FIG. 19A, the ends of the central cords are affixed to side member 3. That is to say, central cords 45 are tied to stabilizer 16, e.g. made of three annular elements wherein the central element has a smaller diameter than the outer elements, and which is adapted to be slid under pressure within longitudinal groove 167 cut in wall 133 of the side member. Central cords 45 are inserted into an aperture formed within stabilizer 16 and are tied at the inner side of the stabilizer. Therefore stabilizer 16 applies a reactive force to the central cords as the latter are longitudinally displaced. Since the cords are wound around ball bearing 35 of block 20, the distance that the central cords traverse is consequently shortened, thereby resulting in a shorter required stroke length for the actuator in order to completely raise or lower the slats and in reduced frictional resistance to the central cords.

Figure 21A:
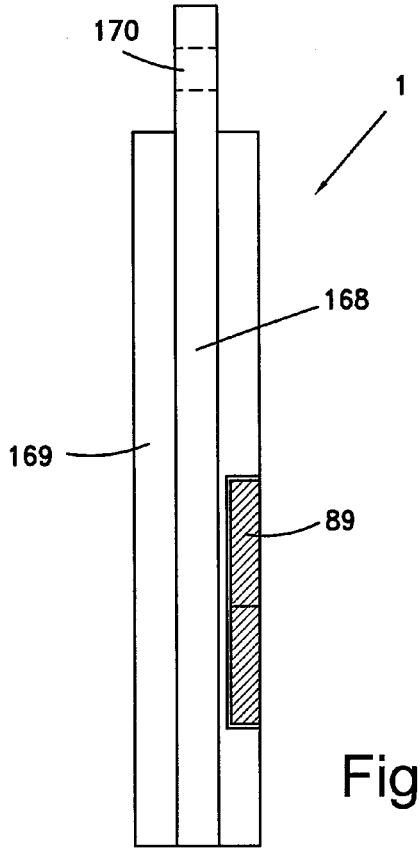
FIG. 21A is a side view of one embodiment of a counterweight and FIG. 21B is a perspective view of another embodiment of a counterweight, both counterweights being suitable for the arrangement of FIG. 18.

FIG. 21A illustrates a side view of lead counterweight 1, e.g. having an ellipsoidal shape as shown in FIG. 18 Counterweight 1 is formed by three integral portions: central portion 168, whose transversal dimension is substantially equal to that of transversal wall 132 of side member 3 (FIG. 13B) and therefore can be guided by wall 133 and leg 136 during longitudinal displacement, and two portions 169, each of which is laterally outward from said central portion. The lateral dimension of counterweight 1 is substantially equal to that of side member wall 133, and each outward portion 169 faces a corresponding transversal wall 132. The counterweight is preferably suitably sized such that there will be a small clearance, e.g. of 2 mm, between the counterweight and the walls of the corresponding side member, so as to allow for thermal expansion during the summer months.

Internal magnets 89 are housed in the outward portion 169 closest to the external magnet housed in external magnet housing 19 (FIG. 9) of actuator 140B (FIG. 1B). It will be appreciated that counterweight 1 is essentially the internal magnet housing for actuator 140B, and as external magnet housing 19 is longitudinally displaced along track 102 of actuator guide 6, counterweight 1 is similarly displaced and the slats are raised or lowered.

Bearing block 20 (FIG. 19A) and counterweight 1 are interconnected by a rope (not shown) that passes through hole 157 bored through the lower portions of bearing block 20 and through hole 170 bored through central portion 1678 of the counterweight. Alternatively, as shown in FIG. 18, bearing block 20 and counterweight 1 are interconnected by means of a longitudinally extending plastic rod 580 having two pairs of laterally extending contractible elements 581 at each longitudinal end of the rod. A pair of contractible elements 581 are press fit into each of hole 157 of bearing block 20 (FIG. 19B) and hole 170 of counterweight 1.

Figure 21B:
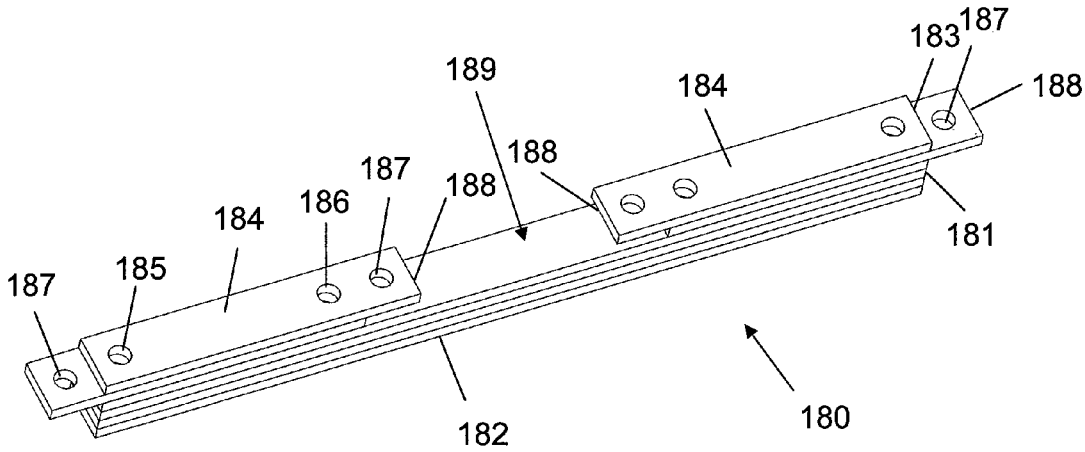

Alternatively, the counterweight may be embodied by a plurality of rectangular metallic plates, e.g. steel, as shown in FIG. 21B. The illustrated longitudinally extending and oriented counterweight 180 comprises three elongated plates 182 and four shortened plates 184, all of which having an essentially equal width. The three elongated plates 182 are stacked one in front of the other in longitudinal and transversal alignment, while two shortened plates 184 are stacked in longitudinally offset arrangement in front of the elongated plates 182. Elongated plates 182 are bored with four holes (not shown). Shortened plates 184 are bored with three holes 185, 186 and 187 such that the distance between holes 186 and 187 is considerably less than the distance between holes 185 and 186. Each pair of two shortened plates 184 are arranged in opposite orientation such that hole 185 of a first shortened plate is aligned with hole 186 of a second shortened plate. Shortened plates 184 are positioned relative to elongated plates 182 such that aligned holes 185 and 186 of oppositely oriented shortened plates 184 are also aligned with a corresponding set of holes bored in elongated plates 182. Therefore counterweight 180 is provided with four sets of aligned holes wherein each set consists of three holes bored in elongated plates 182 and two holes bored in shortened plates 184. A rivet, or any other suitable fastener, passes through the holes of each set of aligned holes, to mutually secure each elongated and shortened plate so that counterweight 180 will be provided with sufficient rigidity and structural strength for achieving reliable blind raising and lowering. It will be appreciated that any other suitable number of elongated and shortened plates may be employed as well.

While each longitudinal edge 181 of elongated plates 182 is longitudinally aligned with the corresponding longitudinal edge 183 of the frontmost shortened plate 184, longitudinal edge 188 of the other shortened plate protrudes from longitudinal edge 181 of elongated plates 182 to such a degree that hole 187 remains uncovered by the frontmost shortened plate. Consequently, the upper hole 187 of the second shortened plate 184 is available for affixing thereto the means for interconnecting counterweight 180 and bearing block 20 (FIG. 19A), whether a rope, plastic rod, or any other suitable interconnecting means. The volume between the longitudinal edges 188 of the two frontmost shortened plates, respectively, constitutes magnetic retaining compartment 189. Internal magnets inserted within magnet retaining compartment 189 are magnetically coupled to the frontmost elongated plate 182. The number of magnets inserted within magnet retaining compartment 189 may be changed, in order to adjust the magnetic force applied by the linear actuator.

Figure 37:
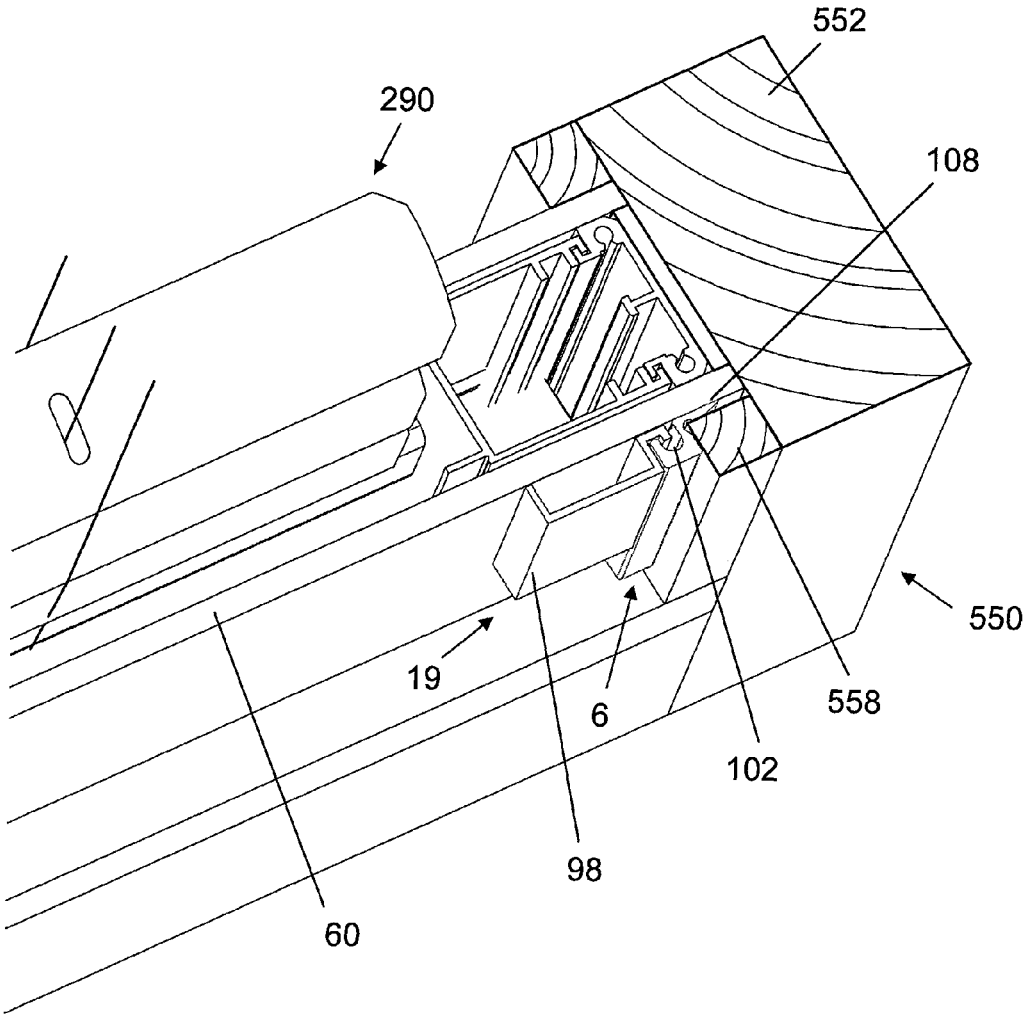
FIG. 37 is a perspective, cross-sectional view of an actuator guide being secured between a wall opening frame and an internal blind.

FIG. 37 illustrates actuator guide 6 in perspective, cross sectional view as it is installed between an internal blind and the frame of a wall opening. Wall opening frame 550, which delimits the opening in which an assembled blind 290, or any other blind, is inserted, comprises side elements 552, lower element 554, a top element (not shown), and removable securing elements 558. Wall opening frame 550 is made of wood, as shown, or of any other suitable load bearing material such as aluminum, and is fixedly attached to a wall formed with a suitable opening, e.g. a window opening, a door opening and a skylight opening.

Blind 290 is sized to substantially correspond to the dimensions of the wall opening. Blind 290 is inserted in the wall opening when securing elements 558 are removed from frame 550. Silicone sealant 69 (FIG. 5), or any other sealing material, may be applied to the blind frame. Actuator guide 6 is then positioned such that the planar inward face of mounting element 108 abuts front glass sheet 60 and arcuate track 102 extends in the intended direction of displacement for body 98 of external magnet housing 19. To retain actuator guide 6 in the desired orientation, securing element 558 is placed in abutting relationship with side element 552 of the wall opening frame and with contact element 111 of actuator guide 6 (FIG. 9) by a press fit and is then fixedly attached to side element 552 by means of a fastening element (not shown). Actuator guide 6 is provided with oblique side 115 to allow for access to contact element 111. The corresponding corner of securing element 558 is received in, and bears on, the wall of arcuate recess 109 of the actuator guide. External magnet housing 19 is coupled to arcuate track 102 of actuator guide 6 after the latter is immobilized by means of securing element 558. Actuator guide 6 is installed in situ, since a securing element 558 is generally not produced with standard dimensions.

Figure 30A:
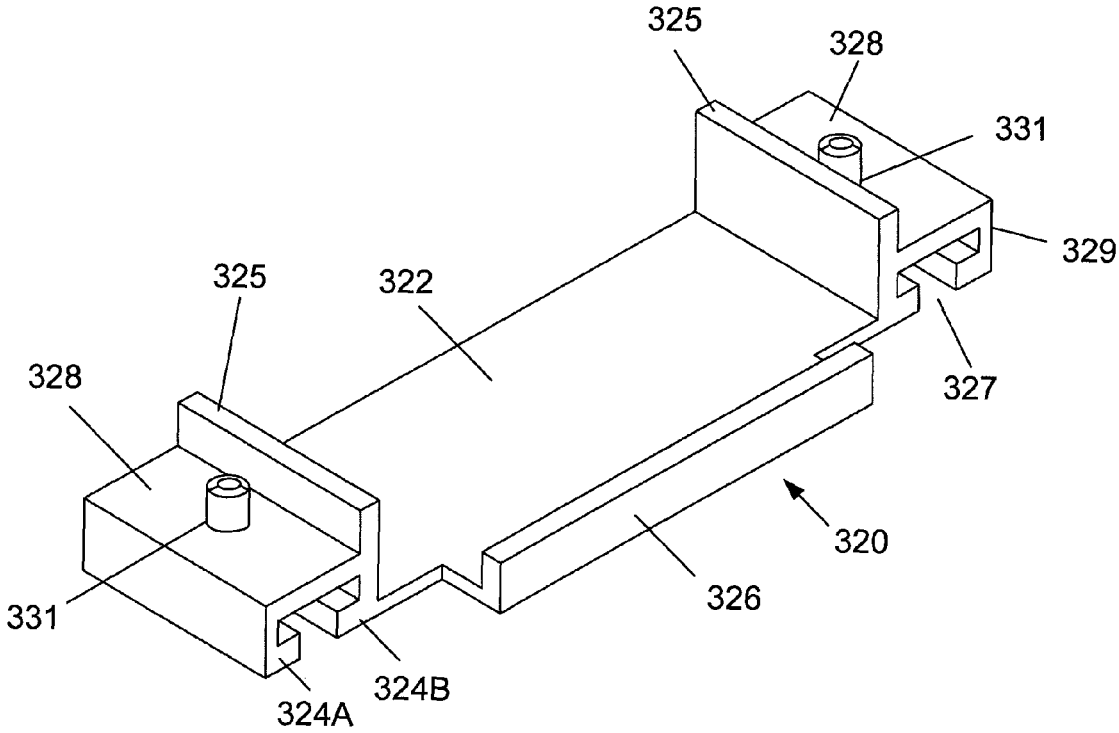
FIGS. 30A-D illustrate in perspective view the method for assembling another embodiment of the external magnet housing.
Figure 30B:
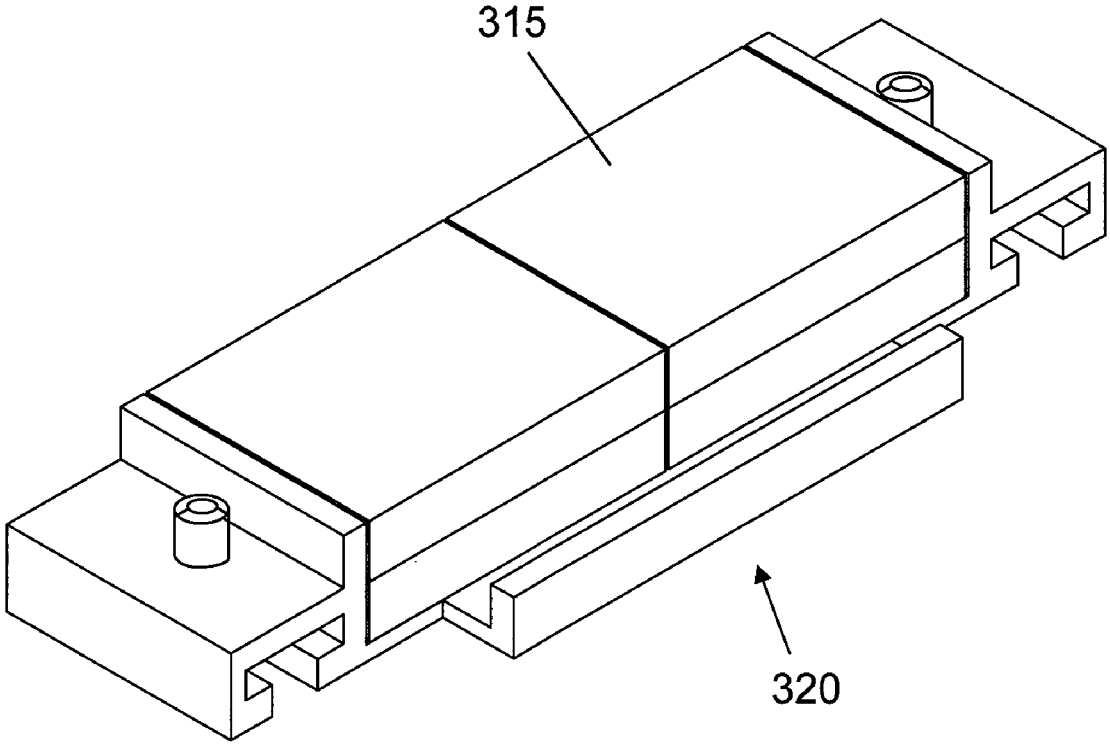
Figure 30C:
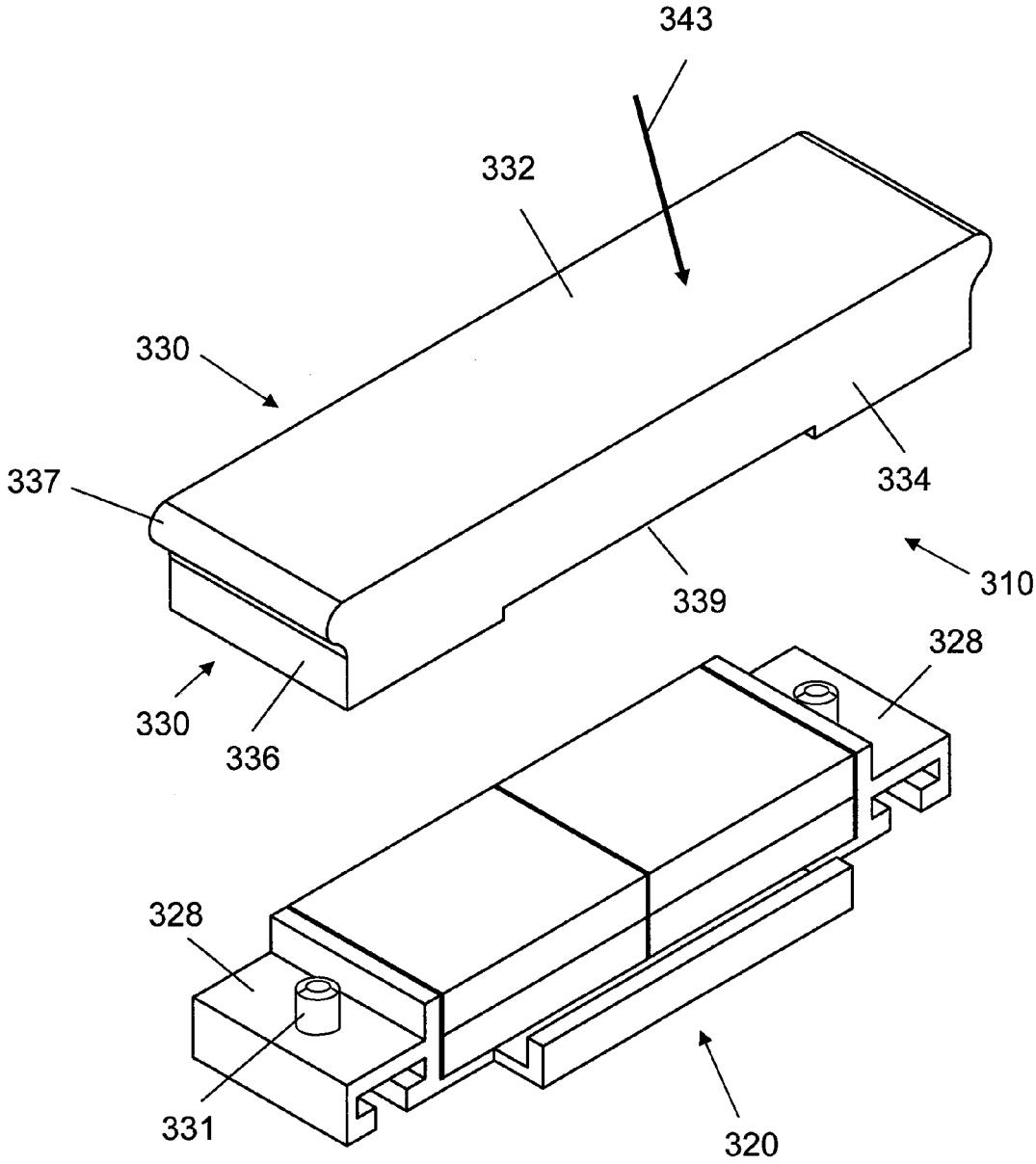
Figure 30D:
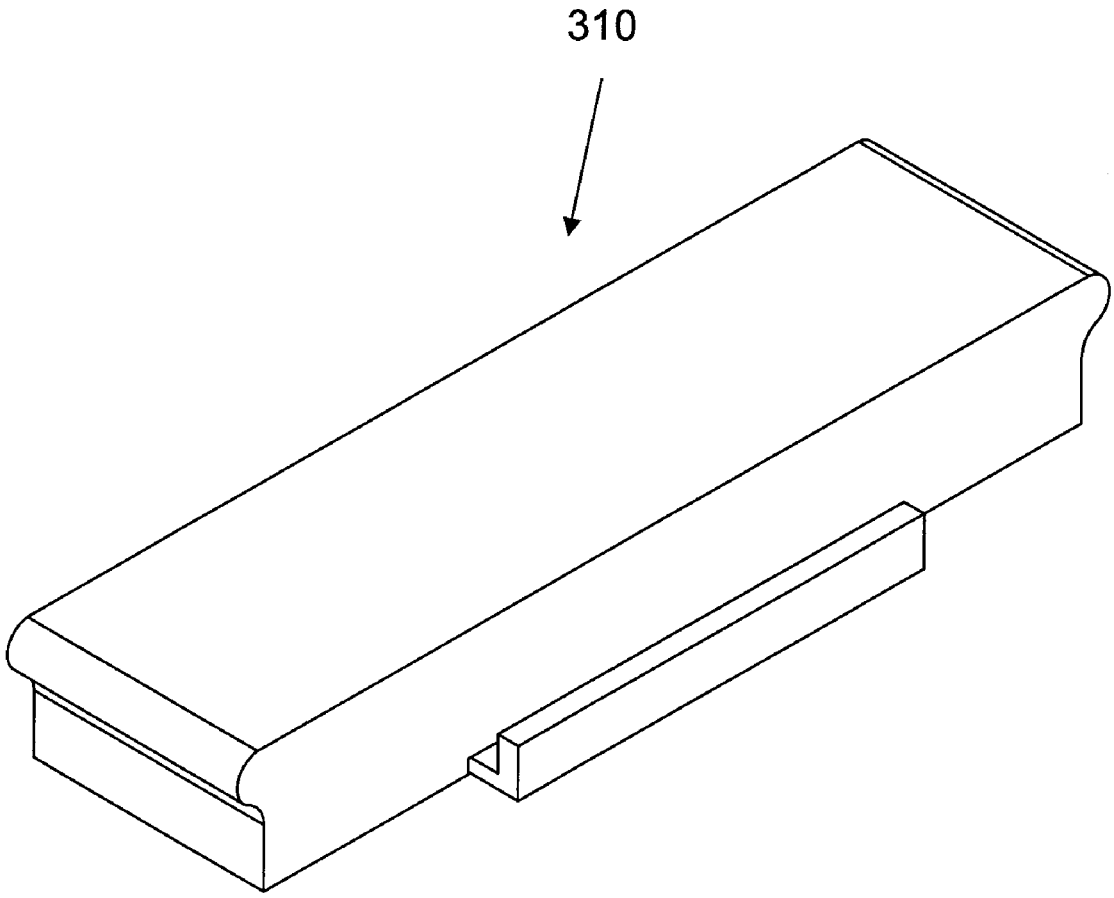

FIGS. 30A-D illustrate another embodiment of an external magnet housing. External magnet unit 310 is shown in FIG. 30D after being assembled by the three stages shown in FIGS. 30A-C, respectively. External magnet unit 310 comprises body 320, magnet cover 330, and external magnets 315 housed within body 320. Body 320 and magnet cover 330 are preferably made from polyacetal.

Body 320 shown in FIG. 30A is a rectilinear component having a magnet retaining compartment defined by inwardly facing back 322 adapted to contact the front glass sheet of the blind and two laterally oriented walls 325 outwardly extending from back 322, L-shaped appendage 326 having a transversal length less than that of back 322 and adapted to be slidingly displaceable within arcuate track 102 of actuator guide 6 (FIG. 9), and two dirt removing channels 327 which are external to the magnet retaining compartment. By employing back 322, external magnets 315 are advantageously separated from the front glass sheet of the blind, thereby achieving a lower coefficient of friction for the actuator. The use of a back 322 also prevents magnets 315 from rusting, since grease is unnecessary.

Each dirt removing channel 327 is defined by a transversally oriented plate 328 extending from approximately the middle of a corresponding compartment wall 325, a laterally oriented channel wall 329 extending inwardly from plate 328, and wall 325, wherein the inward edge of a wall 325 and the corresponding leg 329 are coplanar. Two opposed wiper elements 324A and 324B, which are essentially coplanar with back 322, extend transversally from channel wall 329 and compartment wall 325, respectively, towards the interior of the corresponding dirt removing channel 327. As external magnet unit 310 is displaced, wiper elements 324A and 324B contacting the front glass sheet of the blind scrape any dirt that has accumulated on the glass sheet. A brush (not shown), e.g. having bristles made from Teflon, is adapted to remove the collected dirt from channel 327. The brush handle may be structured to be insertable in the groove between wiper elements 324A and 324B and plate 328, for storage when not in use.

Magnet cover 330 shown in FIG. 30C has an outward, longitudinally oriented surface 332, two transversally oriented walls 334, and two laterally oriented walls 336 such that each laterally oriented wall 336 is connected with outward surface 332 by curved portion 337, which facilitates manipulation of the magnet cover by a user during actuation of the blind. The transversally oriented wall 334 facing L-shaped appendage 326 is formed with a notch 339.

After body 320 is coupled to track 102 of actuator guide 6, magnets 315 are inserted into the magnet retaining compartment as shown in FIG. 30B. Each magnet 315 has a transversal dimension approximately half of that of the magnet retaining compartment, so that two magnets in side-by-side relation contact the two walls 325, respectively. External magnet unit 310 is suitable for adjusting the magnetic force applied by the actuator by advantageously allowing a different number of magnets to be inserted within the magnet retaining compartment. Two, three, or four magnets 315 may be inserted within the magnetic retaining compartment, and when more than two magnets are employed, the magnets are arranged in two layers. Cover 330 is secured to body 320 by means of pins 331, each of which protrudes from the middle of a corresponding plate 328. By pressing on outward surface 332 as indicated by arrow 343 in FIG. 30C, pins 331 are received in corresponding recesses (not shown) formed in cover 330 and cover 330 is secured to body 320 by a snap fit. If a user feels that he has difficulty in actuating the blind, he simply removes cover 330 without having to disassemble the blind, inserts at least one additional magnet 315 into the magnet retaining compartment, and secures the cover to body 320.

As previously mentioned, the internal blind of the present invention may be inverted without loss of operability when reoriented to a working position. In this embodiment, reliable operation of the blind is ensured by retaining the central cords at substantially the lateral centerline of headrail 4, as shown in FIGS. 20C-D.

Figure 22A:
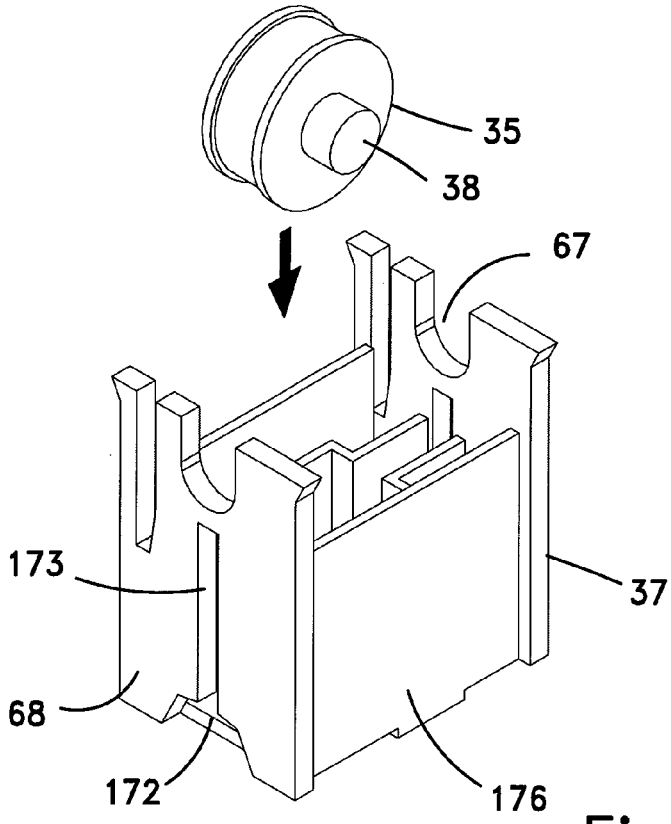
FIGS. 22A-C are perspective views of means for centering the central cords to the lateral centerline of a headrail.
Figure 22B:
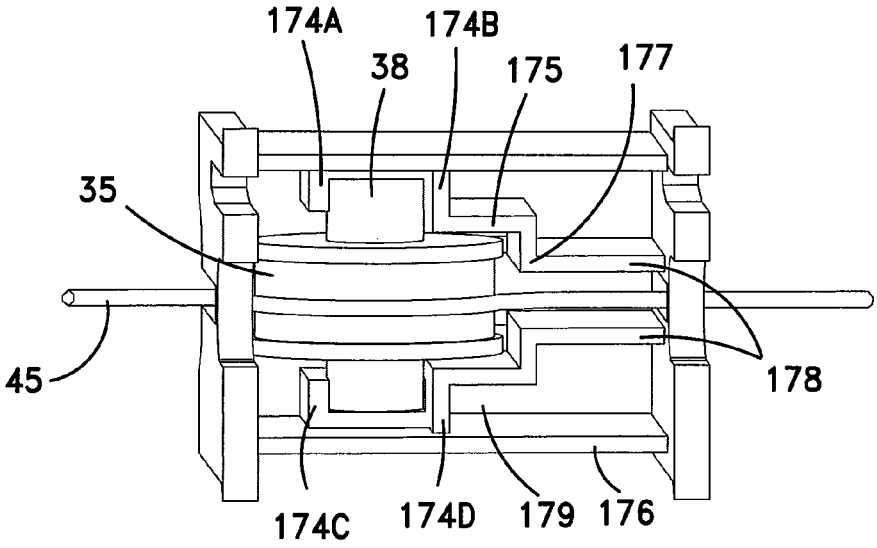
Figure 22C:
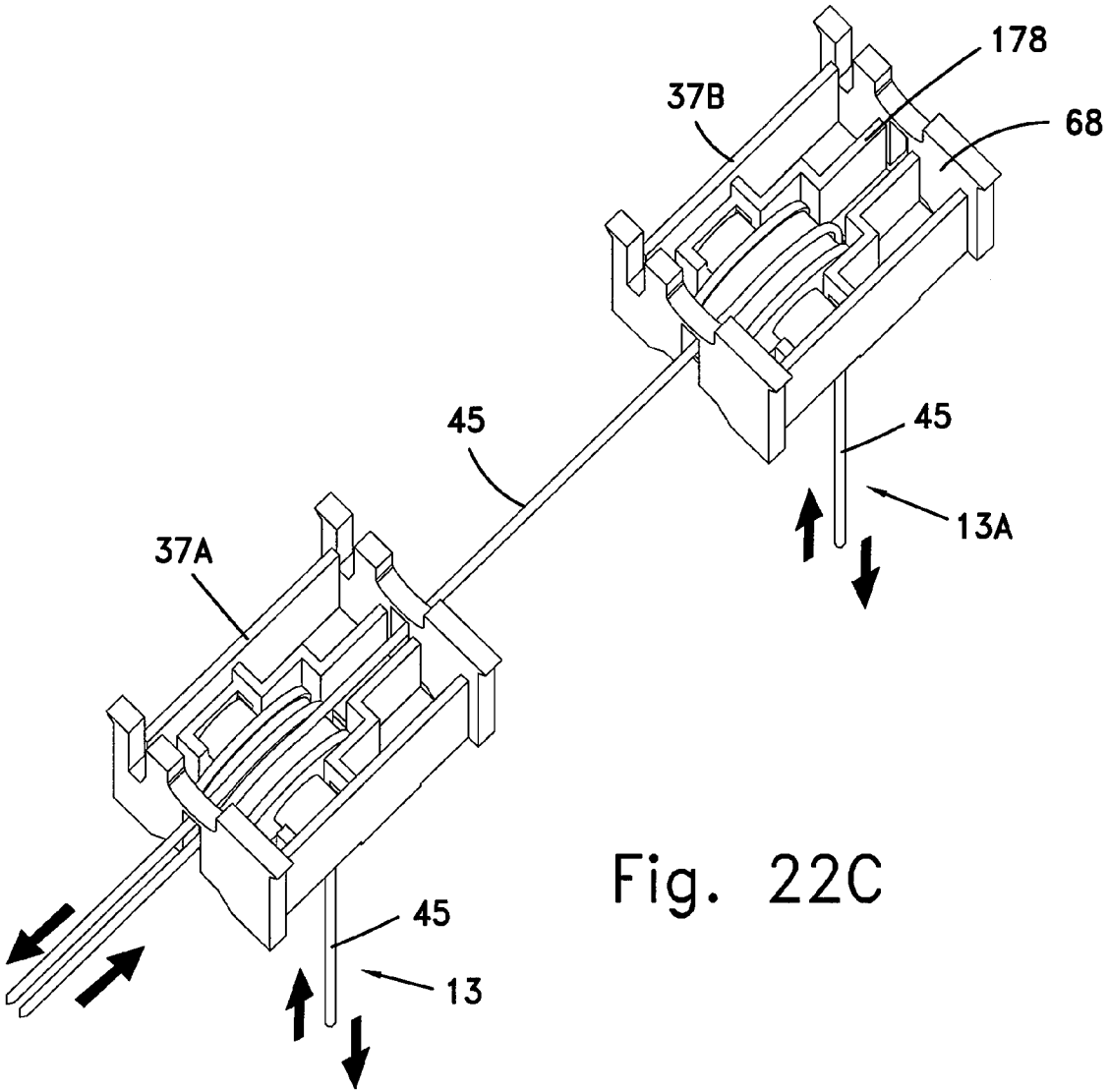

A means for centering central cord 45 illustrated in FIGS. 22A-C may be used. Cord guide assembly 37 is configured in such a way that central cords 45 are continuously urged to the lateral centerline of the headrail. The external structure of cord guide assembly 37 is identical to that of cord guide assembly 36 shown in FIG. 3, with the exception of longitudinally oriented walls 176 transversally extending from one laterally oriented side 68 to the other, trapezoidal opening 172 and narrow rectangular opening 173, the last two being formed in each laterally oriented side 68. Internal laterally oriented walls 174A-D extend from a corresponding wall 176 and are suitably configured so as to allow each axle 38 of ball bearing 35 to be rotatingly seated between a pair of internal laterally oriented walls wherein the axis of the axles is laterally oriented. Internal transversally extending walls 175 extend from each of laterally oriented walls 174B and 174D, defining the housing of ball bearing 35. Transversally extending partitions 178 extend from one laterally oriented wall 68 of cord guide assembly 37 and terminate with a corresponding internal lateral wall 177, which is perpendicular to the end of the corresponding internal transversal wall 175. The spacing between partitions 178 is substantially equal to the lateral dimension of rectangular opening 173.

Figure 20C:
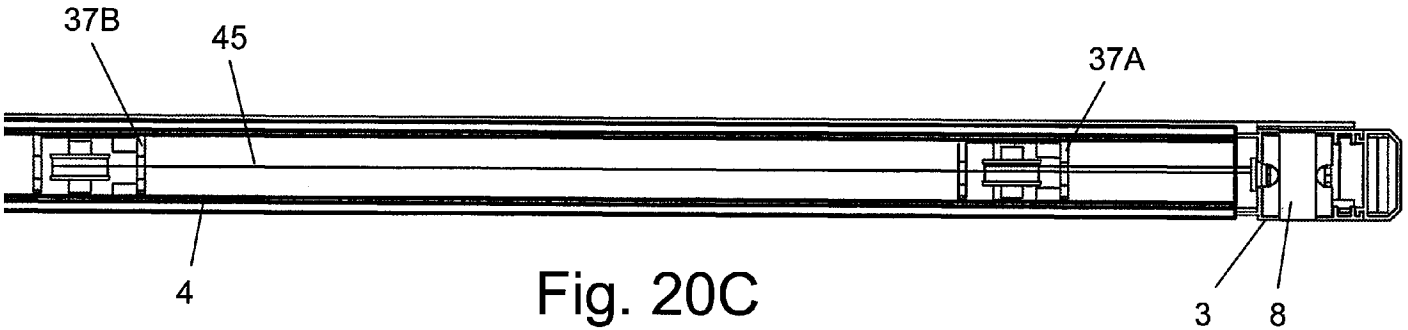
FIG. 20C is a plan view of a blind in which central cords extend substantially through the lateral centerline of the headrail thereof.
Figure 20D:
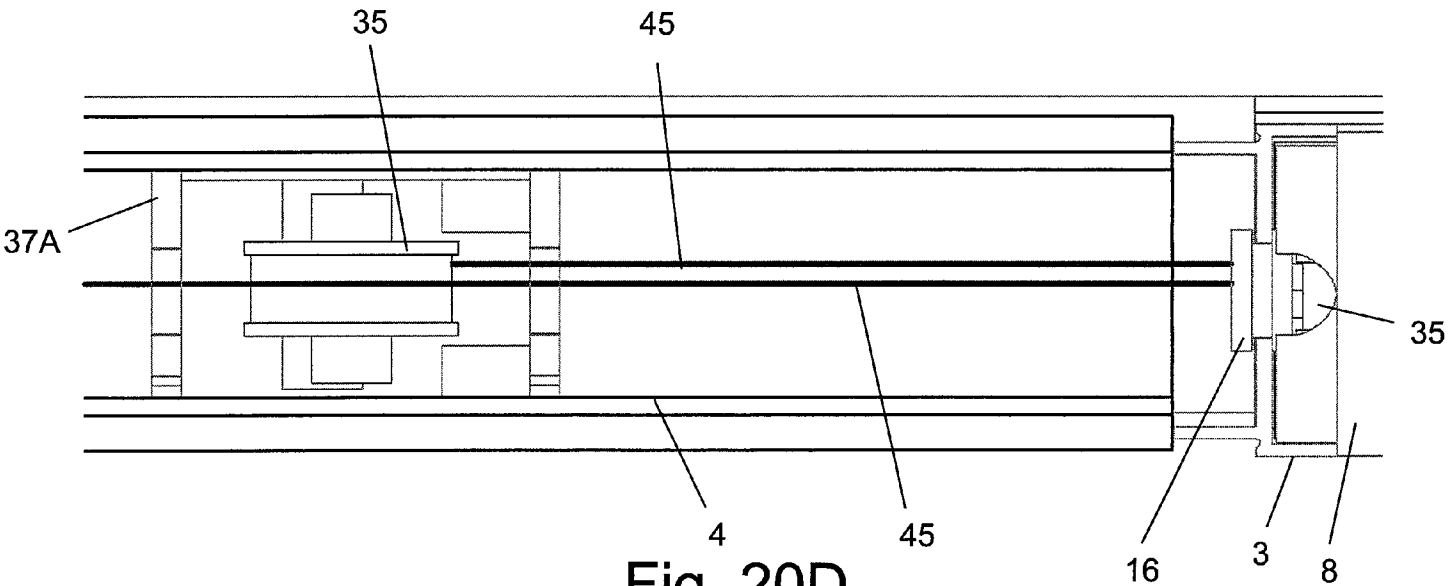
FIG. 20D is an enlarged view of FIG. 20C.

As shown in perspective view in FIG. 22C and in plan view in FIGS. 20C-D, two cord guide assemblies 37A and 37B are employed for ladder braids 13 and 13A, respectively. Central cord 45 of ladder braid 13A longitudinally extends through the central section of cord guide 61 defined by dividers 62A and 62B (FIG. 3), as further shown in FIG. 10, and is wound around ball bearing 35, between the bearing and walls 177. The cord then exits cord guide assembly 37B via rectangular opening 173, and then is in contact with the rim of the ball bearing 35 associated with cord guide assembly 37A, before being wound around ball bearing 35 of bearing housing 8. Similarly, central cord 45 associated with ladder braid 13 longitudinally extends through cord guide assembly 37A and is wound around its corresponding ball bearing before exiting the cord guide assembly via rectangular opening 173. Thus two central cords exit cord guide assembly 37A, as shown in FIGS. 20C, 20D, and 22C.

Partitions 178 of cord guide assembly 37A advantageously urge the central cord associated with ladder braid 13A to remain in the center of rectangular opening 173. When the internal blind is tilted to an angle of 45 degrees, for example, relative to the ground, central cord 45 contacts one of the partitions 178, and therefore additional lateral movement is prevented. When the blind is completely inverted, each central cord contacts the wall at the longitudinal end of the corresponding rectangular opening 173. After the blind is reoriented to its original position the central cords contact again the ball bearing of each cord guide assembly 37, as described hereinabove, and are thereby centered within the headrail. The lateral centering of the central cords is additionally facilitated by the ball bearing 35 of bearing housing 8, which is centrally positioned within side member 3 by means of plain bearings, as described hereinabove, and by ball bearing 35 of bearing block 20, which is centered by its two sections 153A and 153B (FIG. 19B).

After annular protrusions 85 of tilting device 31 (FIG. 4) are mounted in annular openings 67 (FIG. 22A), respectively, of cord guide assembly 37, the outer cords may be affixed to tilting device 31. The two outer cords are inserted within a corresponding outer section of cord guide 61 (FIG. 3) and then pulled through open region 179 between longitudinally oriented wall 176 and corresponding internal transversal wall 175 (FIG. 22B), whereupon the outer cords are affixed to tilting device 31, as described hereinabove.

Figure 38:
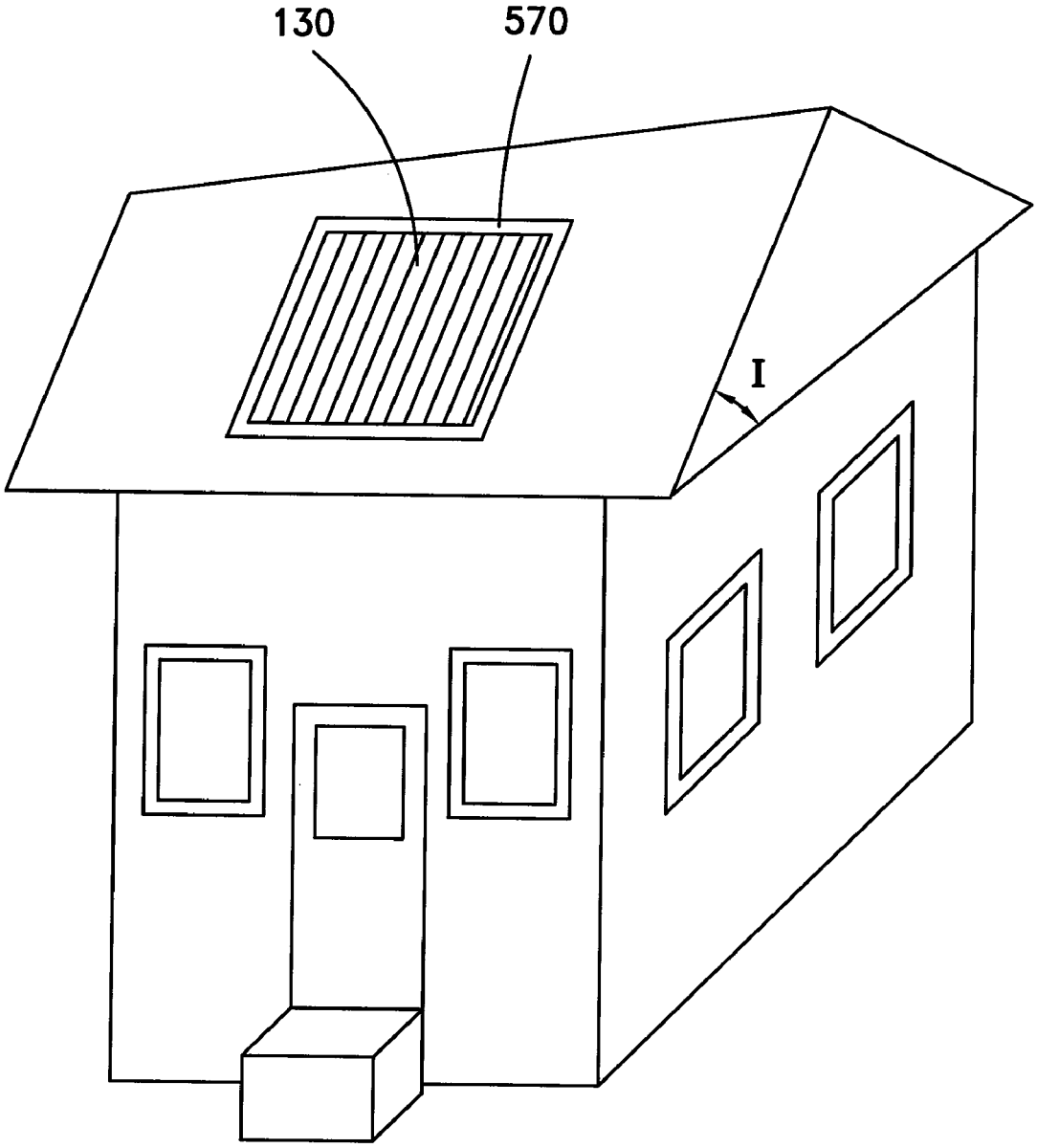
FIG. 38 is a perspective, schematic view of the blind of FIG. 1B being mounted in a skylight.

A blind 130 may be advantageously raised and lowered even when the blind is at an inclination I of up to 45 degrees relative to the ground, such as when mounted within a skylight 570, as shown in FIG. 38. As shown in FIG. 15, slat support 7, which has an arcuate profile, is insertable between fins 134 of side member 3 after headrail 4 and lower rail 52 are inserted within fins 134. Slat support 7 is accordingly guided by the two fins during longitudinal displacement with minimal clearance therefrom, e.g. 4.5 mm. Fins 134 are therefore adapted to prevent contact between the slats and the glass sheets when the blind is inclined, thereby preventing scratching of the glass and disarray of the slats, or even a malfunctioning of the blind. Due to the clearance between slat support 7 and fins 134, and furthermore between slats 14 and the glass sheets, a thermal break is created, whereby heat is not directly conducted from the exterior of the blind to its interior. Plastic inserts (not shown) are preferably inserted within the transversal ends of slat support 7, so that the slat support may slide when longitudinally displaced, such as when the blind is at an inclination I. The blind is operable to raise and lower the slats at an increased incline, e.g. 45 degrees, or an incline of 60 degrees if the slat support 7 is weighted, such as with lead.

Figure 31:
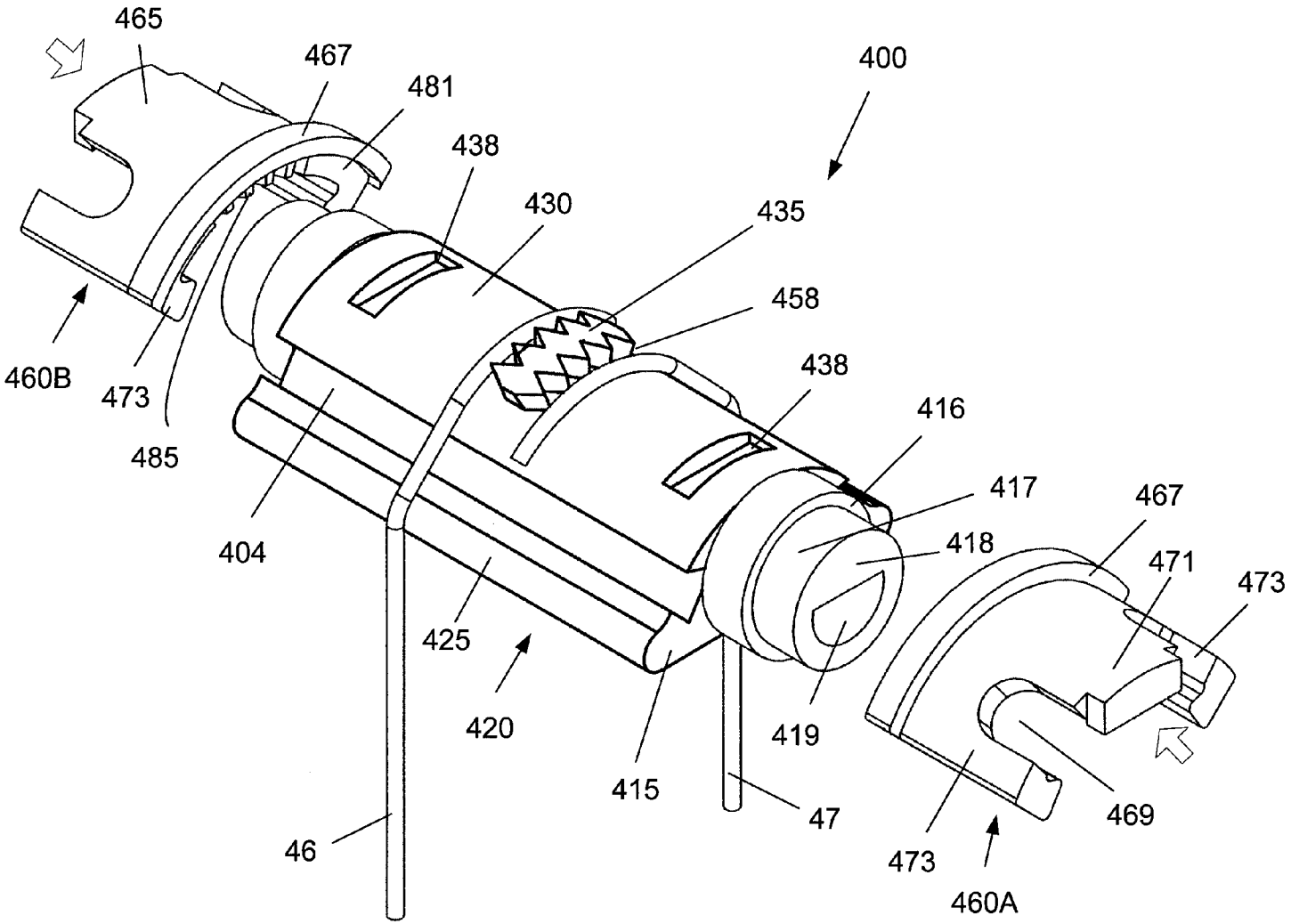
FIG. 31 illustrates a perspective, exploded view of another embodiment of a tilting device.

FIGS. 31-35 illustrate another embodiment of a tilting device which is generally designated by numeral 400. As shown in FIG. 31, tilting device 400 comprises core member 420 and two oppositely oriented wing members 460A and 460B which are engageable with core member 420, so as to retain outer cords 46 and 47 in a pressed relation with respect to core member 420.

Figure 32:
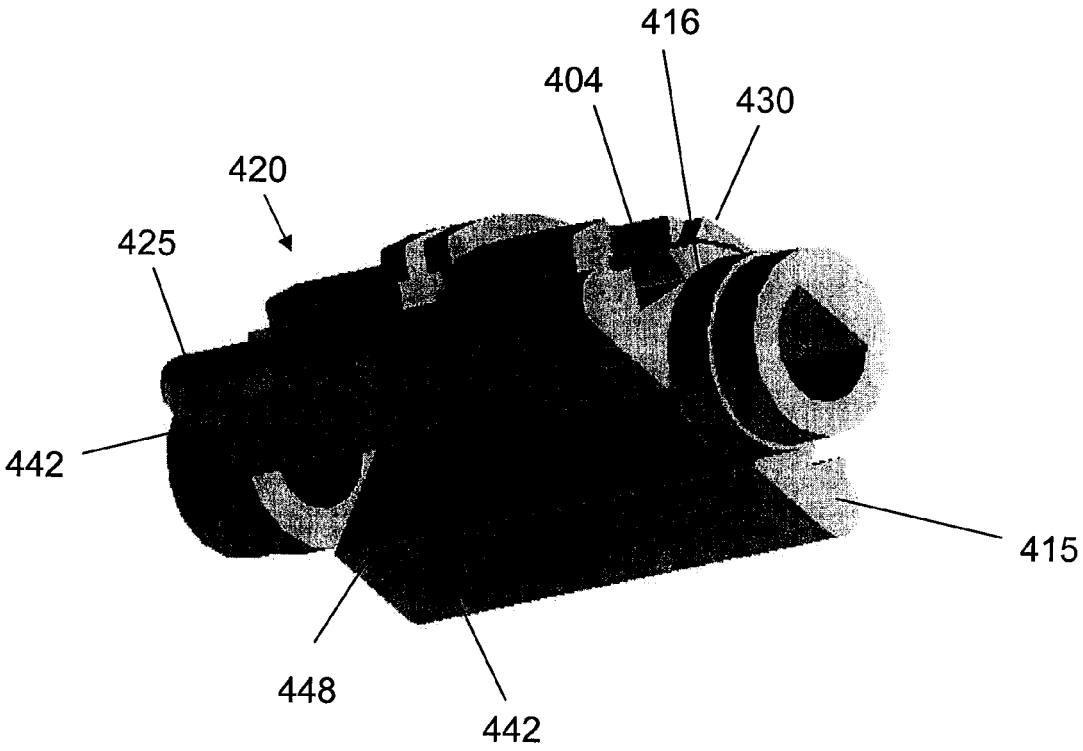
FIG. 32 illustrates a perspective view of a core member of the tilting device of FIG. 31, showing a shaft receiving channel formed therewithin.

With reference to FIGS. 31 and 32, core member 420 comprises two laterally oriented walls 415, convex periphery 430 between walls 415 and subtending an angle of approximately 180 degrees such that the axis thereof is transversally extending, toothed key 435 protruding outwardly from, and having a similar curvature as, periphery 430, and two separated coplanar elements 442 defining a rectangular face and a chord of walls 415 and of periphery 430. By providing core member 420 with a convex periphery, the thickness and therefore the structural integrity of the core member may be advantageously increased. Also, outer cords 46 and 47 may be affixed more easily when a core member 420 with a convex periphery 430 is employed.

The transversal dimension of periphery 430 is longer than the combined length of the two wing members 460A and 460B. Coaxial protrusions 416 and 417 extend transversally from each laterally oriented wall 415, wherein protrusion 416 has a greater outer diameter than protrusion 417 and laterally oriented face 418 of protrusion 417 is formed with a D-shaped aperture 419. The two D-shaped apertures 419 of core member 420 are aligned and are adapted to receive a D-shaped shaft, which may extend internally within channel 448 formed between elements 442. Elements 442 face outwardly when the slats of the blind are in a completely open position.

The entire length of convex periphery 430 including walls 415 is formed with two transversally extending grooves 404, each of which being formed at a different lateral side of protrusions 416. Each groove 404 has a rectangular cross section which is obliquely oriented with respect to coplanar elements 442. The two grooves 404 are separated by an angular distance of approximately 120 degrees and have bilateral symmetry. Portion 425 of convex periphery 430 between a groove 404 and the corresponding rectangular element 442 serves to tension an outer cord, as will be described hereinafter.

Convex periphery 430 is also formed with two circumferential, rectangularly shaped recesses 438 proximate to the transversal ends, respectively, of periphery 430. Recesses 438 and toothed key 435 have a substantially equal circumferential length and are equally spaced between grooves 404. Toothed key 435 is formed at the transversal centerline of periphery 430 and is integral therewith. Toothed key 435 has a series of laterally separated toothed serrations 458 of equal length and of similar configuration with alternating protruding pointed ends and recessed sharp edge junctions, on each transversal end thereof.

Figure 33:
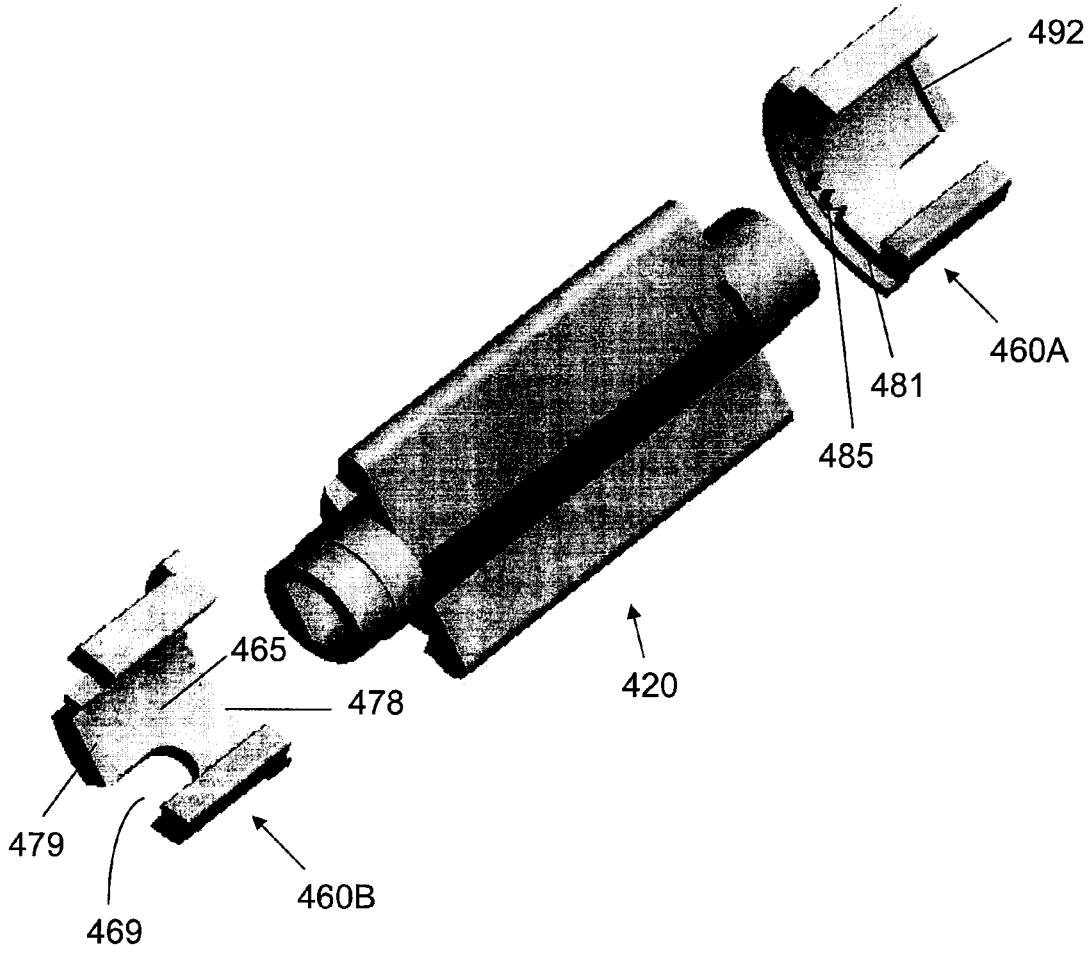
FIG. 33 illustrates another perspective, exploded view of the tilting device of FIG. 31.
Figure 34:
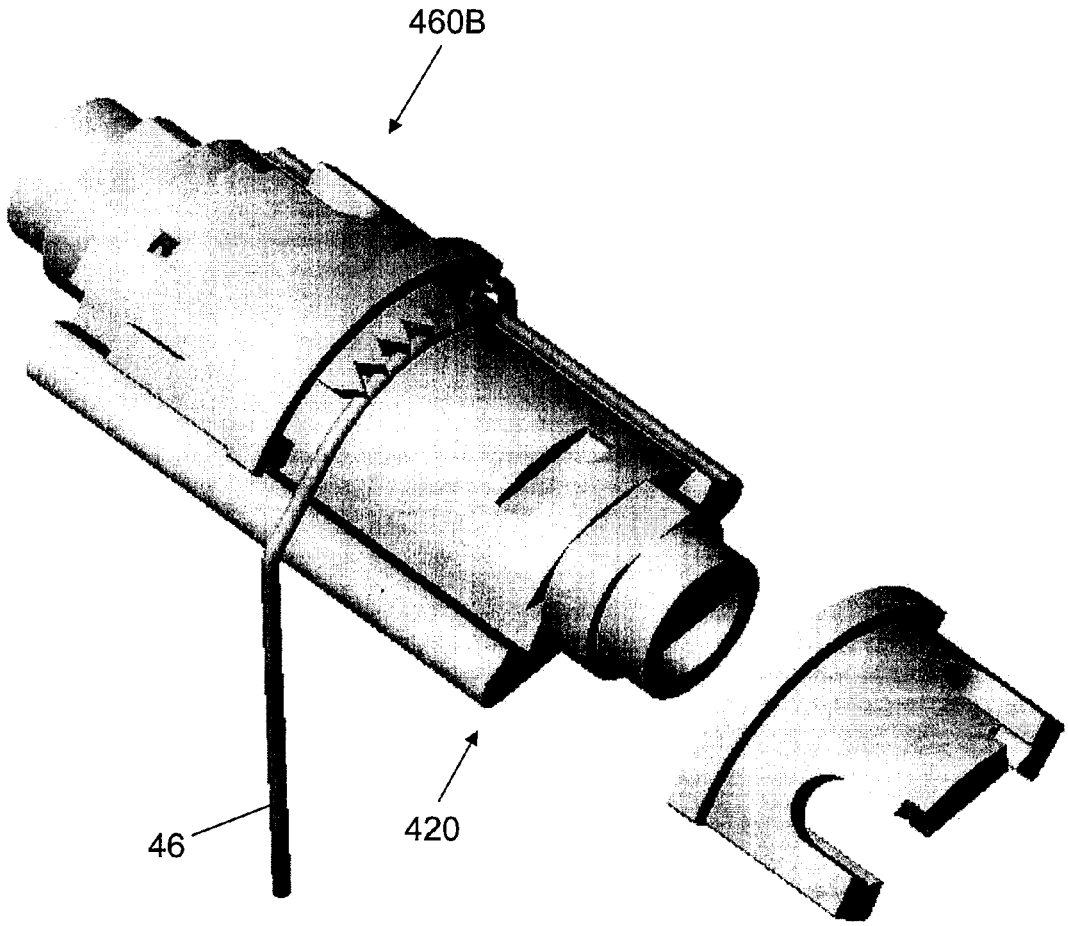
FIGS. 34 and 35 illustrate two stages in perspective view of assembling the tilting device of FIG. 31, illustrating the method of securing an outer cord of a corresponding ladder braid thereby.

Wing members 460A and 460B are illustrated in FIGS. 31, 33, and 34. Each wing member has a convex shell 465, which has a curvature substantially equal to that of convex periphery 430 of core member 420, subtending an angle of approximately 120 degrees and being positioned such that the axis thereof is transversally extending. Transversal end 478 of shell 465, which is proximate to toothed key 435, terminates with a rim 467 adjacent thereto having a radius slightly larger than that of periphery 465. The other transversal end 479 of the wing member shell is formed with two U-shaped openings 469, the curved wall of which faces rim 467, so as to define a central portion 471 and two peripheral portions 473. Each peripheral portion 473 is considerably thicker than central portion 471, and is configured to be received within a corresponding groove 404 of core member 420.

Transversal end 478 also has a laterally oriented circumferential wall 481, which extends between the two peripheral portions 473 along the inner wall of periphery 465. A plurality of radially extending teeth 485 are formed in a central region of circumferential wall 481. Teeth 485 are configured with a sufficient length and spacing therebetween so as to abut the recessed sharp edge junctions of toothed serrations 458 of toothed key 435. Transversal end 479 of wing member periphery 465 has a lip 492 which circumferentially extends along the inner wall of shell 465. Lip 492 has a circumferential length substantially equal to recess 438 of core member 420, and is adapted to engage the same with a snapping action.

In order to affix outer cords 46 and 47 to tilting device 400, outer cords 46 and 47 are first placed on periphery 430 of core member 420 in contact with the two transversal ends of serrations 458, respectively, while in a lateral orientation and dangling from a corresponding tensing portion 425 of core member 420, as shown in FIG. 32. Wing members 460A and 460B are then transversally displaced towards toothed key 435 such that peripheral portions 473 thereof are received in a corresponding groove 404 of core member 420. The wing members are displaced until teeth 485 thereof abut complementary serrations 458 of key 435 and lip 492 thereof snaps into corresponding recess 438 of core member 420. Outer cords 46 and 47 are thereby affixed to core member 420 by means of teeth 485 of a corresponding wing member as they abut complementary serrations 458 of key 435 by a pressing relation, and the outer cords are prevented from being dislodged from the tilting device since lip 492 is secured to a corresponding recess 438 by a snapping fit.

Figure 35:
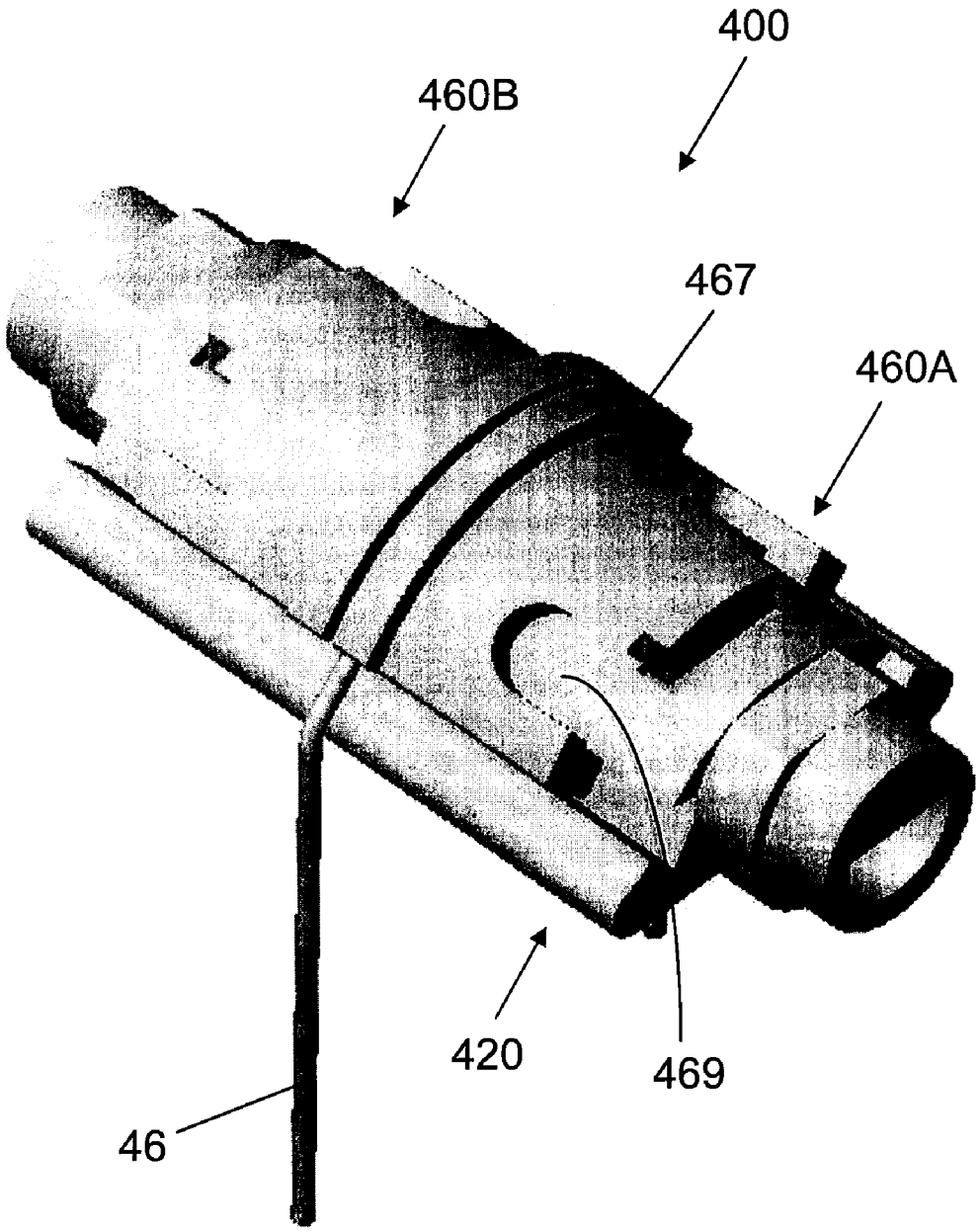

FIG. 34 illustrates core member 420 as wing member 460B is engaged therewith while outer cord 46 is not yet affixed. FIG. 35 illustrates core member 420 as wing members 460A and 460B are engaged t herewith and outer cord 46 is affixed to core member 420. If tilting device 400 were not assembled properly and outer cord 46 is therefore not sufficiently affixed to core member 420, rim 467 of wing member 460A retains outer cord 46 in contact with the periphery of core member 420, until tilting device 400 is reassembled. Wing member 460A is detachable from core member 420 upon manipulation of a suitable tool with one of the U-shaped openings 469.

Figure 29A:
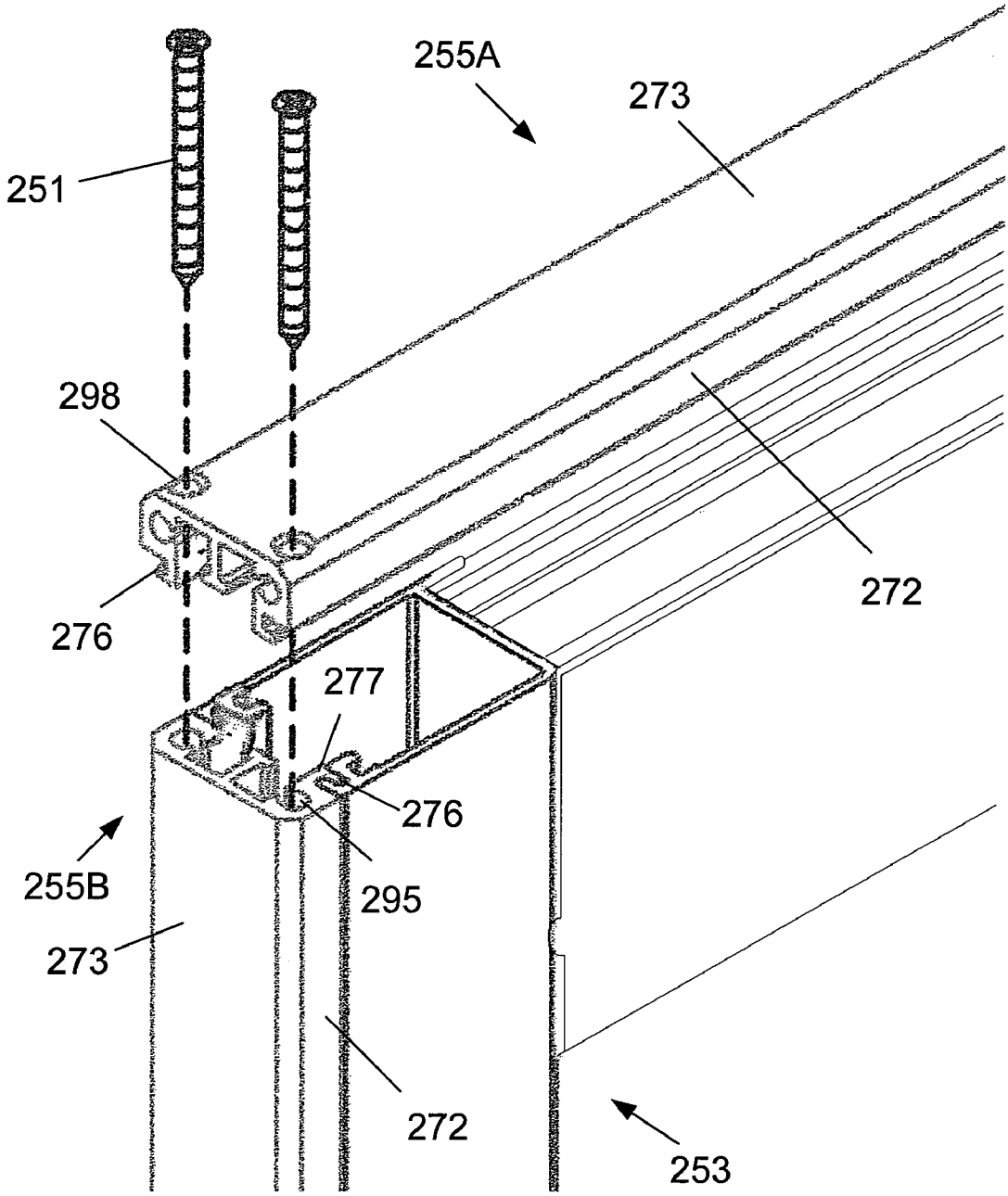
FIG. 29A is a perspective, exploded view which illustrates one method for assembling the frame of FIG. 24.
Figure 29B:
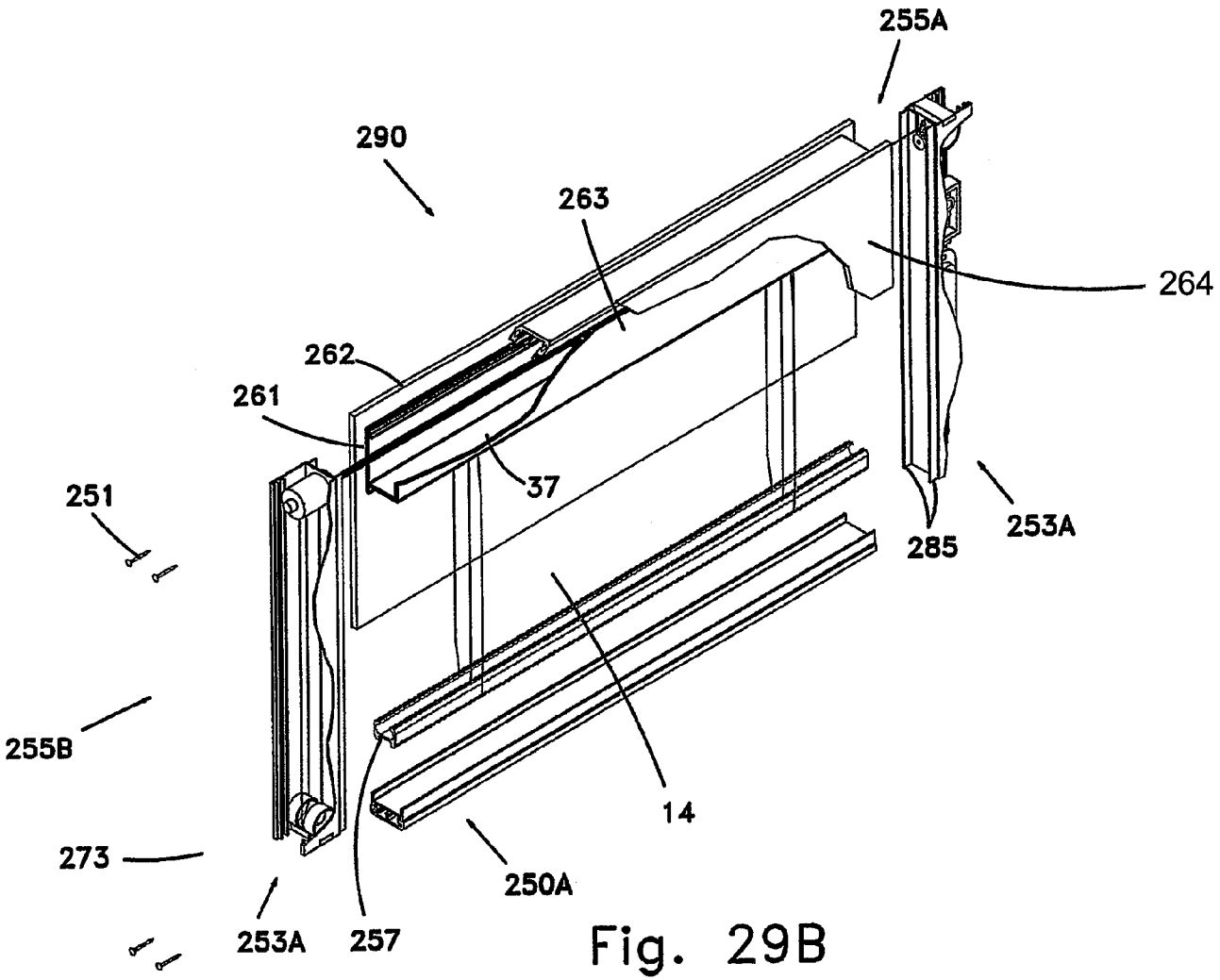
FIG. 29B is a perspective, exploded view of a blind which employs the frame of FIG. 24, illustrating another assembly method therefor.

It will be appreciated that tilting device 400 is suitable for tilting the slats associated with a blind of any of the aforementioned embodiments, for example the blind illustrated in FIGS. 2, 15 and 29B. Protrusions 416 (FIG. 31) of core member 420 are rotatably supported by the cord guide assembly illustrated in FIG. 3 or FIG. 22A, the latter being immobilized to headrail 4 as shown in FIG. 15, to headrail 254 as shown in FIG. 29B, or to lower rail 52 shown in FIG. 2.

Figure 29C:
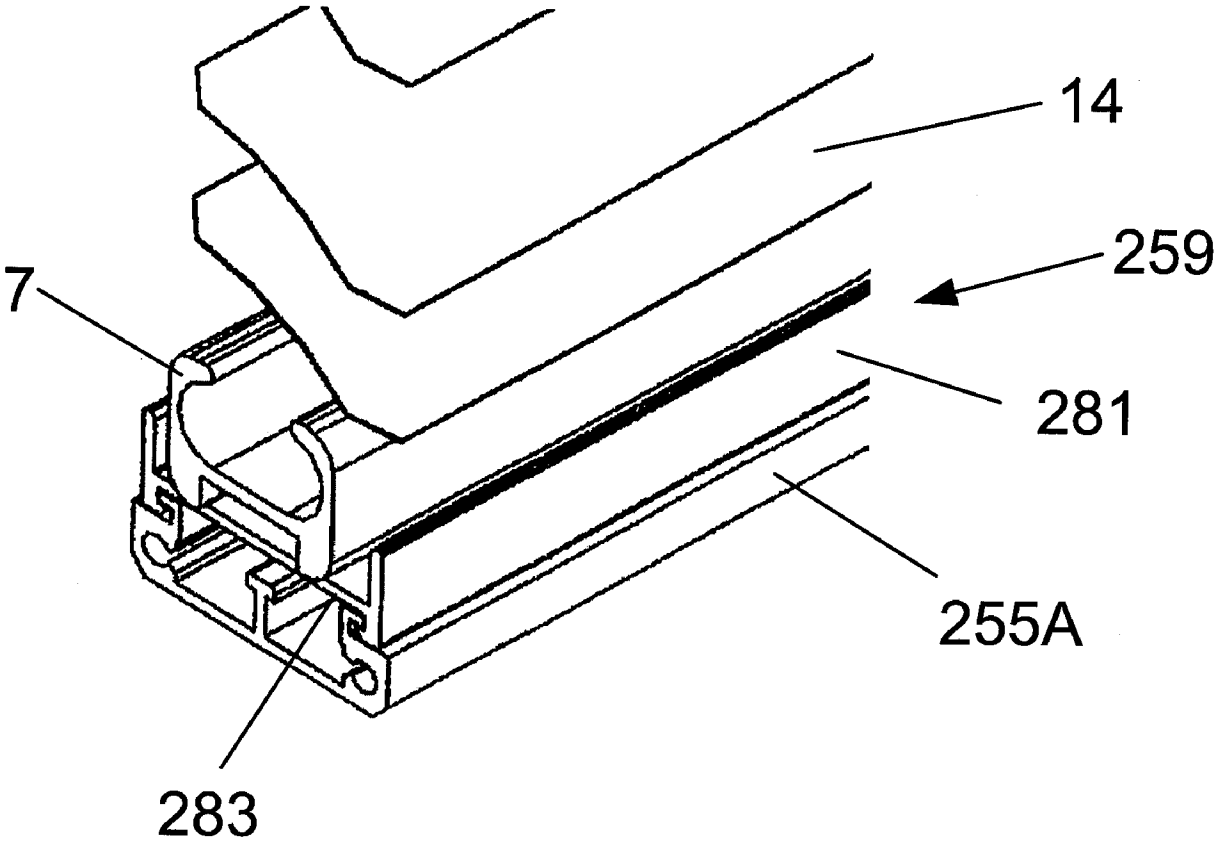
FIG. 29C illustrates the increased darkening capability of the blind of FIG. 29B as a slat support is lowered onto the lower supporting member of FIG. 27A.

With reference to FIG. 31, outer cord 46 is pressed by portion 425 of core member 420 when tilting device 400 is rotated clockwise about a transversally extending axis by a corresponding D-shaped shaft, thereby increasing the tension thereof. As outer cord 46 is pressed by portion 425, outer cord 46 is displaced upwards and inwards, being wound around portion 425 and then around the two planar elements 442 (FIG. 32). As clearly shown in FIG. 32, tilting device is advantageously configured such that the diameter of protrusion 416 is greater than the maximum radial dimension of laterally oriented wall 415 from periphery 430 to coplanar elements 442, particularly due to the provision of channel 448 formed between elements 442 to accommodate the D-shaped shaft, thereby precluding the need of a greater radially dimensioned wall 415 which would be needed to enclose the D-shaped shaft. Tensing portion 425 of core member 420 is consequently also of a relatively small thickness, e.g. no greater than 3 mm. As a result, tilting device 400 may achieve an increased angular displacement of up to 140 degrees while outer cord 46 contacts coplanar elements 442. Such an angular displacement of tilting device 400 assists in increasing the tension of outer cord 46, and the increased tension of outer cord 46 is instrumental in the improved closing of the slats by pressing on the top of each slat. By employing tilting device 400, the maximum inclination of the slats is such that the spacing between outer cords 46 and 47 changes from 17 mm when the slats are in a completely open position to only 3 mm when the slats are in a completely closed position. Consequently, approximately 93% of the incoming solar radiation can be blocked, due to the increased inclination of the slats relative to prior art internal blinds. The solar radiation blockage may be up to 95% when the arrangement shown in FIG. 29C is employed, as will be described hereinafter.

FIGS. 24-29 illustrate another embodiment of a blind frame, which is designated by numeral 250. While prior art frames for internal Venetian blinds are made from aluminum, the frame of this embodiment is made entirely from polyvinyl chloride (PVC), providing the blind with the following advantages:

1) A blind frame from PVC significantly reduces the cost of the blind. Since painted aluminum costs approximately $4/kg and PVC costs approximately $1.40/kg and the density of PVC is approximately one-half of aluminum, the cost of a blind frame made from PVC is approximately one-sixth of one made from aluminum.
2) The thermal conductivity of PVC is significantly less than that of aluminum (237 W/mK for aluminum and only 0.16 W/mK for PVC at 20° C.), and therefore a blind frame from PVC serves as thermal insulation, being well suited to very hot or very cold climates.
3) PVC is produced by extrusion. During the extrusion process, a PVC component may be produced with two layers wherein the base layer has a thickness ranging from 1-2 mm and the outer layer has a thickness ranging from 0.2-0.3 mm. The outer layer may be dyed to any desired color, and therefore the blind frame may be custom made. In contrast, aluminum needs to be painted separately after being produced, further increasing its price.

Figure 24:
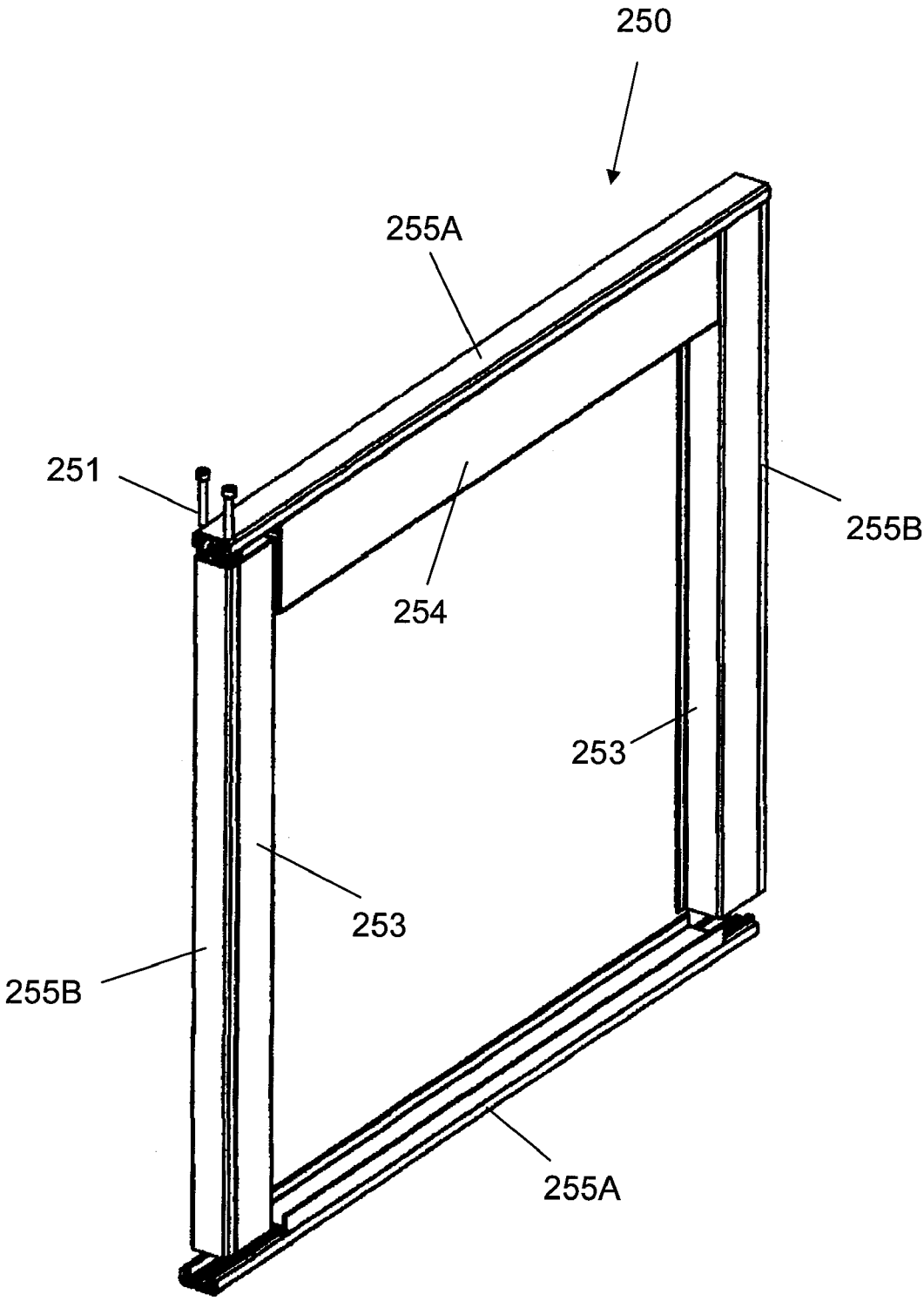
FIG. 24 is a perspective view of another embodiment of a blind frame.

As shown in FIG. 24, frame 250 comprises headrail 254, side members 253, lower support member 259 to support the slats when lowered, transversal covers 255A, and longitudinal covers 255B. A transversal cover 255A is the same component as longitudinal cover 255B, albeit with a different orientation. Headrail 254 has a similar configuration as side members 253, although the front and rear wall length of the two components is different. An additional flexible corner element, which may compromise the dimensional stability (i.e. the ability to avoid substantial unpredictable dimensional alteration after being subjected to extreme conditions such as heat, cold and moisture upon return to ambient conditions), is unnecessary since transversal covers 255A and longitudinal transversal covers 255B are connected together by screws 251. Another advantage of the configuration of frame 250 is that a lower rail is unnecessary since tilting is effected by longitudinally displacing actuator 140A and raising/lowering is effected by longitudinally displacing actuator 140B (FIG. 1B). The field of vision visible through the glass sheets is therefore increased. Furthermore, frame 250 is assembled from only three components, thereby reducing manufacturing cost and time.

Figure 25:
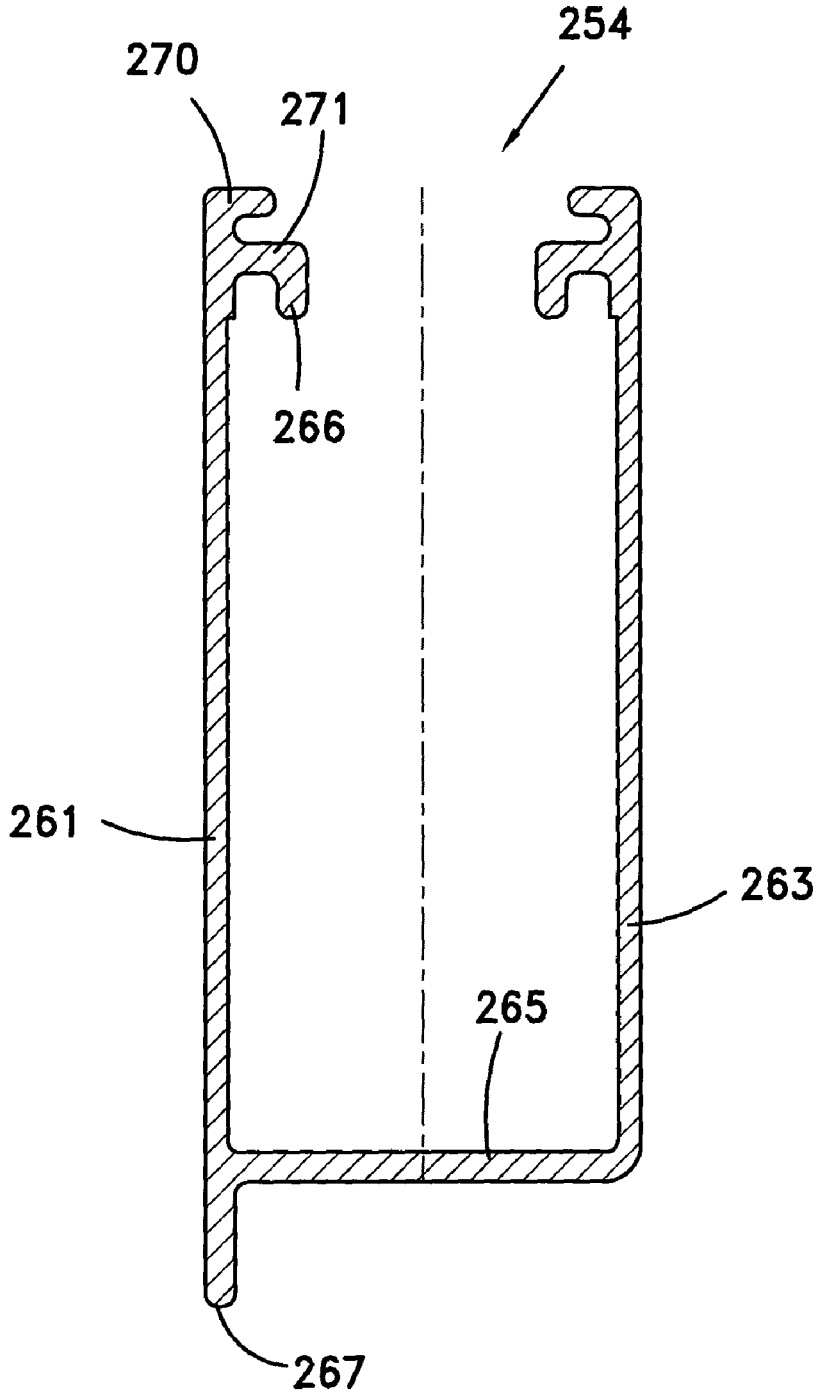
FIG. 25 is a side view of the headrail of the frame of FIG. 24.

A side view of headrail 254 is illustrated in FIG. 25. Headrail 254 is a rectilinear component provided with transversally oriented rear wall 261 and front wall 263, which are bonded to the glass sheets 262 and 264 (FIG. 29B) of the blind. Planar surface 265 is perpendicular to, and located above, lower longitudinal edge 267 of rear wall 261, and laterally extends to front wall 263. Mutually parallel, laterally oriented legs 270 and 271 perpendicularly protrude from the inner side of each of walls 261 and 263, with leg 271 being longer than leg 270. The upper surface of leg 270 defines the upper longitudinal edge of wall 261. Abutting element 266 longitudinally extends from the inward lateral end of leg 271 towards planar surface 265 for a sufficient distance to allow each wedge-shaped portion of a cord guide assembly, e.g. cord guide assembly, 37 as shown in FIG. 29B, to be inserted between longitudinally oriented abutting element 266 and the corresponding rear wall 261 or front wall 263, so as to be compressed and snapped in secured, undetachable relationship with respect to a corresponding set of leg 271, abutting element 266, and a wall of headrail 254.

Figure 27A:
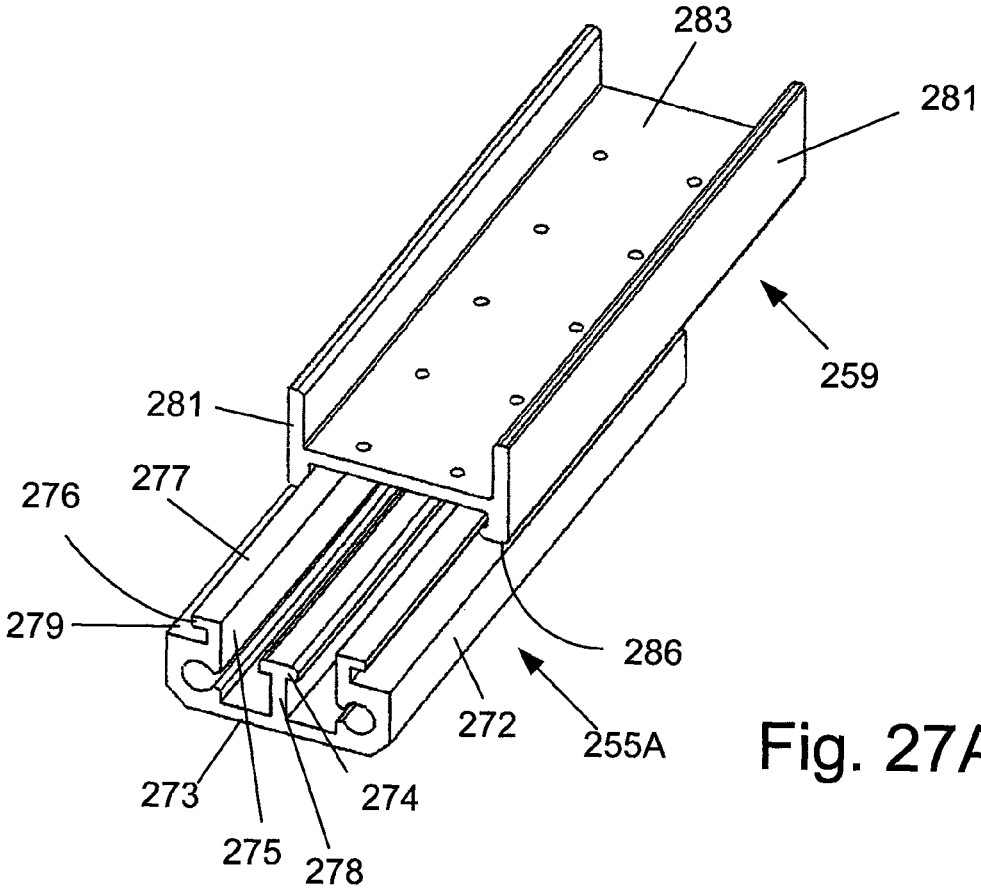
FIGS. 27A and 27B illustrate the engagement of the lower supporting member of the frame of FIG. 24 with a corresponding cover, wherein the lower supporting member and cover are in a transversally offset relation in FIG. 27A and are transversally aligned in FIG. 27B.

A perspective view of transversal cover 255A is illustrated in FIG. 27A. Transversal cover 255A comprises laterally oriented side walls 272, transversally oriented base portion 273 which is chamfered to coincide with each side wall 272, two laterally oriented inner walls 275, transversally oriented abutment surface 279, and transversally oriented leg 276 perpendicularly protruding from each inner wall 275, the lateral dimension of which being less than that of abutment surface 279. The spacing between abutment surface 279 and leg 276 is substantially equal to the thickness of headrail leg 270 (FIG. 25). Cover 255A also comprises transversally oriented dislodging preventing element 274, which is interposed between the two inner walls 275 and is substantially coplanar with abutment surfaces 279. Laterally oriented connecting element 278 extends from substantially the centerline of base portion 273 to dislodging preventing element 274 and is connected to the latter by a T-shaped connection.

Figure 26:
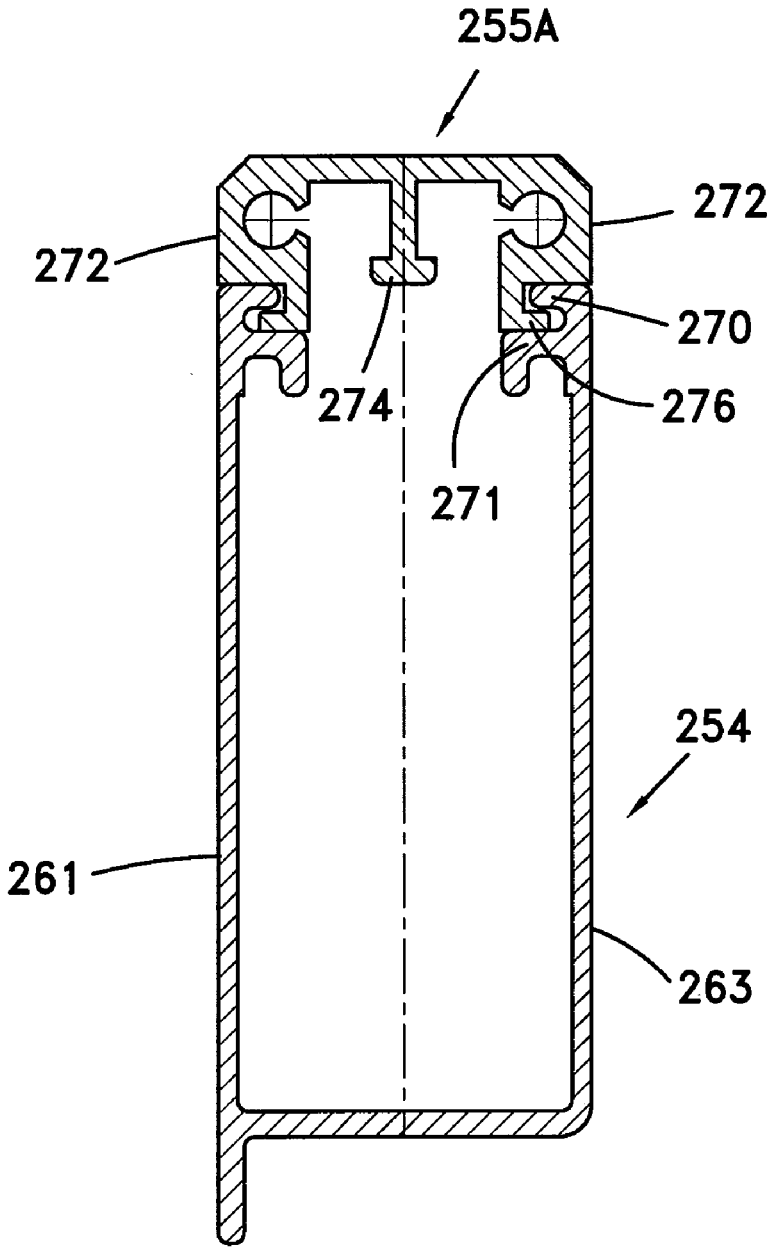
FIG. 26 is a side view of the headrail of FIG. 25 and a corresponding cover in interlocking relation.

A side view of a transversal cover 255A being interlocked with headrail 254 is illustrated in FIG. 26. Transversal cover 255A is adapted to be interlocked with a headrail 254 by a single snap after inserting each leg 276 of transversal cover 255A between corresponding legs 270 and 271 of headrail 254. After transversal cover 255A is interlocked with headrail 254 whereby legs 270 and 271 support abutment surfaces 279 and 277 (FIG. 27A), respectively, of transversal cover 255A, rear and front walls 261 and 263, respectively, of headrail 254 are coplanar with the corresponding side wall 272 of transversal cover 255A. Dislodging preventing element 274 contacts a tilting device, e.g. tilting device 31 of FIG. 4 or tilting device 400 of FIG. 31, as the tilting device is rotated, to retain the tilting device in the corresponding cord guide assembly in which it is rotatably supported.

Figure 27B:
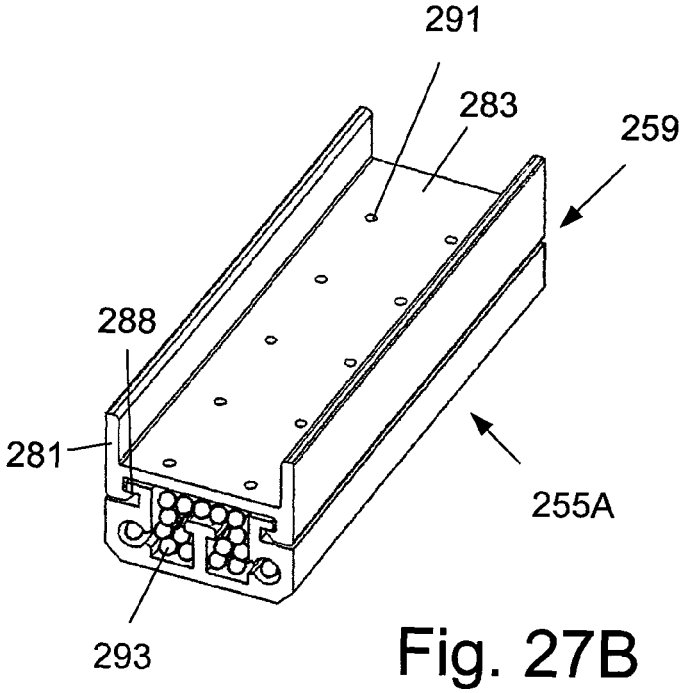

Support member 259, as illustrated in FIGS. 27A-B, is an H-shaped rectilinear component comprising two longitudinally oriented mounting surfaces 281 and transversally oriented plate 283 extending between the two mounting surfaces 281. The total longitudinal dimension of support member 259 is significantly less than lower rail 52 of FIG. 12, and therefore provides an increased field of vision visible through the glass sheets. The transversal length of support member 259 is substantially equal to that of the headrail. The distance between the lower longitudinal edge 286 of each mounting surface 281 and plate 283 is slightly greater than the distance between abutment surfaces 277 and 279. The lateral dimensional of support member 259 is substantially equal to that of transversal cover 255A. The lower longitudinal edge 286 of each mounting surface 281 terminates with an inwardly and upwardly oriented protuberance 288, which is so configured that when mounting surfaces 281 of support member 259 are placed on corresponding abutment surfaces 279 of transversal cover 255A, protuberance 288 contacts the underside of leg 276 as shown in FIG. 27B. Accordingly, support member 259 is afforded the ability of sliding over transversal cover 255A, so as to be displaced to a desired position. Alternatively, support member 259 may be snapped in place to transversal cover 255A by inserting the protuberance 288 of one mounting surface 281 between the corresponding leg 276 and abutment surface 279, and then flexing the other mounting surface such that its protuberance 288 is inserted by a press fit between the corresponding leg 276 and abutment surface 279.

During the extrusion of support member 259, plate 283 thereof is formed with a plurality of apertures 291. Consequently, the holding chamber defined by the volume between plate 283 of support member 259 and transversally oriented base portion 273 of transversal cover 255A, when support member 259 and transversal cover 255A are coupled, communicates with the interior of the blind via apertures 291. Hydrophilic pellets 293 placed within the holding chamber absorb any moisture that infiltrates to the interior of the blind.

Figure 28:
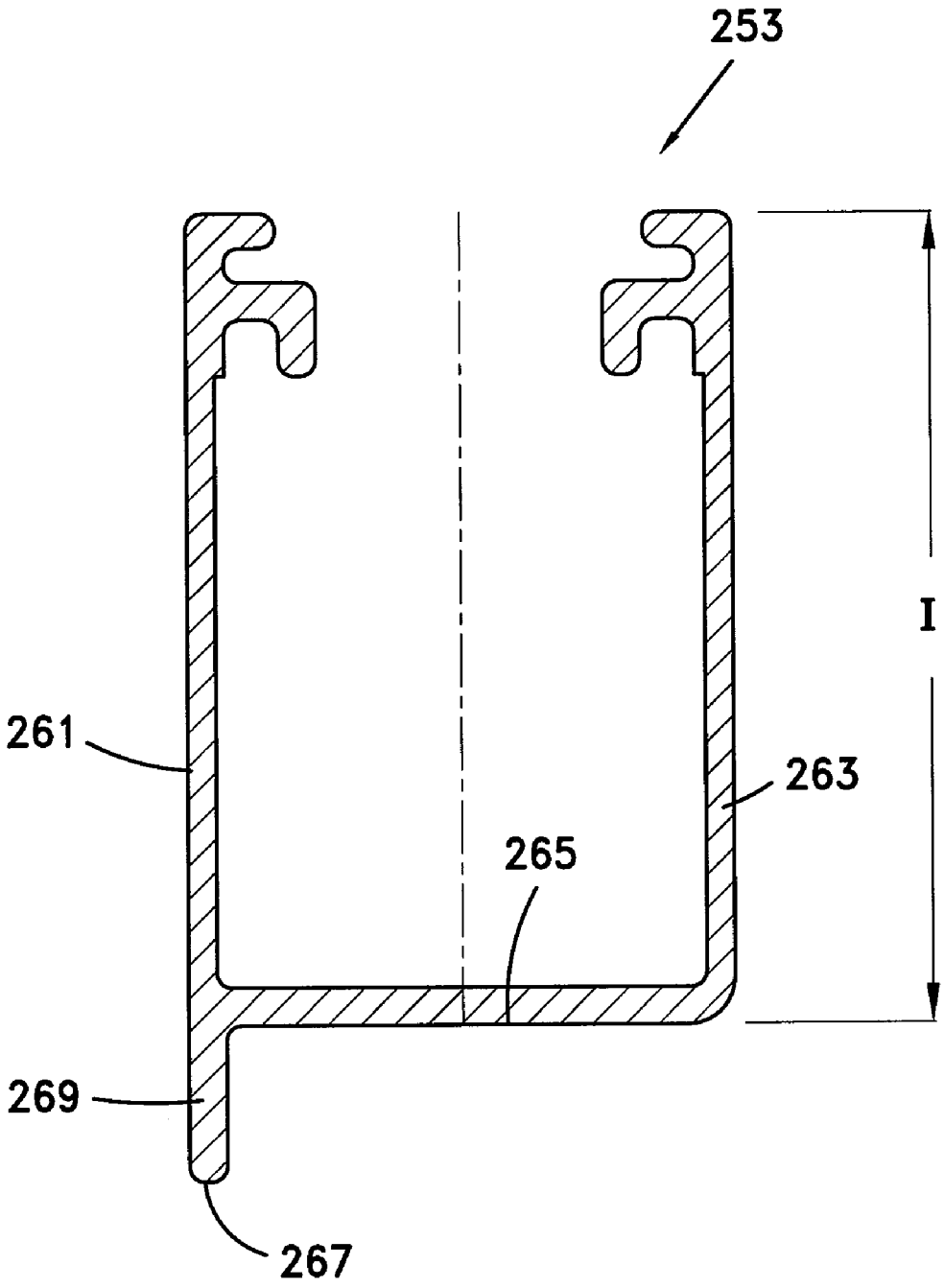
FIG. 28 is a top view of a side member of the frame of FIG. 24.

Side element 253 is illustrated in FIG. 28. Although side element 253 and headrail 254 have a similar configuration, front wall 263 of side element 253 has a length of I, which is less than the length J of the front wall of headrail 254 shown in FIG. 25. Portion 269 of rear wall 261 between planar surface 265 and transversal edge 267, which serves as a fin, has the same length for both side element 253 and headrail 254. For example, the side element front wall has a length I of 26 cm, the headrail front wall has a length J of 40 cm, and portion 269 has a length of 5 cm. A side element 253 having only one fin is employed for a blind having a surface area greater than 2 $m^2$.

As shown in FIG. 24, transversal cover 255A is longer than headrail 254 or support member 259, with the protruding portion on both sides of headrail 254 or support member 259 being equal to the combined transversal length of a side element 253 and the corresponding longitudinal cover 255B interlocked therewith. After headrail 254, support member 259, and each side element 253 is interlocked with the corresponding cover, the two transversal ends of each transversal cover 255A are connected to a longitudinal end of a corresponding longitudinal cover 255B.

FIGS. 29A and 29B illustrate two alternative methods of connecting a transversal cover 255A to a longitudinal cover 255B.

In FIG. 29A, longitudinal cover 255B is positioned such that side walls 272 are longitudinally extending and transversally oriented, base portion 273 is longitudinally extending and laterally oriented, and leg 276 is laterally oriented. The longitudinal length of longitudinal cover 255B and side element 253 are essentially equal. Longitudinal cover 255B has a concave screw insertion portion 295 formed in the inner wall of base portion 273 and the corresponding side wall 272. Screw insertion portion 295 subtends an angle of approximately 300 degrees and is truncated by the corresponding inner wall 277 perpendicular to leg 276.

Transversal cover 255A is positioned such that side walls 272 are transversally extending and longitudinally oriented, and base portion 273 is transversally extending and oriented. Apertures 298 bored within base portion 273 and surface 279 (FIG. 27A) of transversal cover 255A are aligned with a corresponding screw insertion portion 295 of a longitudinal cover 255B. When screws 251 are inserted within apertures 298 and are threadedly engaged to a fullest extent with the walls of the corresponding screw insertion portion 295, each leg 276 of a transversal cover 255A contacts the longitudinal edge of base portion 273 of the corresponding longitudinal cover 255B, thereby securing the fully assembled frame.

Alternatively, as shown in FIG. 29B, apertures are bored within base portion 273 and surface 279 (FIG. 27A) of longitudinal cover 255B. Screws 251 are inserted within the apertures bored within longitudinal cover 255B and are threadedly engaged to a fullest extent with the walls of the corresponding screw insertion portion of transversal cover 255A.

FIG. 29B illustrates a blind 290 in perspective, exploded form which employs frame 250A and is suitable for tilting and raising/lowering slats 14. It will be appreciated that frame 250A may also be employed for a blind that is suitable only for tilting the plurality of slats. Frame 250A is identical to frame 250 of FIG. 24 with the exception of side elements 253A. As shown, an alternative configuration of a side element has two parallel longitudinally oriented fins 285 of a length substantially equal to, and laterally spaced from, a corresponding side element wall. A side element having two fins is suitable for a blind having a surface area of less than 2 $m^2$. Fins 285 extend transversally from laterally oriented, longitudinally extending planar surface 265 (FIG. 28). As frame 250A is assembled, slat support 7 having an arcuate profile is received between fins 285. Slat support 7 is accordingly guided by fins 285 during longitudinal displacement of slats 14. Fins 285 are therefore adapted to prevent contact between slats 14 and glass sheets 262 and 264 when the blind is inclined, thereby increasing the darkening capability of the blind and preventing scratching of the glass and disarray of the slats, or even a malfunctioning of the blind.

When slats 14 are completely lowered, as shown in FIG. 29C, slat support 7 contacts plate 283 of lower support member 259, or is in close proximity thereto. The two longitudinally oriented mounting surfaces 281 of lower support member 259 advantageously block the incoming solar radiation between slat support 7 and plate 283, thereby increasing the darkening capability of the blind.

Figure 36:
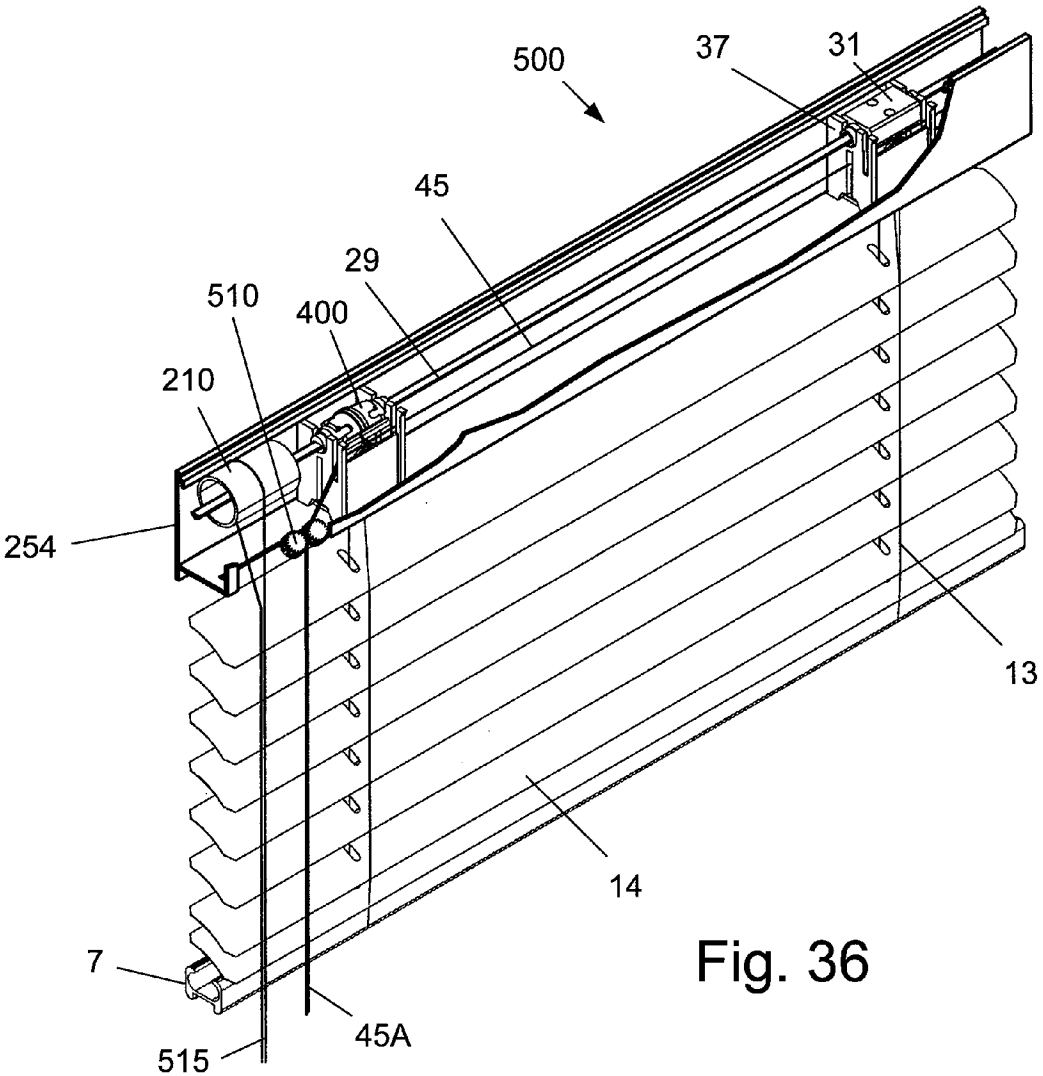
FIG. 36 is a perspective view of an external blind in accordance with the present invention.

FIG. 36 illustrates another embodiment of the invention, which is an external blind, i.e. slats 14 are not retained between two glass sheets, and is designated by numeral 500. Blind 500 is suitable for both tilting and raising/lowering the plurality of slats 14, and comprises the blind frame embodied by headrail 254 and a corresponding transversal cover (not shown), cord guide assemblies 37 secured to headrail 254 for each ladder braid 13, tilting devices 31 and/or 400, driving assembly 210, slat support 7 to which one end of each ladder braid 13 is attached, and cord lock 510 positioned within headrail 254 for securing each central cord 45 and thereby retaining the plurality of slats in a raised position. A D-shaped shaft 29 connects two adjacent tilting devices and connects driving assembly 210 with its neighboring tilting device.

Driving assembly 210 is conveniently and compactly housed within headrail 254. Actuator cord 515 is affixed to driving assembly 210. The two ends of actuator cord 515 may be attached to a suitable cord end (not shown), which serves as an actuator for driving assembly 210. As one end of actuator cord 515 is displaced, the other end thereof is displaced in an opposite direction, causing driving assembly 210 and tilting devices 31 and/or 400 to rotate in the same rotational direction and thereby causing slats 14 to tilt. Headrail 254 is provided with two cornered openings (not shown) to accommodate actuator cord 515 and central cord ends 45A, respectively. As central cord ends 45A are manipulated as well known to those skilled in the art to release the same from cord lock 510, the central cord 45 of each ladder braid 13 may be lowered or raised according to the discretion of the operator and then cord ends 45A are secured again to cord lock 510.

Blind 500 advantageously provides tilting and raising/lowering arrangements that are directly driven, without need of a gear train or any other transmission, as has been employed heretofore in prior art external blinds, thereby lowering the cost of the blind. Additionally, tilting devices 31 and/or 400, about which the outer cords are wound upon rotation of driving assembly 210, are configured to simplify the mounting thereof on cord guide assembly 37 and the affixation of the outer cords thereto, and to furthermore allow the outer cords to be essentially longitudinally disposed from headrail 254 to slat support 7, thereby affording the blind with increased reliability with respect to the prior art. Also, tilting devices 31 and/or 400 can rotate an increased angular distance with respect to those of the prior art, and therefore blind 500 can block at least 90% of the incoming light. Moreover, cord guide assembly 37 provides a lateral centering capability of the central cords, so as to prevent entanglement of the cords during transportation of the blind.

It will be appreciated that any other aforementioned configuration of the cord guide assembly, driving assembly, headrail, and transversal cover may similarly be employed in conjunction with blind 500.

Reliability Tests

A manually operable internal Venetian blind adapted for tilting and lowering/raising a plurality of slats was tested for reliability by Hollis Metal Industries Ltd., Industrial Zone Alon-Tavor, Israel between May 29, 2005 and Jun. 21, 2005. The Quality Assurance Group supervised the measurement of the tolerance tests, and the Electronic Group supervised the counting of the testing cycles and verified the operation of the testing apparatus.

The blind had a height of 200 cm and a width of 100 cm, and the slats had a width of 16 mm. The lowering/raising arrangement had a stroke length of 80 cm, i.e. 40% of the distance to which the longitudinally lowest slat is raised or lowered. The tilting arrangement had a stroke length of 4 cm. The arrangement for tilting the slats included a driving assembly having a D-shaped core and a plurality of radially extending ribs, and tilting devices to which the corresponding outer cords were affixed by nails having radial protrusions. A laterally centering cord guide assembly was used.

The blind was mounted without its glass sheets onto a custom made testing apparatus. The testing apparatus had a motor for actuating the tilting arrangement and the lowering/raising arrangement simultaneously, an electronic control system for the motor, sensors for detecting the end of the actuator stroke, and an electronic counting system. A first pulley and a second pulley having a considerably smaller diameter than that of the first pulley were mounted on the drive shaft of the motor, and a third pulley was driven by a cord wound around the second pulley. A cord wound around the first pulley was connected to the counterweight of the lowering/raising arrangement and simulated the action of a linear actuator. The cord wound around the third pulley was connected to the internal magnet housing of the tilting arrangement, to which was connected another counterweight, and simulated the action of a linear actuator. The transmission of the first, second and third pulleys was such that the stroke length ratio of the tilting arrangement counterweight to the lowering/raising counterweight was 1:20, and the tilting and lowering/raising arrangements underwent the same number of testing cycles. The bearing housing was removed from the tilting arrangement since glass sheets were not used. The testing conditions did not simulate solar radiation radiating on the blind.

Prior to the first testing cycle, selected components of the blind were visually inspected and measured. Each measurement had a tolerance of 0.001 mm. The following components were selected for inspection and measurement:

a) bearing housing;

b) driving assembly;

c) cord guide assemblies;

d) 3 tilting devices;

e) nails with radial protrusions;

f) 2 bearing blocks;

g) interconnecting plastic rod;

h) 2 plain bearings: housed in a bearing block;

i) 4 bearings made from polyacetal: housed in a bearing housing of the tilting arrangement and in a cord guide assembly; and j) 2 ball bearings: housed in a bearing block and bearing housing.

After inspection, the components were assembled and a first group of 26,680 testing cycles was performed. Each testing cycle included the following steps applied to the lowering/raising arrangement: a) the counterweight was raised for a duration of 13 seconds; b) a delay of 3 seconds; c) the counterweight was lowered for a duration of 10 second; and d) a delay of 2 seconds. The aforementioned components were removed from the blind, and a second visual inspection and measurement of the components was performed. The measured level of wear of the aforementioned components did not exceed the permissible value of 1 mm, with greatest measured level of wear being no more than 0.4 mm.

The aforementioned components were assembled and a second group of 20,180 testing cycles was performed. The aforementioned components were removed from the blind, and a third visual inspection and measurement of the components was performed. The measured level of wear of the aforementioned components ranged from 0-0.7 mm. Some small signs of wear were noticeable on the metallic components which did not negatively influence the operation of the blind. With the exception of the interconnecting plastic rod, no signs of wear were noticeable on the plastic components. Some small signs of wear were noticeable on the interconnecting plastic rod which did not negatively influence the operation of the blind.

The following are three examples of the measured wear:

A) Diameter of the arcuate opening of the cord guide assembly—

1. Measurement 1-6.85 mm

2. Measurement 2-6.85 mm

3. Measurement 3-6.85 mm

B) Diameter of the inner portion of the ball bearing housed in the bearing block, over which the central cords were wound—

1. Measurement 1-15.73 mm
2. Measurement 2-15.68 mm
3. Measurement 3-15.68 mm

C) Diameter of the connecting element which transversally extends between the longitudinally rod and the contractible elements of the interconnecting plastic rod—

1. Measurement 1-4.96 mm
2. Measurement 2-4.95 mm
3. Measurement 3-4.88 mm

The diameter of the connecting element remained greater than the accepted tolerance of 2 mm.

Since the blind is actuated on the average 3 times a day, it can be concluded, after a total number of 46,860 testing cycles without noticeable wear, that the blind of the present invention can operate reliably for at least 42 years without failing.

While some embodiments of the invention have been described by way of illustration, it will be apparent that the invention can be carried into practice with many modifications, variations and adaptations, and with the use of numerous equivalents or alternative solutions that are within the scope of persons skilled in the art, without, departing from the spirit of the invention or exceeding the scope of the claims.

The invention claimed is:

1. A manually operable internal Venetian blind adapted for lowering and raising a plurality of slats, comprising:

a. A frame comprising a transversally extending headrail and lower support member, each of which having at least one planar support surface, and two longitudinally extending side members positioned at each transversal end of said blind, said frame being interposed between two glass sheets;

b. A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids further comprise a longitudinally extending central cord passing through each slat;

c. A transversally oriented slat support disposed underneath said plurality of slats to which each of said ladder braids is affixed;

d. A bearing housing for housing a ball bearing, wherein said bearing housing is secured to the upper longitudinal end of a first side member;

e. A bifurcated bearing block longitudinally displaceable within said first side member which houses a ball bearing, said bifurcated bearing block comprising two symmetrical rectilinear sections for housing a ball bearing therebetween, each of said sections being formed of an upper laterally thicker portion and a lower laterally narrower portion, said thicker portion being above said narrower portion, each of said thicker portions being formed with a circular recess to receive therein a corresponding bearing flange and an annular portion outwardly protruding from the back of said recess in which a corresponding bearing axle is seated, wherein the narrower portions are mated such that each upper portion is spaced one from the other with only a bearing rim located between said bearing flanges being visible, a hole being bored through said mated narrower portions;

f. A rollerless counterweight longitudinally displaceable within said first side member and comprising a central portion and two outward portions, each of said outward portions being disposed laterally outwardly from said central portion, at least one internal magnet being housed in said counterweight;

g. A stabilizer affixed proximate to the upper longitudinal end of said first side member; and h. A first linearly displaceable actuator disposed outwardly to one of said glass sheets and provided with at least one external magnet in opposed relation to, and at a fixed distance from, said at least one internal magnet which is housed in said counterweight, said external and internal magnets being magnetically coupled, wherein said bearing block and said counterweight are two separate components and interconnected such that said bearing block is interposed between said counterweight and said bearing housing, wherein each central cord is transversally oriented within said headrail, is wound around the ball bearing housed in said bearing housing, is further wound around the ball bearing housed in said bearing block, and the ends of each central cord are affixed to said stabilizer, said stabilizer thereby applying a reactive force to each of the central cords during displacement of said central cords, said counterweight and said bearing block being longitudinally displaceable upon linear displacement of said first actuator, the displacement of said first actuator being significantly less than the distance to which the longitudinally lowest slat is raised or lowered due to the winding of said central cords around the ball bearing of said bearing block.

2. The blind according to claim 1, wherein a hole is bored through a portion of the central portion of the counterweight longitudinally protruding from said outward portions, said bearing block and counterweight being interconnected by means of a plastic rod fit into the hole bored through said lower portions of said bearing block and into the hole bored through said central portion of the counterweight.

3. The blind according to claim 2, wherein the displacement of the actuator is 40% of the distance to which the longitudinally lowest slat is raised or lowered.

4. The blind according to claim 1, wherein the headrail and/or lower support member comprise at least one planar transversally oriented support surface, two transversally extending walls perpendicular to said support surface which are bonded to the two glass sheets, respectively, and mutually parallel, laterally oriented and transversally extending legs which perpendicularly protrude from the inner side of each of said walls such that a first leg has a longer lateral dimension than a second leg.

5. The blind according to claim 1, further comprising a transversally extending cover interlocked with the headrail and two longitudinally extending covers interlocked with the side members, respectively.

6. The blind according to claim 5, further comprising a transversally extending cover interlocked with the lower support member.

7. The blind according to claim 6, wherein a transversally extending cover has the same configuration as a longitudinally extending cover.

8. The blind according to claim 1, wherein a side member comprises two longitudinally oriented walls, a laterally oriented wall interposed between said longitudinally oriented walls, two parallel longitudinally oriented fins extending from an inner face of said laterally oriented wall, and two sets of mutually parallel, laterally oriented and longitudinally extending legs which perpendicularly protrude from the inner side of a corresponding longitudinally oriented wall.

9. The blind according to claim 8, wherein the lateral dimension of the counterweight is substantially equal to that of the laterally oriented wall of the side member.

10. The blind according to claim 8, wherein two longitudinally oriented walls of the headrail or of the lower support member are disposed between the fins of each of the two side members.

11. The blind according to claim 8, wherein first and second legs of a side member interlock with a laterally oriented and longitudinally extending leg of a corresponding longitudinally extending cover.

12. The blind according to claim 5, wherein the frame further comprises a two-sided corner made of a thermoplastic molded material and provided with wedge-shaped teeth on the inner faces thereof, said corner being insertable by a snap fit within the interior of a longitudinally extending cover and an adjacent transversally extending cover in such a way that said wedge -shaped teeth are engageable with a corresponding planar surface of said longitudinally extending cover and said transversally extending cover.

13. The blind according to claim 8, wherein the bearing housing has a laterally oriented base and two parallel, flexible rings which longitudinally protrude from said base, a ball bearing and a pair of plain bearings for supporting and positioning said ball bearing being housed in said bearing housing.

14. The blind according to claim 13, wherein each parallel ring of the bearing housing is spaced from a corresponding lateral end of the housing to define a shoulder.

15. The blind according to claim 14, wherein each shoulder is supported by a cut-out formed in a corresponding longitudinally oriented wall of the side member, the parallel rings being inwardly facing with respect to the base of the bearing housing.

16. The blind according to claim 15, wherein each parallel ring is in pressed engagement with the laterally oriented wall and a corresponding third leg of the side member to which the bearing housing is secured.

17. The blind according to claim 8, wherein the stabilizer is secured to a groove cut in the laterally oriented wall of the side member.

18. The blind according to claim 8, wherein the slat support is disposed between the fins of the two side members.

19. The blind according to claim 1, wherein the plurality of slats define a blind surface area of up to 5 square meters.

20. The blind according to claim 4, wherein the frame is made from PVC.

21. The blind according to claim 20, wherein the side members have the same configuration as the headrail.

22. A manually operable internal Venetian blind adapted for lowering and raising a plurality of slats, comprising:

a) A frame made from PVC comprising a transversally extending headrail and lower support member, each of which having at least one planar support surface, and two longitudinally extending side members positioned at each transversal end of said blind, said frame being interposed between two glass sheets;

b) A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids further comprise a longitudinally extending central cord passing through each slat;

c) A transversally oriented slat support disposed underneath said plurality of slats to which each of said ladder braids is affixed;

d) A bearing housing for housing a ball bearing, wherein said bearing housing is secured to the upper longitudinal end of a first side member;

e) A bifurcated bearing block longitudinally displaceable within said first side member which houses a ball bearing;

f) A rollerless counterweight longitudinally displaceable within said first side member and comprising a central portion and two outward portions, each of said outward portions being disposed laterally outwardly from said central portion, at least one internal magnet being housed in said counterweight;

g) A stabilizer affixed proximate to the upper longitudinal end of said first side member; and h) A first linearly displaceable actuator disposed outwardly to one of said glass sheets and provided with at least one external magnet in opposed relation to, and at a fixed distance from, said at least one internal magnet which is housed in said counterweight, said external and internal magnets being magnetically coupled, wherein said bearing block and said counterweight are two separate components and interconnected such that said bearing block is interposed between said counterweight and said bearing housing, wherein each central cord is transversally oriented within said headrail, is wound around the ball bearing housed in said bearing housing, is further wound around the ball bearing housed in said bearing block, and the ends of each central cord are affixed to said stabilizer, said stabilizer thereby applying a reactive force to each of the central cords during displacement of said central cords, said counterweight and said bearing block being longitudinally displaceable upon linear displacement of said first actuator, the displacement of said first actuator being significantly less than the distance to which the longitudinally lowest slat is raised or lowered due to the winding of said central cords around the ball bearing of said bearing block, wherein frame members selected from the group consisting of the headrail, the lower support member, and the headrail and lower support member comprise at least one planar transversally oriented support surface, two transversally extending walls perpendicular to said support surface which are bonded to the two glass sheets, respectively, and mutually parallel, laterally oriented and transversally extending legs which perpendicularly protrude from the inner side of each of said walls such that a first leg has a longer lateral dimension than a second leg; and wherein a cover comprises two mutually parallel side walls, a base portion perpendicular to said side walls, two inner walls each of which is parallel to a corresponding side wall, an abutment surface extending from one of said side walls to a corresponding inner wall, and a leg perpendicularly extending from a corresponding inner wall towards a corresponding side wall, the width of one of said legs being shorter than that of said abutment surface.

23. The blind according to claim 22, wherein the spacing between the abutment surface and a corresponding leg of the cover is substantially equal to the thickness of the second leg of the headrail, thereby allowing the headrail to be interlocked with the corresponding transversally extending cover.

24. The blind according to claim 22, wherein the cover further comprises a transversally oriented element for preventing the dislodging of a tilting device during the rotation thereof, said dislodging preventing element being interposed between the two inner walls and being connected to the base portion by a T-shaped connection.

25. The blind according to claim 22, wherein a longitudinally extending cover further comprises a concave screw insertion portion formed in the inner wall of the base portion and the corresponding side wall thereof, a screw passing through an aperture bored within the base portion and abutment surface of a transversally extending cover and being aligned with corresponding screw insertion portion of the longitudinally extending cover being threadedly engaged with said corresponding screw insertion portion, the transversal dimension of said transversally extending cover being longer than that of the headrail.

26. The blind according to claim 25, wherein the screw insertion portion subtends an angle of approximately 300 degrees and is truncated by the corresponding inner wall.

27. The blind according to claim 22, wherein the lower support member is H-shaped.

28. The blind according to claim 27, wherein the lower support member has two longitudinally oriented mounting surfaces and a transversally oriented plate extending between the two mounting surfaces.

29. The blind according to claim 27, wherein the lateral dimensional of the lower support member is substantially equal to that of a transversally extending cover.

30. The blind according to claim 28, wherein the lower longitudinal edge of each mounting surface terminates with an inwardly and upwardly oriented protuberance which is engageable with a leg and corresponding abutment surface of a transversally extending cover.

31. The blind according to claim 30, wherein the plate of the lower support member is formed with a plurality of apertures, hydrophilic pellets placed within a holding chamber defined by the volume between the plate of the lower support member and the base portion of the transversally extending cover being adapted to absorb moisture that infiltrates to the interior of the blind.

32. The blind according to claim 1, further comprising means for laterally centering the central cords.

33. The blind according to claim 32, wherein the means for laterally centering the central cords comprises a cord guide assembly secured to the headrail, said cord guide assembly being formed with— a. transversally and laterally oriented walls;

b. a rectangular opening in each of said laterally oriented walls, at essentially the lateral centerline thereof;

c. internal lateral walls extending from a corresponding transversally oriented wall which are suitably configured so as to allow each axle of a bearing element to be rotatingly seated between a pair of said internal lateral walls wherein the axis of said axles is laterally oriented;

d. a pair of parallel, transversally extending partitions, the spacing between said partitions being substantially equal to the lateral dimension of said rectangular opening, such that a central cord is transversally fed through said cord guide assembly via said rectangular openings and said partitions, said partitions being adapted to limit, when said blind is tilted, the lateral movement of a central cord fed through said cord guide assembly and in contact with said bearing element.

34. The blind according to claim 33, wherein a longitudinal wall of the rectangular opening is adapted to contact a central cord fed therethrough when the blind is completely inverted and to further urge said central cord to the lateral centerline of the cord guide assembly.

35. The blind according to claim 1, wherein the blind is operable for raising and lowering the plurality of slats when the frame is inclined relative to a horizontal plane.

36. The blind according to claim 35, wherein the inclination of the frame is up to 45 degrees, relative to a horizontal plane.

37. The blind according to claim 35, wherein the inclination of the frame is up to 60 degrees, relative to a horizontal plane, when the slat support is weighted.

38. A manually operable internal Venetian blind adapted for lowering and raising a plurality of slats, comprising:

a) A frame comprising a transversally extending headrail and lower support member, each of which having at least one planar support surface, and two longitudinally extending side members positioned at each transversal end of said blind, said frame being interposed between two glass sheets;

b) A plurality of transversally extending, equally sized slats suspended from said headrail by means of at least two ladder braids, each ladder braid comprising two longitudinally extending outer cords, each of which being disposed laterally outward from a different lateral edge of the slats, and a plurality of laterally extending cross ladders, each cross ladder being connected to the two outer cords and supporting a corresponding slat, wherein two outwardly positioned ladder braids further comprise a longitudinally extending central cord passing through each slat;

c) A transversally oriented slat support disposed underneath said plurality of slats to which each of said ladder braids is affixed;

d) A bearing housing for housing a ball bearing, wherein said bearing housing is secured to the upper longitudinal end of a first side member;

e) A bifurcated bearing block longitudinally displaceable within said first side member which houses a ball bearing;

f) A rollerless counterweight longitudinally displaceable within said first side member and comprising a central portion and two outward portions, each of said outward portions being disposed laterally outwardly from said central portion, at least one internal magnet being housed in said counterweight;

g) A stabilizer affixed proximate to the upper longitudinal end of said first side member; and h) A first linearly displaceable actuator disposed outwardly to one of said glass sheets and provided with at least one external magnet in opposed relation to, and at a fixed distance from, said at least one internal magnet which is housed in said counterweight, said external and internal magnets being magnetically coupled, wherein said side member comprises two longitudinally oriented walls, a laterally oriented wall interposed between said longitudinally oriented walls, two parallel longitudinally oriented fins extending from an inner face of said laterally oriented wall, and two sets of mutually parallel, laterally oriented and longitudinally extending legs which perpendicularly protrude from the inner side of a corresponding longitudinally oriented wall, wherein said bearing block and said counterweight are two separate components and interconnected such that said bearing block is interposed between said counterweight and said bearing housing, wherein each central cord is transversally oriented within said headrail, is wound around the ball bearing housed in said bearing housing, is further wound around the ball bearing housed in said bearing block, and the ends of each central cord are affixed to said stabilizer, said stabilizer thereby applying a reactive force to each of the central cords during displacement of said central cords, said counterweight and said bearing block being longitudinally displaceable upon linear displacement of said first actuator, the displacement of said first actuator being significantly less than the distance to which the longitudinally lowest slat is raised or lowered due to the winding of said central cords around the ball bearing of said bearing block, wherein said blind further comprises an arrangement for tilting the plurality of slates, said arrangement comprising:

i. for each ladder braid, a device for tilting said plurality of slats to which two outer cords of a corresponding ladder braid are affixed, each of said tilting devices comprising two laterally oriented sides, a rectangular face perpendicular to said laterally oriented sides, and first and second annular transversally extending outwardly from each laterally oriented side, wherein the first annular protrusion of each of said tilting devices is rotatably supported by a corresponding arcuate wall formed within a laterally oriented wall of a cord guide assembly which is secured to the headrail and is rotatable about a transversal axis coincident with the axis of said first annular, one end of a transversally extending shaft for rotating a corresponding tilting device being received in said second annular protrusion;

ii. a driving assembly having a cylindrical casing in which a hole is bored through the periphery thereof, and receiving means for receiving one of said shafts, said casing being rotatably supported within the walls of a circular aperture formed within a first longitudinal end of the laterally oriented wall of a second side member;

iii. a second linearly displaceable actuator comprising an internal magnet housing and an external magnet housing;

iv. a bearing element rotatingly supported by a bearing housing secured to a second longitudinal end of the laterally oriented wall of said second side member; and v. an actuator cord partially wound about said bearing element rotatingly supported by the bearing housing secured to the second longitudinal end of the laterally oriented wall of said second side member and fed through a hole bored in an abutment plate of said internal magnet housing and through said hole of said casing, the ends of said actuator cord being tied to each other, wherein longitudinal displacement of said external magnet housing results in corresponding longitudinal displacement of said actuator cord, causing said driving assembly and each of said shafts to rotate in unison, and wherein an outer cord is partially wound around, and tensioned by, a corresponding tilting device during rotation thereof upon rotation of each of said shafts, said outer cord being subsequently longitudinally and laterally displaced, causing uniform tilting of each of said slats.

39. The blind according to claim 38, wherein the second linearly displaceable actuator comprises:

a. An actuator guide mounted by a press fit between a glass sheet and a frame element of the wall opening in which the blind is placed, a linear track having an arcuate cross section being formed within said actuator guide;

b. An external magnet housing having a body for the insertion therein of an external magnet and an L-shaped appendage protruding from said body, said L-shaped appendage being adapted to be slidingly displaceable within said track; and c. An internal magnet housing positioned within the second side member, said internal magnet housing being formed with an outwardly facing cavity for the insertion therein of an internal magnet in opposed relation to, and at a fixed distance from, said external magnet, an elongated element parallel to the back of said outwardly facing cavity, a bridge connecting between said elongated element and the back of said outwardly facing cavity, and coplanar abutment plates extending from each of the elongated element and cavity back to such a length such that a gap is formed between said abutment plates, said internal and external magnets being of opposite polarity and adapted to be displaced in unison following displacement of said body.

* * * * *